US005514529A

United States Patent [19]

Mihayashi et al.

[11] Patent Number: 5,514,529

[45] Date of Patent: May 7, 1996

[54] SILVER HALIDE COLOR PHOTOGRAPHIC LIGHT-SENSITIVE MATERIAL CONTAINING CHEMICALLY SENSITIZED GRAINS AND PUG COMPOUND

[75] Inventors: Keiji Mihayashi; Atsuhiro Ohkawa, both of Minami-ashigara, Japan

[73] Assignee: Fuji Photo Film Co., Ltd., Kanagawa, Japan

[21] Appl. No.: 906,670

[22] Filed: Jun. 30, 1992

[30] Foreign Application Priority Data

Jul. 2, 1991 [JP] Japan ..... 3-187067

[51] Int. Cl.[6] ..... G03C 1/08; G03C 7/26; G03C 7/32; G03C 8/00

[52] U.S. Cl. ..... 430/544; 430/223; 430/567; 430/551; 430/505; 430/955; 430/957

[58] Field of Search ..... 430/544, 223, 430/567, 551, 505, 543, 549, 955, 957

[56] References Cited

U.S. PATENT DOCUMENTS

| | | | |
|---|---|---|---|
| 4,439,520 | 3/1984 | Kofron et al. | 430/434 |
| 4,861,701 | 8/1989 | Burns | 430/543 |
| 4,965,180 | 10/1990 | Suematsu et al. | 430/518 |
| 5,118,597 | 6/1992 | Mihayashi et al. | 430/544 |
| 5,350,666 | 9/1994 | Motoki | 430/544 |

FOREIGN PATENT DOCUMENTS

| | | |
|---|---|---|
| 0282896 | 9/1988 | European Pat. Off. . |
| 0337370 | 10/1989 | European Pat. Off. . |
| 0438129 | 7/1991 | European Pat. Off. . |
| 60-218645 | 11/1985 | Japan . |

OTHER PUBLICATIONS

European Search Report.

*Primary Examiner*—Charles L. Bowers, Jr.
*Assistant Examiner*—J. Pasterczyk
*Attorney, Agent, or Firm*—Sughrue, Mion, Zinn, Macpeak & Seas

[57] ABSTRACT

A light-sensitive material having at least one emulsion layer containing silver halide grains, wherein tabular grains having an average aspect ratio of 2 or more occupy at least 50% of the total projected area of all grains, and the material contains a compound which releases two photographically useful groups from one molecule through a timing group and/or a compound which releases a photographically useful group through two timing groups.

12 Claims, No Drawings

SILVER HALIDE COLOR PHOTOGRAPHIC LIGHT-SENSITIVE MATERIAL CONTAINING CHEMICALLY SENSITIZED GRAINS AND PUG COMPOUND

BACKGROUND OF THE INVENTION

1. Field of the Invention

The present invention relates to a silver halide color photographic light-sensitive material. More particularly, it relates to a silver halide color photographic light-sensitive material which contains a silver halide emulsion having tabular grains and a novel, development inhibitor-releasing compound, which excels in sensitivity, sharpness, color reproduction, graininess and pressure resistance, and which has its photographic properties little changed while being stored.

2. Description of the Related Art

There is a demand for a silver halide color photographic light-sensitive material, particularly one for photographing, which has high light-sensitivity and excels in graininess, color reproduction and sharpness, and which has its photographic properties little changed while being stored.

As means for improving the sharpness and color reproduction of a light-sensitive material, a timing DIR coupler which releases a development-inhibiting compound through two timing groups is known. DIR couplers of this type are disclosed in, for example, JP-A-51-146828, ("JP-A" means Published Unexamined Japanese Patent Application), JP-A-60-218645, JP-A-61-156127, JP-A-63-37346, JP-A-1-280755, JP-A-1-219747, JP-A-2-230139, Laid-open European Patent Applications 348139, 354532, and 403019. The use of a timing DIR coupler indeed enhances inter-layer effect or edge effect and improves sharpness and color reproduction to some extent. However, neither the inter-layer effect nor the edge effect can be sufficient. This is because release of the development-inhibiting compound is one step, and its timing is inappropriate. Further, there is a problem that light-sensitive material containing these couplers have their photographic properties changed greatly while being stored.

In order to provide a light-sensitive material which has high sensitivity and excels in graininess and sharpness, it is proposed in, for example, JP-A-58-113934, that tabular silver halide grains be used which has an aspect ratio (i.e., the ratio of the diameter of each grain to the thickness thereof) of 8:1 or more. The material containing such silver halide grains is, however, dissatisfactory in terms of color reproduction, graininess and storage stability.

SUMMARY OF THE INVENTION

A first object of the present invention is to provide a light-sensitive material which has high light-sensitivity and excels in graininess, color reproduction and sharpness.

A second object of the invention is to provide a light-sensitive material which has its photographic properties little changed while being stored.

A third object of this invention is to provide a light-sensitive material which can be manufactured at low cost and excels in image quality, by using an emulsion having good graininess and a timing DIR coupler which performs its function well even if used in a small amount.

A fourth object of the invention is to provide a light-sensitive material which excels in pressure resistance, and thus has its photographic properties little changed even if applied with a pressure.

These objects of the invention have been achieved by a silver halide color light-sensitive material which comprises a support and at least one light-sensitive emulsion layer formed on the support, wherein at least one of the emulsion layers contains a silver halide emulsion comprising tabular grains having an average aspect ratio of 2 or more, and at least one of the emulsion layers contains a compound represented by the following formula (I) and/or a compound represented by the following formula (II).

$$A-(L_1)_j-(L_2)_m+(L_3)_n-PUG]_s \qquad \text{Formula (I)}$$

where A is a coupler residue or a redox group, $L_1$ and $L_3$ are divalent timing groups, $L_2$ is a timing group of tri- or more valent, PUG is a photographically useful group, j and n are independently 0, 1 or 2, m is an integer of 1 or 2, s is 2 or greater and is determined by subtracting 1 from the valence of $L_2$, if there are two or more $L_1$, $L_2$ or $L_3$ in the molecule, they are either identical or different, and if there are two or more PUGs in the molecule, they are either identical or different;

$$A\text{-}L_4\text{-}L_5\text{-}PUG \qquad \text{Formula (II)}$$

where A and PUG are of the same definition as made in conjunction with formula (I), $L_4$ is —OCO— group, —OSO group, —$OSO_2$— group, —OCS— group, —SCO— group, —SCS— group, or —$WCR_{11}R_{12}$— group, where W is oxygen, sulfur or tertiary amino group (—$NR_{13}$—), $R_{11}$ and $R_{12}$ are independently hydrogen or a substituent, $R_{13}$ is a substituent, $R_{11}$, $R_{12}$ and $R_{13}$ are divalent groups and capable of combining in some cases, forming a ring, $L_5$ is a group which releases PUG by electron transfer along a conjugated system or a group defined by $L_4$.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

DETAILED DESCRIPTION OF THE PREFERRED EMBODIMENTS

The couplers represented by the formulas (I) and (II) will now be described in detail.

As has been pointed out, A in the formula (I) is a coupler residue or a redox group. Examples of the coupler residue are: a yellow coupler residue (e.g., an open chain ketomethylene-type coupler residue such as acylacetoanilide or malondianilide); a magenta coupler residue (e.g., a coupler residue of such as 5-pyrazolone-type, pyrazolotriazole-type, or imdazopyrazole-type); a cyan coupler residue (e.g., a coupler residue of phenol-type, naphthol-type, or imidazole-type disclosed in Laid-open European Patent Application 249,453, and a pyrazopyridine-type coupler residue disclosed in Laid-open European Patent Application 304,001); and a colorless compound forming coupler residue (e.g., a coupler residue of indanone-type or acetophenone-type). Other examples of the coupler residue are the heterocyclic coupler residues which are disclosed in U.S. Pat. No. 4,315,070, U.S. Pat. No. 4,183,752, U.S. Pat. No. 4,174,969, U.S. Pat. No. 3,961,959 and U.S. Pat. No. 4,171,223, and JP-A-52-82423.

If A in the formula (I) is a redox group, this is a group that can be oxidized by an oxidized form of a developing agent. Examples of the redox group are: hydroquinones, catechols, pyrogallols, 1,4-naphthohydroquinones, 1,2-naphthohydroquinones, sulfon amidephenols, and sulfonamidenaphthols. These groups can be those disclosed in JP-A-61-230135, JP-A-62-251746, JP-A-61-278852, U.S. Pat. No. 3,364,022, U.S. Pat. No. 3,379,529, U.S. Pat. No. 3,639,417, U.S. Pat. No. 4,684,604, and J. Org. Chem., 29,588 (1964).

Preferable examples of A are coupler residues represented by the following formulas (Cp-1), (Cp-2), (Cp-3), (Cp-4), (Cp-5), (Cp-6), (Cp-7), (Cp-8), (Cp-9), (Cp-10), and (Cp-11), since these couplers have high coupling rates.

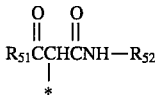

Formula (Cp-1)

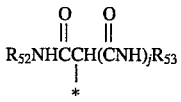

Formula (Cp-2)

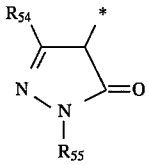

Formula (Cp-3)

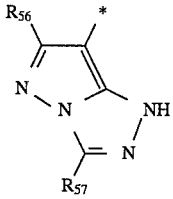

Formula (Cp-4)

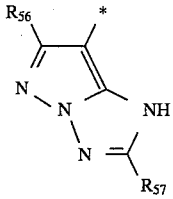

Formula (Cp-5)

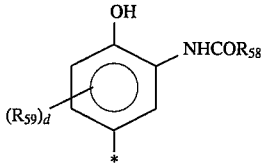

Formula (Cp-6)

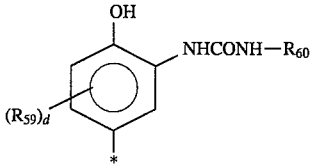

Formula (Cp-7)

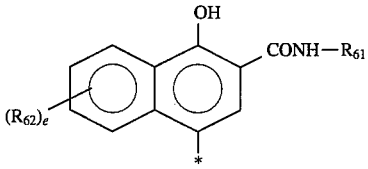

Formula (Cp-8)

-continued

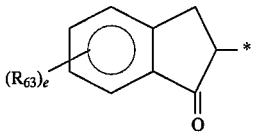

Formula (Cp-9)

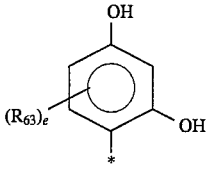

Formula (Cp-10)

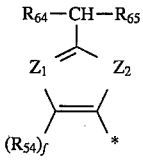

Formula (Cp-11)

In the formulas (Cp-1) to (Cp-11), the mark * extending from a coupling position represents the position where $L_1$ et seq. are coupled to in the formula (I), and also the position where $L_4$ et seq. are coupled to in the formula (II).

When, in the formulas (Cp-1) to (Cp-11), $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{62}$, $R_{63}$, $R_{64}$, or $R_{65}$ comprises a nondiffusing group, the total carbon number thereof is 8 to 40, preferably 10 to 30. Otherwise, these groups should preferably have a total of 15 carbon atoms or less.

$R_{51}$ to $R_{65}$, k, d, e, and f, shown in the formulas (Cp-1) to (Cp-11), will be explained in detail. $R_{41}$ is an aliphatic group, an aromatic group or a heterocyclic group, and $R_{42}$ is an aromatic group or a heterocyclic group. $R_{43}$, $R_{44}$, and $R_{45}$ are hydrogen, aliphatic groups, aromatic groups, or heterocyclic groups.

$R_{51}$ is equal to $R_{41}$. $R_{52}$ and $R_{53}$ are equal to $R_{42}$. The notation of k is 0 or 1. $R_{54}$ is equal to $R_{41}$ or is $R_{41}CON(R_{43})$— group, $R_{41}R_{43}N$— group, $R_{41}SO_2N(R_{43})$— group, $R_{41}S$— group, $R_{43}O$— group, $R_{45}N(R_{43})CON(R_{44})$— group, or ≡C— group. $R_{55}$ is equal to $R_{41}$. $R_{56}$ and $R_{57}$ are equal to $R_{43}$, or are $R_{41}S$— groups, $R_{43}O$— groups, $R_{41}CON(R_{43})$— groups, or $R_{41}SO_2N(R_{43})$— groups. $R_{58}$ is equal to $R_{41}$. $R_{59}$ is equal to $R_{41}$, or it represents $R_{41}CON(R_{43})$— group, $R_{41}OCON(R_{43})$— group, $R_{41}SO_2N(R_{43})$— group, $R_{43}R_{44}NCON(R_{45})$— group, $R_{41}O$— group, $R_{41}S$— group, a halogen atom, or $R_{41}R_{43}N$— group. The notation of "d" is an integer from 0 to 3. If d is plural, the plural $R_{59}$ groups are substituents which are the same or different, or can be divalent groups combining together, forming a ring such as pyridine ring or a pyrrole ring. $R_{60}$ and $R_{61}$ are equal to $R_{41}$. $R_{62}$ is equal to $R_{41}$, or $R_{41}OCONH$— group, $R_{41}SO_2NH$— group, $R_{43}R_{44}NCON(R_{45})$— group, $R_{43}RNSO_2(R_{45})$— group, $R_{43}O$— group, $R_{41}S$— group, a halogen atom, or $R_{41}R_{43}N$— group. $R_{63}$ is equal to $R_{41}$, or is $R_{43}CON(R_{45})$— group, $R_{43}R_{44}NCO$— group, $R_{41}SO_2N(R_{44})$— group, $R_{43}R_{44}NSO_2$—group, $R_{41}SO_2$— group, $R_{43}OCO$— group, $R_{43}O$—$SO_2$— group, a halogen atom, nitro, cyano, or $R_{43}CO$— group. The notation of "e" is an integer from 0 to 4. When $R_{62}$ or $R_{63}$ are plural, these groups are either same or different. $R_{64}$ and $R_{65}$ are $R_{43}R_{44}NCO$— groups, $R_{41}CO$— groups, $R_{43}R_{44}NSO_2$—groups, $R_{41}OCO$— groups, $R_{41}SO_2$—groups, nitro, or cyano. $Z_1$ is nitrogen or $=C(R_{66})$—group, where $R_{66}$ is hydrogen or equal to $R_{63}$. $Z_2$ is sulfur or oxygen. The notation of "f" is either 0 or 1.

The aliphatic groups, mentioned above, are aliphatic hydrocarbon group which has 1 to 32 carbon atoms, preferably 1 to 22 carbon atoms, and are saturated or unsaturated, chain or cyclic, straight-chain or branched chain, and substituted or unsubstituted. Typical examples of the aliphatic groups are: methyl, ethyl, propyl, isopropyl, butyl, (t)-butyl, (i)-butyl, (t)-amyl, hexyl, cyclohexyl, 2-ethylhexyl, octyl, 1,1,3,3-tetramethylbutyl, decyl, dodecyl, hexadecyl, or octadecyl.

The aromatic groups, also mentioned above, are those having 6 to 20 carbon atoms, preferably substituted or unsubstituted phenyl groups or substituted or unsubstituted naphthyl groups.

The heterocyclic groups, mentioned above, are preferably substituted or unsubstituted 3- to 8-membered heterocyclic groups, which have 1 to 20 carbon atoms, more preferably 1 to 7 carbon atoms, and at least one hetero atom selected from nitrogen, oxygen and sulfur. Typical examples of the heterocyclic groups are: 2-pyridyl, 2-furyl, 2-imidazolyl, 1-indolyl, 2,4-dioxo-1,3-imidazolidin-5-yl, 2-benzoxazolyl, 1,2,4-triazol-3-yl or 4-pyrazolyl.

when the aliphatic hydrocarbon groups, the aromatic groups and the heterocyclic groups have a substituent or substituents, typical examples of the substituent are: a halogen atom, $R_{47}O$— group, $R_{46}S$— group, $R_{47}CON(R_{48})$— group, $R_{47}N(R_{48})CO$— group, $R_{46}OCON(R_{47})$— group, $R_{46}SO_2N(R_{47})$— group, $R_{47}R_{48}NSO_2$— group, $R_{46}SO_2$— group, $R_{47}OCO$— group, $R_{47}R_{48}NCON(R_{49})$— group, group of the same meaning as $R_{46}$, $R_{46}COO$— group, $R_{47}OSO_2$— group, cyano, nitro. $R_{46}$ is an aliphatic group, an aromatic group, or a heterocyclic group. $R_{47}$, $R_{48}$, and $R_{49}$ are aliphatic groups, aromatic groups, heterocyclic groups, or hydrogen. The aliphatic group, the aromatic group, and the heterocyclic group have the same meanings as defined above.

Preferable ranges for $R_{51}$ to $R_{65}$, k, d, e, and f will be described.

Preferably, $R_{51}$ is an aliphatic group or an aromatic group, $R_{52}$ and $R_{55}$ are preferably aromatic groups, and $R_{53}$ is an aromatic group or a heterocyclic group.

In the formula (Cp-3), $R_{54}$ is preferably $R_{41}CONH$— group or $R_{41}R_{43}N$— group, $R_{56}$ and $R_{57}$ are desirably an aliphatic groups, an aromatic groups, $R_{41}O$— groups, or $R_{41}S$— groups, and $R_{58}$ is preferably an aliphatic group or an aromatic group. In the formula (Cp-6), $R_{59}$ is desirably chlorine, an aliphatic group, or $R_{41}CONH$— group, d is preferably 1 or 2, and $R_{60}$ is preferably an aromatic group. In the formula (Cp-7), $R_{59}$ is desirably $R_{41}CONH$—group, d is preferably 1. In the formula (Cp-8), $R_{61}$ is preferably an aliphatic group or an aromatic group, and e is preferably 0 or 1, $R_{62}$ is desirably $R_{41}OCONH$— group, $R_{41}CONH$— group or $R_{41}SO_2NH$— group, the location of which is preferably 5-position of the naphthol ring. In the formula (Cp-9), $R_{63}$ is preferably $R_{41}CONH$— group, $R_{41}SO_2NH$— group, $R_{41}R_{43}NSO_2$— group, $R_{41}SO_2$— group, $R_{41}R_{43}NCO$— group, nitro, or cyano, and e is preferably 1 or 2. In the formula (Cp-10), $R_{63}$ is desirably $(R_{43})_2NCO$— group, $R_{43}OCO$— group or $R_{43}CO$— group, and e is preferably 1 or 2. In the formula (Cp-11), $R_{54}$ is preferably an aliphatic group, an aromatic group, or $R_{41}CONH$— group, and f is preferably 1. A comprises preferably a nondiffusing group or nondiffusing groups.

In the formula (I), preferable examples of $L_1$ are the groups specified below:

(1) Group Utilizing Cleavage Reaction of Hemiacetal

Example of this group are disclosed in, for example, U.S. Pat. No. 4,146,396, JP-A-60-249148, and JP-A-60-249149. This group is represented by the following formula (T-1), wherein mark * indicates the position where the group bonds to A or $L_1$ of the compound represented by the formula (I), and mark ** indicates the position where the group bonds to $L_1$ or $L_2$ of the compound.

$$*\text{—}(W\text{—}CR_{11}(R_{12}))_t\text{—}** \qquad \text{Formula (T-1)}$$

In this formula, W is oxygen, sulfur, or —$NR_{13}$— group, $R_{11}$ and $R_{12}$ are hydrogen or substituents, $R_{13}$ is a substituent, t is 1 or 2. If t is 2, the two —W—$CR_{11}(R_{12})$— groups are either same or different. If $R_{11}$ and $R_{12}$ are substituents, typical examples of these and $R_{13}$ are $R_{15}$ groups, $R_{15}CO$— group, $R_{15}SO_2$— group, $R_{15}(R_{16})NCO$— group, and $R_{15}(R_{16})NSO_2$— group, wherein $R_{15}$ is an aliphatic group, an aromatic group, or a heterocyclic group, and $R_{16}$ is hydrogen, an aliphatic group, an aromatic group, or a heterocyclic group. In some cases, $R_{11}$, $R_{12}$, and $R_{13}$ may be divalent groups, combining together, forming a ring. Specific examples of the group represented in the formula (T-1) are as follows:

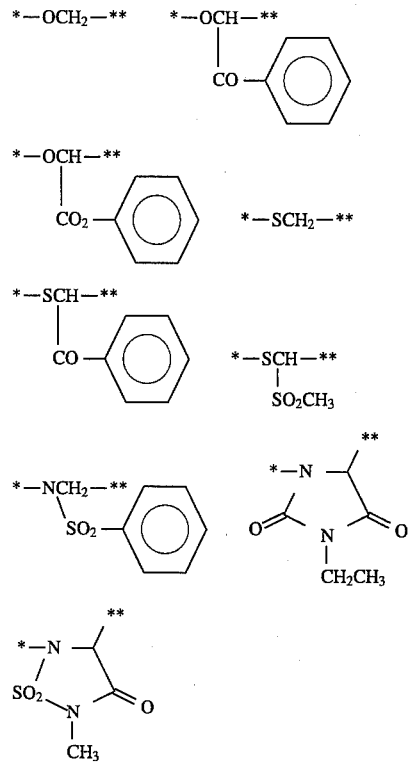

(2) Group Causing Cleavage Reaction by Using Intramolcular Nucleophilic Substitution Reaction An example of this group is the timing group disclosed in U.S. Pat. No. 4,248,292. This group is represented by the following formula (T-2):

$$*\text{-Nu-Link-E-}** \qquad \text{Formula (T-2)}$$

In the formula (T-2), Nu is a nucleophilic group, e.g., oxygen or sulfur, E is an electrophilic group which can cleave the bond at the position ** by a nucleophilic attack of Nu, and Link is a linking group which links Nu and E in such a steric relation that Nu and E undergo an intramolecular nucleophilic substitution reaction. Specific examples of the group represented by the formula (T-2) are as follows:

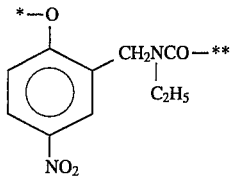

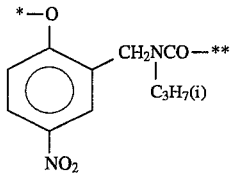

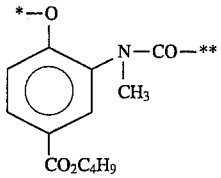

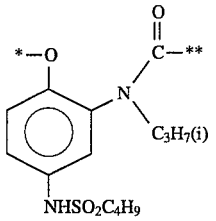

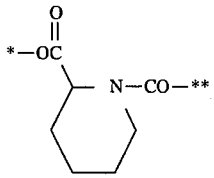

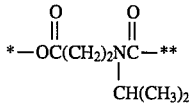

-continued

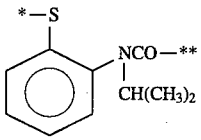

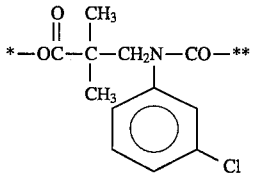

(3) Group Causing Cleavage Reaction by Using Electron Transfer Moving along Conjugated System Example of this group are disclosed in, for example, U.S. Pat. Nos. 4,409,323 and 4,421,845, JP-A-57-188035, JP-A-58-98728, JP-A-58-209736, and JP-A-58-209738. This group is represented by the following formula (T-3):

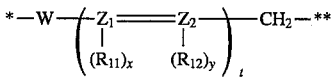

Formula (T-3)

In the formula (T-3), marks * and , W, $R_{11}$, $R_{12}$ and t are of the same meaning as explained in connection with the formula (T-1). However, $R_{11}$ and $R_{12}$ can bond together to form a benzene ring or a heterocyclic ring. $Z_1$ and $Z_2$ are independently carbon or nitrogen, and x and y are integers of 0 or 1. If $Z_1$ is carbon, x is 1. If $Z_1$ is nitrogen, x is 0. $Z_2$ has the same relationship with y as $Z_1$ with x. In the formula (T-3), t is 1 or 2; if t is 2, the two —$[Z_1(R_{11})_x{=}Z_2(R_{12})_y]$— groups can either be same or different. The —$CH_2$— group, which is adjacent to the mark , can be substituted by an alkyl group having 1 to 6 carbon atoms or by a phenyl group.

Specific examples of the group represented by the formula (T-3) are as follows:

C'-1

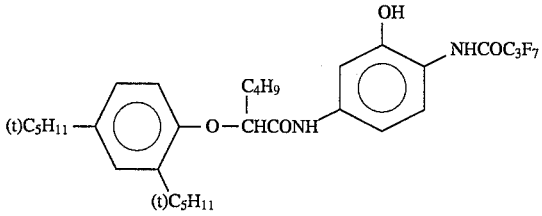

C'-2

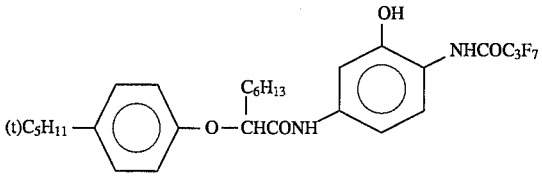

-continued
C'-3
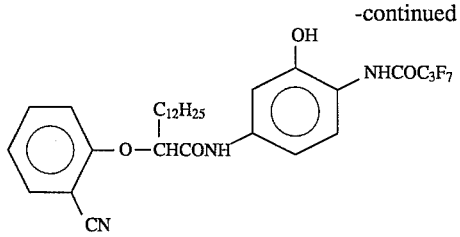
C'-4
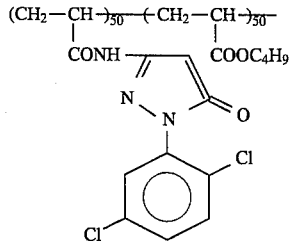
number indicating wt %
Av. molecular weight: about 25,000
C'-5
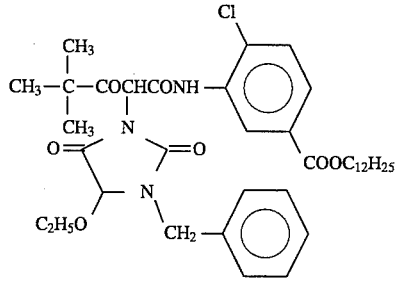
C'-6
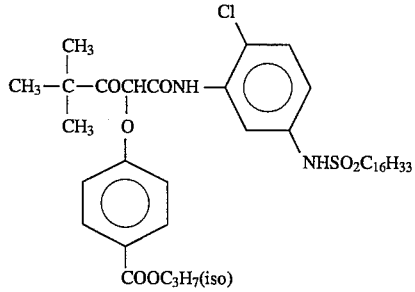
C'-7
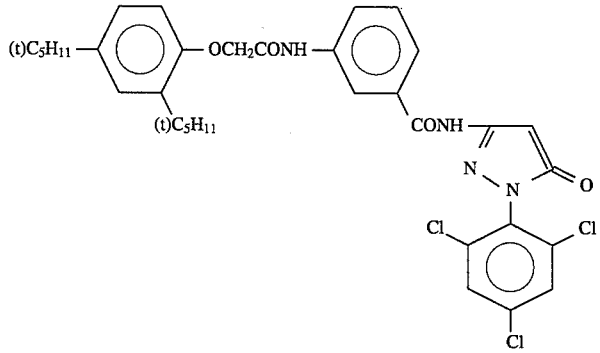

-continued
C'-8
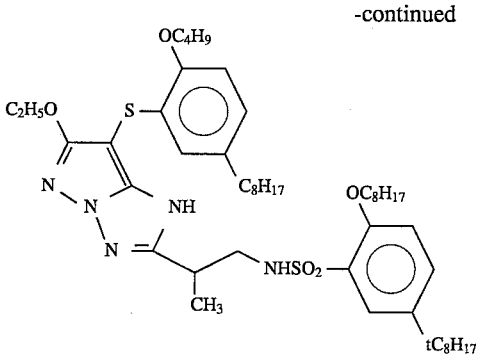
C'-9
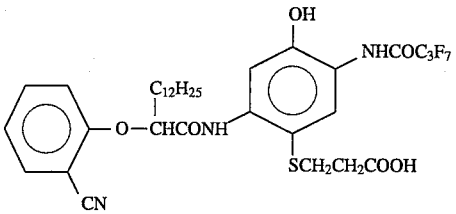
C'-10
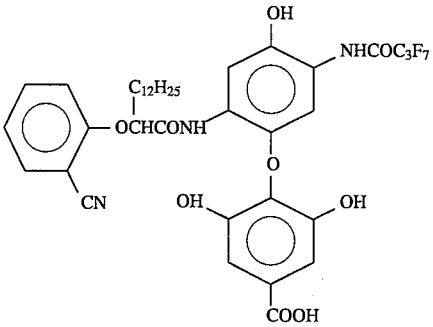
C'-11
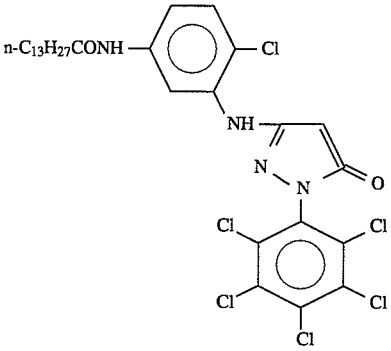

-continued
C'-12
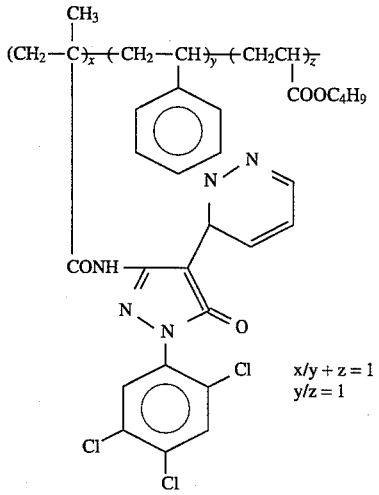
Dibutyl phthalate — Oil-1
Triycresylphosphate — Oil-2
Oil-3
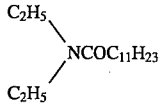
Cpd-A
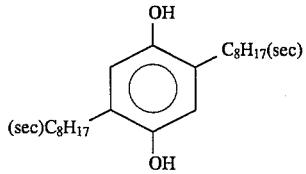
Cpd-B
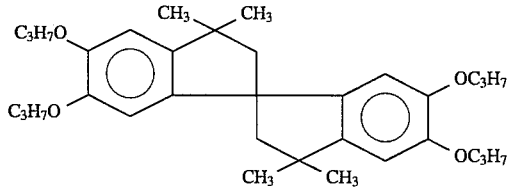
Cpd-C
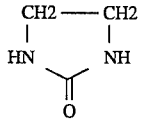
Cpd-D
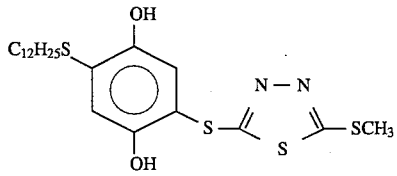
Cpd-E
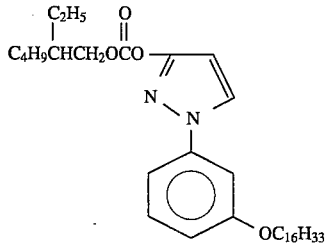

-continued
Cpd-F
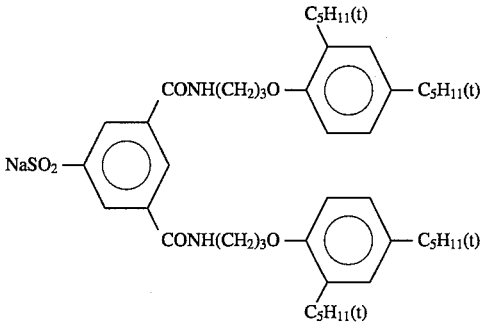
Cpd-G
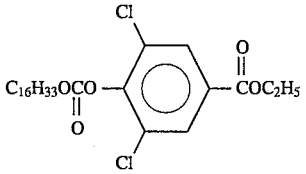
Cpd-H
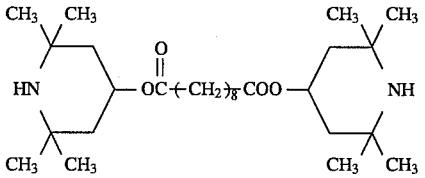
Cpd-I
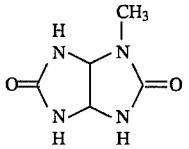
Cpd-J
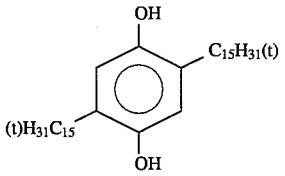
Cpd-K
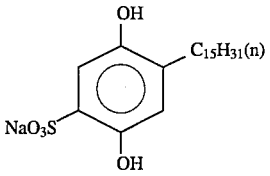
Cpd-L
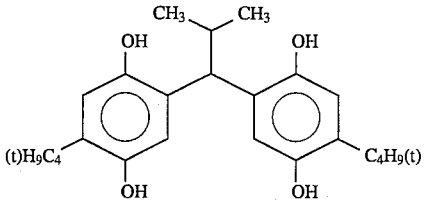
Cpd-M
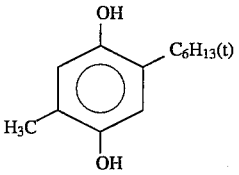

-continued
Cpd-N
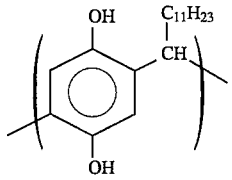
U'-1
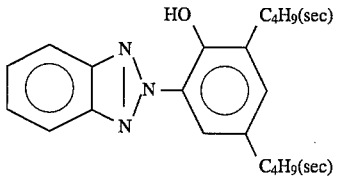
U'-2
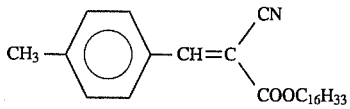
U'-3
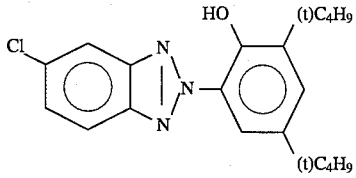
U'-4
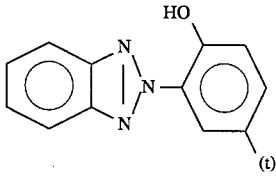
U'-5
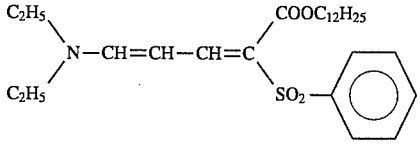
U'-6
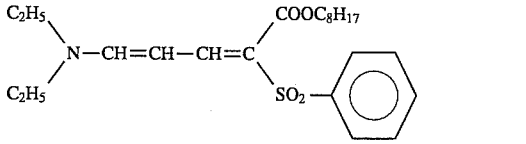
S'-1
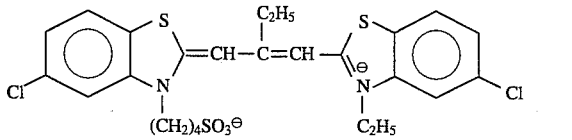
S'-2
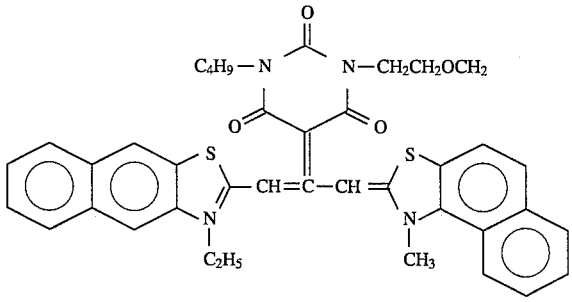

-continued
S'-3
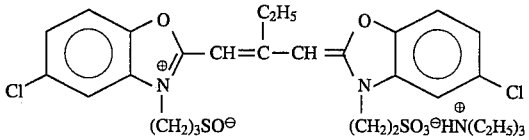
S'-4
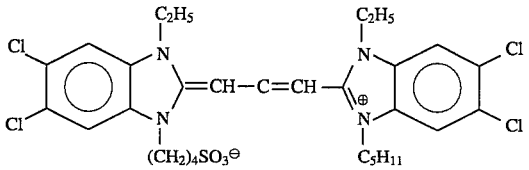
S'-5
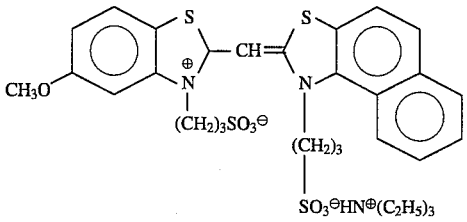
S'-6
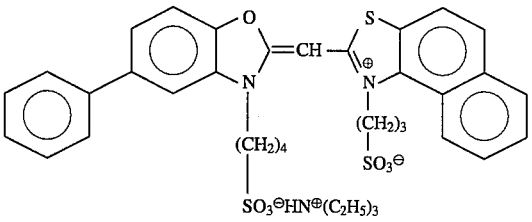
S'-7
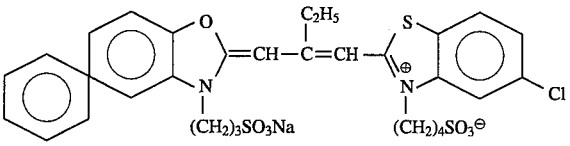
S'-8
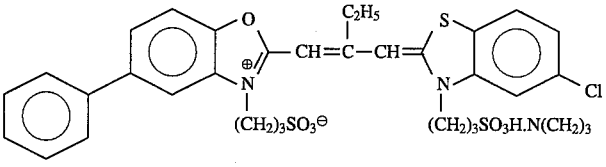
S'-9
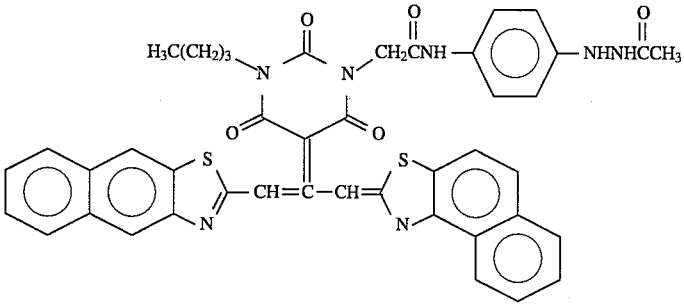
S'-10
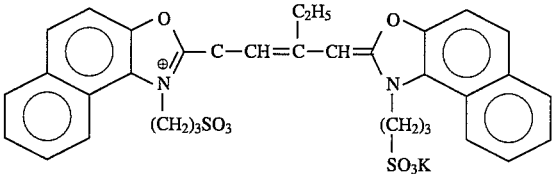

-continued
S'-11
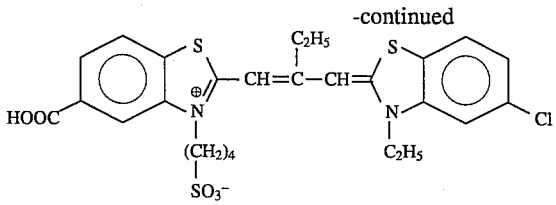
D-1
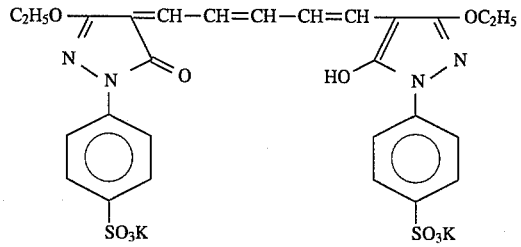
D-2
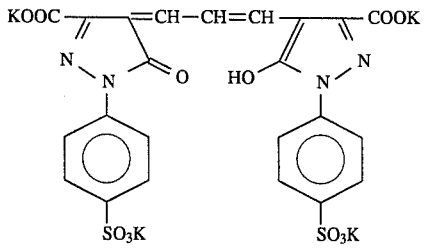
D-3
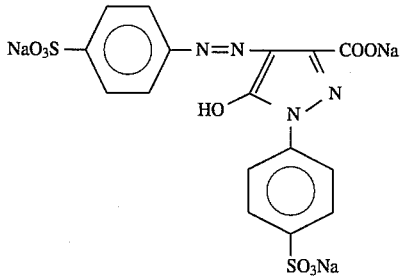
D-4
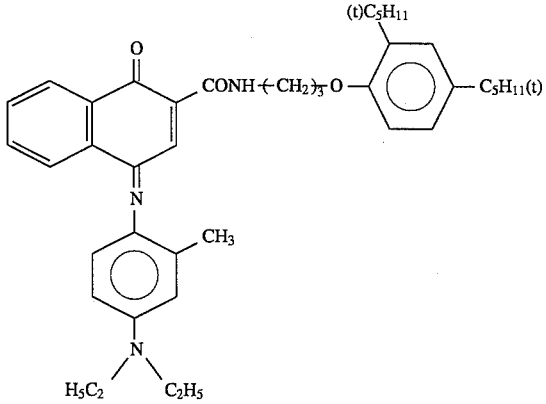
D-5
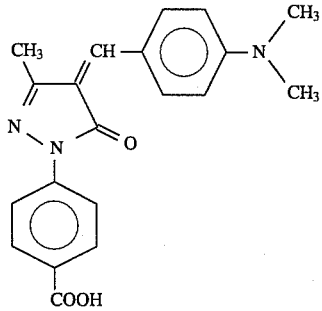

-continued
D-6
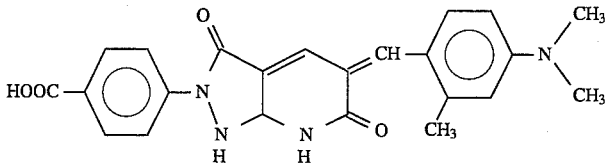
D-7
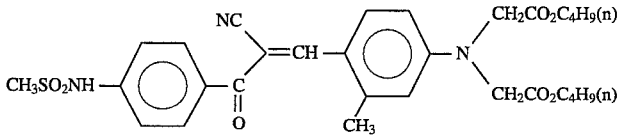
D-8
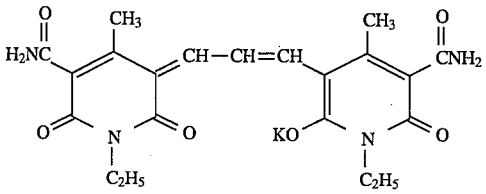
D-9
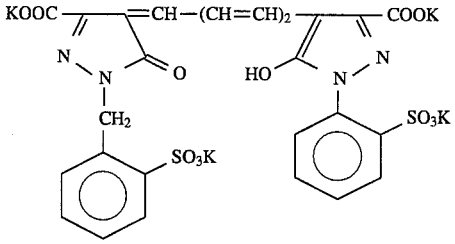
H-1
$CH_2{=}CHSO_2CH_2CONHCH_2$
$\quad\quad\quad -continued
M-1
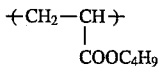
M-2
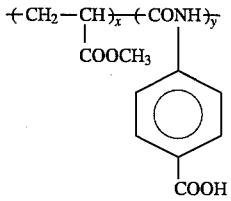
x/y = 1/1
F'-1
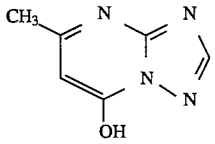
F'-2
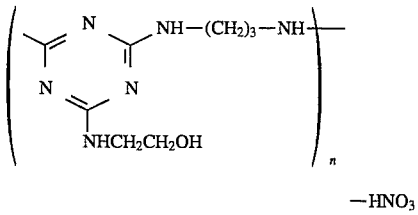
F'-3
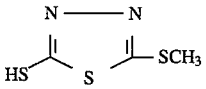
F'-4
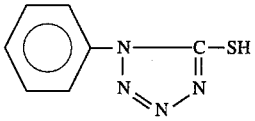
F'-5
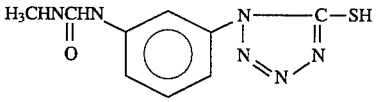
F'-6
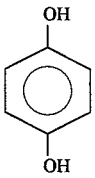
F'-7
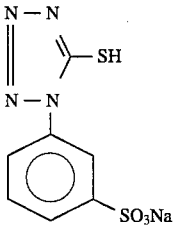
F'-8
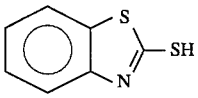

-continued

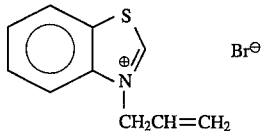

F'-9

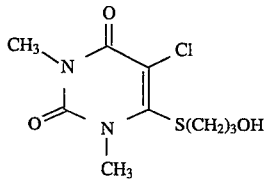

F'-10

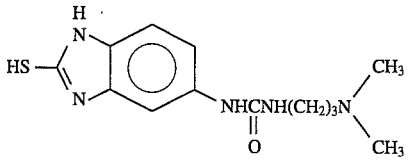

F'-11

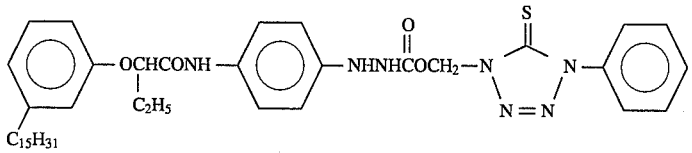

F'-12

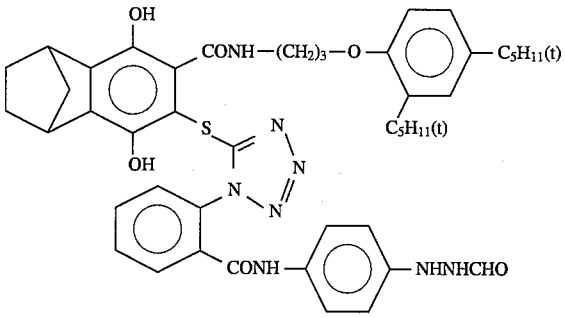

F'-13

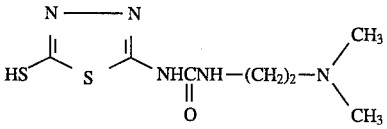

F'-14

(4) Group Utilizing Cleavage Reaction by Hydrolysis of Ester

An example of this group is the linking group disclosed in, for example, West German Laid-Open Patent Application 2,626,315. This group is represented by the following formulas (T-4) and (T-5), in which the marks and ** are of the same meaning as explained in connection with the formula (T-1):

*—OCO—** Formula (T-4)

*—SCS—** Formula (T-5)

(5) Group Utilizing Cleavage Reaction of Iminoketal

An example of this group is the linking group disclosed in U.S. Pat. No. 4,546,073. This group is represented by the following formula (T-6):

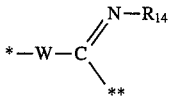

Formula (T-6)

In the formula (T-6), marks * and **, and W are of the same meaning as explained in connection with the formula (T-1). $R_{14}$ is equal to $R_{13}$. Specific examples of the group represented by the formula (T-6) are as follows:

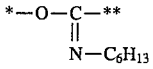

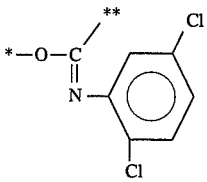

-continued

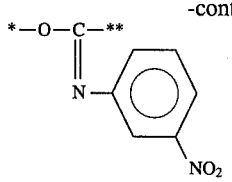

Preferable examples of $L_1$ are the groups of the formulas (T-1) to (T-5). Particularly preferable are the groups of the formulas (T-1), (T-3) and (T-4). Preferably, j is 0 or 1.

In the formula (I), the group $L_2$ is a timing group of 3- or more valent. Preferable examples of $L_2$ are the groups represented by the following formulas (T-$L_1$) or (T-$L_2$):

$$*—W—[Z_1—(R_{11})_x=Z_2(R_{12})_y]_t—CH_2—** \qquad \text{Formula (T-L}_1\text{)}$$

In the formula (T-$L_1$), W, $Z_1$, $Z_2$, $R_{11}$, $R_{12}$, x, and y are of the same meaning as explained in connection with the formula (T-3) and t can be 1, 2 or 3. Marks * and ** indicate the positions where the group bonds to A-$(L_1)_j$- and -$(L_3)_n$-PUG shown in the formula (I), respectively. When $R_{11}$ or $R_{12}$ is plural, at least one of $R_{11}$ and $R_{12}$ is a substituted or unsubstituted methylene group which bonds to -$(L_3)_n$-PUG.

A preferable example of (T-$L_1$) is one wherein W is nitrogen. An example more preferable is one wherein W and $Z_2$ bonds, forming a 5-membered ring. Particularly preferable is one in which W and $Z_2$ form an imidazole ring or a pyrazole ring.

$$*—N—(Z_3—**)_2 \qquad \text{Formula (T-L}_2\text{)}$$

In the formula (T-$L_2$), marks * and ** are of the same meaning as in the formula (T-$L_1$), $Z_3$ is a substituted or unsubstituted methylene group, and two $Z_3$ groups can be either same or different, and can bond with each other to form a ring.

Specific examples of the timing groups represented by the formulas (T-$L_1$) and (T-$L_2$) are as follows. Nonetheless, the timing groups used in the invention are not limited to these examples.

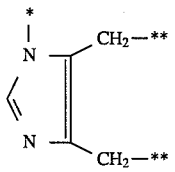

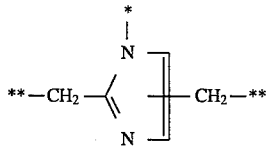

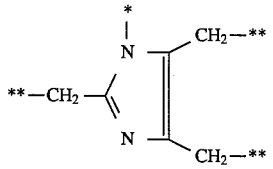

-continued

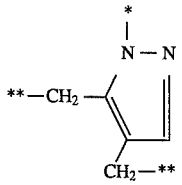

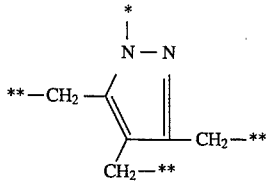

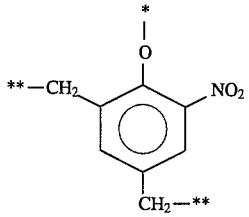

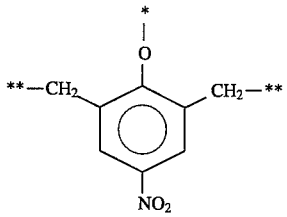

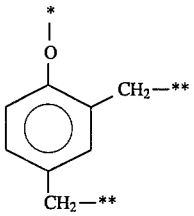

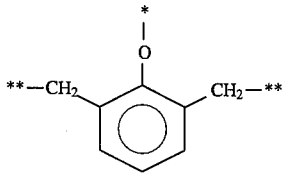

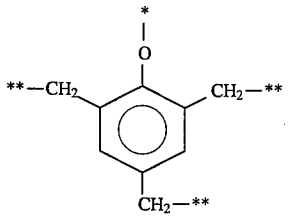

-continued

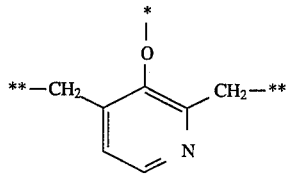

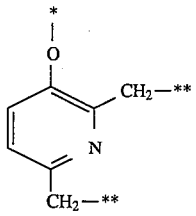

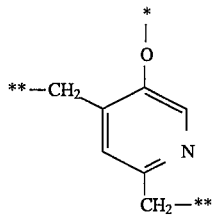

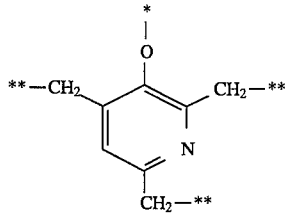

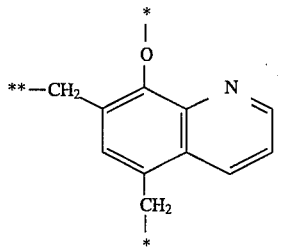

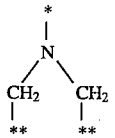

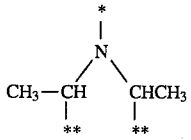

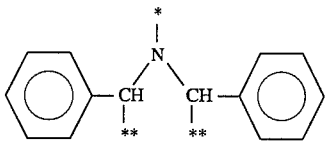

-continued

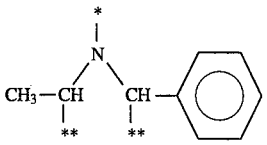

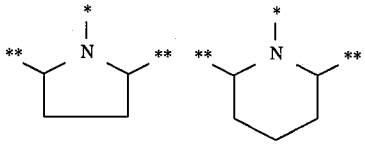

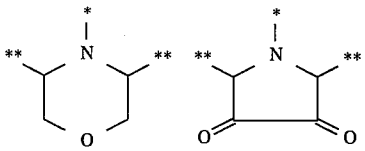

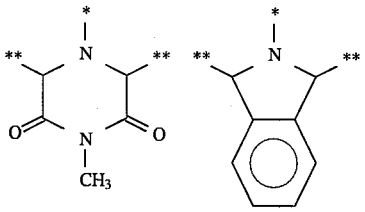

The specific examples of the timing groups, described above, can have a substituent or substituents. Examples of this substituent are: an alkyl group (e.g., methyl, ethyl, isopropyl, t-butyl, hexyl, methoxymethyl, methoxyethyl, chloroethyl, cyanoethyl, nitroethyl, hydroxypropyl, carboxyethyl, dimethylaminoethyl, benzyl, or phenetyl); an aryl group (e.g., phenyl, naphthyl, 4-hydroxyphenyl, 4-cyanophenyl, 4-nitrophenyl, 2-methoxyphenyl, 2,6-dimethylphenyl, 4-carboxyphenyl, or 4-sulfophenyl); a heterocyclic group (e.g., 2-pyridyl, 4-pyridyl, 2-furyl, 2-thienyl or 2-pyrrolyl; a halogen atom (e.g., chloro or bromo); nitro; an alkoxy group (e.g., ethoxy, methoxy, or isopropoxy); an aryloxy group (e.g., phenoxy); an alkylthio group (e.g., methylthio, isopropylthio, or t-butylthio); an arylthio group (e.g., phenylthio); an amino group (e.g., amino, dimethylamino, or diisopropyl amino); an acylamino group (e.g., acetylamino or benzoyl amino); a sulfonamido group (e.g., methanesulfonamido or benzenesulfonamido); cyano; a carboxyl group; an alkoxycarbonyl group (e.g., methoxycarbonyl or ethoxycarbonyl); an aryloxycarbonyl group (e.g., phenoxycarbonyl); and a carbamoyl group (e.g., N-ethylcarbamoyl or N-phenylcarbamoyl).

Of these substituents, preferable are an alkyl group, nitro, an alkoxy group, an alkylthio group, an amino group, an acylamino group, a sulfonamido group, an alkoxycarbonyl group, and a carbamoyl group.

In the formula (T-$L_1$), the —$CH_2$— group, which is adjacent to the mark **, can be substituted by an alkyl group having 1 to 6 carbon atoms or a phenyl group.

In the formula (I), m is preferable 1.

In the formula (I), the group represented by $L_3$ is equal to $L_1$, and n is 0 or 1, preferably 0.

The photographically useful group, represented by PUG in the formula (I), is for example an development inhibitor, a dye, a fogging agent, a developing agent, a coupler, a bleaching accelerator, or a fixing accelerator. Examples of the photographically useful group are the group disclosed in U.S. Pat. No. 4,248,962 (i.e., the group represented by general formula PUG in the patent specification), the dye disclosed in JP-A-62-49353 (i.e., the coupling split-off group released from a coupler in the patent specification), the development inhibitor described in U.S. Pat. No. 4,477,563, and the breaching accelerators disclosed in JP-A-61-201247 and JP-A-2-55 (i.e., the coupling split-off groups released from couplers in the patent specifications). In the present invention, particularly preferable as photographically useful group is a development inhibitor.

Preferable examples of the development inhibitor are the groups represented by the following formulas (INH-1) to (INH-13):

(INH-1)

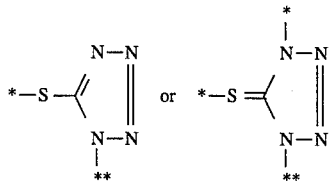

(INH-2)

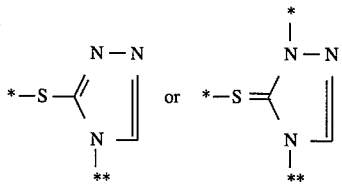

(INH-3)

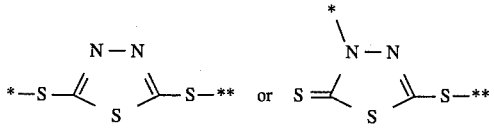

(INH-4)

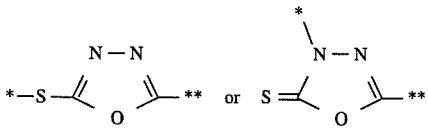

(INH-5)

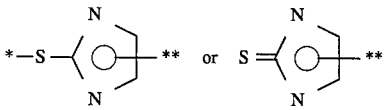

(INH-6)

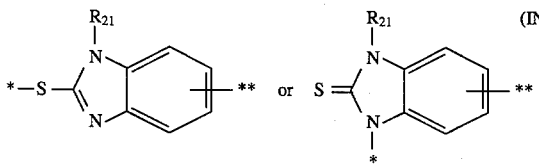

In the formula (INH-6), $R_{21}$ is hydrogen or a substituted or unsubstituted hydrocarbon group (e.g., methyl, ethyl, propyl, or phenyl). (INH-7)

(INH-7)

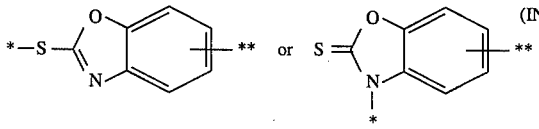

-continued (INH-8)

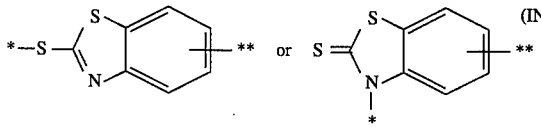

(INH-9)

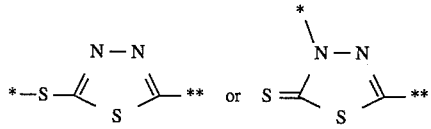

(INH-10)

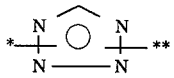

(INH-11)

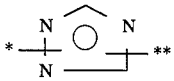

(INH-12)

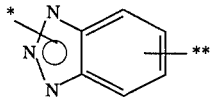

(INH-13)

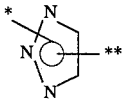

In the formulas (INH-1) to (INH-13), the mark * indicates the position where the development inhibitor bonds to $L_2$ or $L_3$ of the compound represented by the formula (I), and the mark ** indicates the position where the development inhibitor bonds to a substituent. Examples of the substituent can be a substituted or unsubstituted aliphatic group, an aryl group, or a heterocyclic group. These substituents preferably comprises the group which can be decomposed in a process solution during photographic processing.

More specifically, examples of the aliphatic group are: methyl, ethyl, propyl, butyl, hexyl, decyl, isobutyl, t-butyl, 2-ethylhexyl, 2-methylthioethyl, benzyl, 4-methoxybenzyl, phenetyl, 1-methoxycarbonylethyl, propyloxycarbonylmethyl, methoxycarbonyl, phenoxycarbonyl, 2-(propyloxycarbonyl) ethyl, butyloxycarbonylmethyl, pentyloxycarbonylmethyl, 2-cyanoethyloxycarbonylmethyl, 2,2-dichloroethyloxycarbonylmethyl, 3-nitropropyloxycarbonylmethyl, 4-nitrobenzyloxycarbonylmethyl, 2,5-dioxo-3,6-dioxadecyl, and a group represented by $—CO_2CH_2CO_2R_{100}$, where $R_{100}$ is an unsubstituted alkyl group having 1 to 8 carbon atoms.

Specific examples of the aryl group are: phenyl, naphthyl, 4-methoxycarbonylphenyl, 4-ethoxycarbonylphenyl, 2-methylthiophenyl, 3-methoxycarbonylphenyl, and 4-cyanoethyloxycarbonyl)-phenyl.

Specific examples of the heterocyclic group are: 4-pyridyl, 3-pyridyl, 2-pyridyl, 2-furyl, and 2-tetrahydropyranyl.

Of the development inhibitors INH exemplified above, preferable are (INH-1), (INH-2), (INH-3), (INH-4), (INH-9) and (INH-12). Of these six inhibitors, (INH-1), (INH-2), (INH-3) are desirable in particular.

Preferable as a substituent which bonds to INH is an aliphatic group or a substituted or unsubstituted phenyl group.

Particularly preferred as the compound represented by the formula (I) are the compounds which are represented by the following formulas (Ia) and (Ib):

$$A\text{-}(L_1)j\text{-}W\text{-}[Z_1—(R_{11})_x{=}Z_2(R_{12})_y]_t—CH_2\text{-}PUG \qquad \text{Formula (Ia)}$$

$$A\text{-}(L_1)—N—(Z_3\text{-}PUG)_2 \qquad \text{Formula (Ib)}$$

All notations used in the formulas (Ia) and (Ib) are of the same meaning as has been explained in connection with the formulas (I), (T-$L_1$), and (T-$L_2$). In the formula (Ia), j is preferably 0 or 1. In the formulas (Ia) and (Ib), preferable as $L_2$ is —OC(=O)— group, and preferable as PUG is a development inhibitor.

If the plural photographically useful groups have different functions, the timing group is not one which utilizes intramolecular nucleophilic substitution. The term "function of a photographically useful group" means the function effected by a development inhibitor, a dye, a fogging agent, a developing agent, a coupler, a bleach accelerator, or a fixing agent. It is particularly desirable that two or more PUGs released from the same compound be the same development inhibitors.

The compound represented by the formula (II) will now be described. In the formula (II), A and PUG are of the same meaning as defined in conjunction with the formula (I). $L_4$ is —OCO— group, —OSO— group, —$OSO_2$— group, —OCS— group, —SCO— group, —SCS— group, or —$WCR_{11}R_{12}$— group. W, $R_{11}$, and $R_{12}$ are of the same meaning as defined in connection with the formula (T-1) which is described as an example of $L_1$ in the formula (I).

If $L_4$ is —$WCR_{11}R_{12}$— group, it is desirable that W be oxygen or a tertiary amino group. More preferably, $L_4$ is —$OCH_2$— group, or $L_4$ is the group where W and $R_{11}$ or $R_{12}$ form a ring.

If $L_4$ is a group other than —$WCR_{11}R_{12}$—, it is preferably —OCO— group, —OSO— group, or —$OSO_2$— group, of which the most preferred is —OCO— group.

The group represented by $L_5$ is either a group which releases PUG by electron transfer along a conjugated system, or a group which is defined as $L_4$. The group releasing PUG by electron transfer along the conjugated system is equal to the group represented by the formula (T-3), which has been explained in conjunction with $L_1$ in the formula (I). Preferable as $L_5$ is a group which releases PUG by electron transfer along a conjugated system. More preferable as $L_5$ is a group which can bond to $L_4$ through nitrogen.

Of the compounds represented by the formula (II) are those which are represented by the following formulas (III) and (IV):

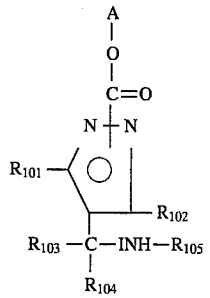

Formula (III)

In the formula (III), A is equal to A in the formula (I). $R_{101}$ and $R_{102}$ are independently hydrogen or a substituent. $R_{103}$ and $R_{104}$ are independently hydrogen or a substituent. INH is a group which can inhibit development. $R_{105}$ is an unsubstituted phenyl or primary alkyl group, or a primary alkyl group substituted by a group other than an aryl group. At least one of groups $R_{101}$ to $R_{104}$ is a substituent other than hydrogen.

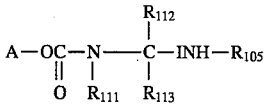

Formula (IV)

The compounds of the formula (IV) will be described in detail. In the formula (IV), A, INH, and $R_{105}$ are equal to those defined in the formula (III), and $R_{111}$, $R_{112}$, and $R_{113}$ are independently hydrogen or an organic residue. Any two of $R_{111}$, $R_{112}$, and $R_{113}$ can be divalent groups bonding together, forming a ring.

The compound of the formula (III) will be described in more detail.

In the formula (III), A is equal to A in the formula (I), and $R_{101}$ and $R_{102}$ are independently hydrogen or a substituent. Specific examples of the substituent are: an aryl group (e.g., phenyl, naphthyl, p-methoxyphenyl, p-hydroxyphenyl, p-nitrophenyl, or o-chlorophenyl); an alkyl group (e.g., methyl, ethyl, isopropyl, propyl, tert-butyl, tert-amyl, isobutyl, sec-butyl, octyl, methoxymethyl, 1-methoxyethyl, or 2-chloroethyl); a halogen atom (e.g., fluoro, chloro, bromo, or iodo); an alkoxy group (e.g., methoxy, ethoxy, isopropyloxy, propyloxy, tert-butyloxy, isobutyloxy, butyloxy, octyloxy, 2-methoxyethoxy, 2-chloroethoxy, nitromethyl, 2-cyanoethyl, 2-carbamoylethyl, or 2-dimethylcarbamoylethyl); an aryloxy group (e.g., phenoxy, naphthoxy, or p-methoxyphenoxy); an alkylthio group (e.g., methylthio, ethylthio, isopropylthio, propylthio, tert-butylthio, isobutylthio, sec-butylthio, octylthio, or 2-methoxyethylthio); an arylthio group (e.g., phenylthio, naphthylthio, or p-methoxyphenylthio); an amino group (e.g., amino, methylamino, phenylamino, dimethylamino, diethylamino, diisopropylamino, or phenylmethylamino); a carbamoyl group (e.g., carbamoyl, methylcarbamoyl, dimethylcarbamoyl, diethylcarbamoyl, diisopropylcarbamoyl, ethylcarbamoyl, isopropylcarbamoyl, tert-butylcarbamoyl, phenylcarbamoyl, or phenylmethylcarbamoyl); a sulfamoyl group (e.g., sulfamoyl, methylsulfamoyl, ethylsulfamoyl, isopropylsulfamoyl, phenylsulfamoyl, octylsulfamoyl, dimethylsulfamoyl, diethylsulfamoyl, diisopropylsulfamoyl, dihexylsulfamoyl, or phenylmethylsulfamoyl); an alkoxycarbonyl group (e.g., methoxycarbonyl, propyloxycarbonyl, isopropyloxycarbonyl, tert-butyloxycarbonyl, tert-amyloxycarbonyl, or octyloxycarbonyl); an aryloxycarbonyl group (e.g., phenoxycarbonyl or p-methoxyphenoxycarbonyl); an acylamino group (e.g., acetylamino, propanoylamino, pentanoylamino, N-methylacetylamino, or benzoylamino); a sulfonamido group (e.g., methanesulfonamido, ethanesulfonamido, pentanesulfonamido, benzenesulfonamido, or p-toluenesulfonamido); an alkoxycarbonylamino group (e.g., methoxycarbonylamino, isopropyloxycarbonylamino, tert-butoxycarbonylamino, or hexyloxycarbonylamino); an aryloxycarbonylamino group (e.g., phenoxycarbonylamino); an ureido group (e.g., 3-methyluriodo or 3-phenylureido); cyano, and nitro.

$R_{101}$ and $R_{102}$ can either be the same or different, but it is desirable that the sum of their formula weights be less than 120. Preferable as substituents are an alkyl group, a halogen atom, and an alkoxy group. An alkyl group is preferred in particular.

In the formula (III), the groups represented by $R_{103}$ and $R_{104}$ are independently hydrogen or an alkyl group. Examples of the alkyl group are methyl, ethyl, isopropyl, tert-butyl, isobutyl, hexyl, and 2-methoxyethyl. Preferable as $R_{103}$ and $R_{104}$ are hydrogen, methyl, and ethyl. Hydrogen is particularly preferred.

In the formula (III), the group represented by $R_{105}$ is an unsubstituted phenyl or primary alkyl group, or a primary alkyl group substituted by a group other than an aryl group. Examples of the alkyl group are: ethyl, propyl, butyl, isobutyl, pentyl, isopentyl, 2-methylbutyl, hexyl, 2-methylpentyl, 3-methylpentyl, 4-methylpentyl, 2-ethylbutyl, heptyl, and octyl. Examples of the group other than an aryl group are: a halogen atom, an alkoxy group, an alkylthio group, an amino group, a carbamoyl group, a sulfamoyl group, an alkoxycarbonyl group, an acylamino group, a sulfonamido group, an alkoxycarbonylamino group, an ureido group, cyano, nitro, and a group represented by $—CO_2CH_2CO_2R_{106}$. Specific examples of each of these groups are all groups exemplified as $R_{101}$ and $R_{102}$, except for those having aryl groups. $R_{106}$ is an unsubstituted alkyl group having 3 to 6 carbon atoms (e.g., propyl, butyl, isobutyl, pentyl, isopentyl, or hexyl).

$R_{105}$ can be substituted by two or more types of substituents. Preferable as substituents for $R_{105}$ are: fluoro, chloro, an alkoxy group, a carbamoyl group, an alkoxycarbonyl group, cyano, nitro, and $—CO_2CH_2CO_2R_{106}$. Of these, particularly preferable are an alkoxycarbonyl group and $—CO_2CH_2CO_2R_{106}$.

Preferable as $R_{105}$ are: a phenyl group, an unsubstituted primary alkyl group having 2 to 6 carbon atoms, and a primary alkyl group substituted by the group exemplified above as preferable as a substituent for $R_{105}$. Particularly preferable is an unsubstituted primary alkyl group having 3 to 5 carbon atoms or a primary alkyl group substituted by an alkoxycarbonyl group.

In the formula (III), the group represented by INH is a group which can effect development inhibition. Specific examples of this group are the inhibitors (INH-1) to (INH-13) which have been specified in connection with the PUG shown in the formula (I). Other comments on the INH, including preferable scope thereof, is same as that described in connection with formula (I).

The compound represented by the formula (IV) will now be described in greater detail.

First, the case where $R_{111}$, $R_{112}$, and $R_{113}$ are independently hydrogen or a monovalent organic group will be described.

If $R_{112}$ and $R_{113}$ are monovalent organic groups, they are preferably alkyl groups (e.g., methyl or ethyl), or aryl groups (e.g., phenyl). Preferable is the case where either $R_{112}$ or $R_{113}$, or both are hydrogen. Particularly preferable is the case where both $R_{112}$ and $R_{113}$ are hydrogen.

$R_{111}$ is an organic group. Preferable examples of this organic group are: an alkyl group (e.g., methyl, isopropyl, butyl, isobutyl, tert-butyl, sec-butyl, neopentyl, or hexyl); an aryl group (e.g., phenyl), an acyl group (e.g., acetyl or benzoyl); a sulfonyl group (e.g., methanesulfonyl or benzensulfonyl); a carbamoyl group (e.g., ethylcarbamoyl or phenylcarbamoyl); a sulfamoyl group (e.g., ethylsulfamoyl or phenylsulfamoyl); an alkoxycarbonyl group (e.g., ethoxycarbonyl or butoxycarboyl); an aryloxycarbonyl group (e.g., phenoxycarbonyl or 4-methylphenoxycarbonyl); an alkoxysulfonyl group (e.g., butoxysulfonyl or ethoxysulfonyl); an aryl oxysulfonyl group (e.g., phenoxysulfonyl or 4-methoxyphenoxysulfonyl); cyano; nitro, nitroso; a thioacyl group (e.g., thioacetyl or thiobenzoyl); thiocarbamoyl group (e.g., ethylthiocarbamoyl); an imidoyl group (e.g., N-ethylimidoyl); an amino group (e.g., amino, dimethylamino, or methylamino); an acylamino group (e.g., formylamino, acetylamino, or N-methylacetylamino); an alkoxy group (e.g., methoxy or isopropyloxy); and an aryloxy group (e.g., phenoxy).

These groups can have a substituent. Examples of the substituent are those exemplified as $R_{111}$, a halogen atom (e.g., fluoro, chloro or bromo), a carboxyl group, and a sulfo group.

Preferably, $R_{111}$ has 15 or less atoms other than hydrogen atoms. More preferable as $R_{111}$ is a substituted or unsubstituted alkyl or aryl group. Particularly preferred is a substituted or unsubstituted alkyl group.

The case, where two of the groups represented by $R_{111}$, $R_{112}$, and $R_{113}$ are divalent groups bonding together, forming a ring, will now be explained.

The ring, thus formed, is preferably a 4- to 8-membered ring, more preferably a 4- to 6-membered ring.

Desirable as the divalent groups are: $—C(=O)—N(R_{114})—$, $—SO_2—N(R_{114})—$, $—(CH_2)_3—$, $—(CH_2)_4—$, $—(CH_2)_5—$, $—C(=O)—(CH_2)_2—$, $—C(=O)—N(R_{114})—C(=O)—$, $—SO_2—N(R_{114})—C(=O)—$, $—C(=O)—C(R_{114})(R_{115})—$, and $—(CH_2)_2—O—CH_2—$.

In these notations, $R_{114}$ and $R_{115}$ are independently hydrogen, or equal to $R_{111}$ which is a monovalent organic group. $R_{114}$ and $R_{115}$ can either be the same or different.

Of $R_{111}$, $R_{112}$, and $R_{113}$, any one which is other than the divalent group forming a ring mentioned above is hydrogen or a monovalent organic group. Specific examples of the organic group are equal to those exemplified as $R_{111}$, $R_{112}$, and $R_{113}$ for the case where $R_{111}$, $R_{112}$, and $R_{113}$ form no rings.

If two of $R_{111}$, $R_{112}$, and $R_{113}$ bond together, forming a ring, it is desirable that one of $R_{112}$ and $R_{113}$ be hydrogen, and the other bonds to $R_{111}$, thus forming a ring, and it is more preferable that the divalent group have their left ends bonded to the nitrogen atom of the compound represented by the formula (I), and their right ends bonded to the carbon atom.

Also, preferable as $R_{111}$, $R_{112}$, and $R_{113}$ are groups which form no rings and which are independently hydrogen or a monovalent organic group.

In the formulas (I) and (II), each of the formula weight of the residues which are obtained by removing two groups represented by A and PUG from the formula (I) or (II) respectively, is preferably 64 to 240, more preferably 70 to 200, and still more preferably 90 to 180.

Specific examples of the compounds represented by the formulas (I) to (IV) will be presented below. Nonetheless, compounds for use in the present invention are not limited to these examples.

Of the compounds exemplified below, those of the formula (I), in which A is a coupler residue, are labeled with "CA," those of the formulas (II) to (IV), in which A is a coupler residue, are labeled with "CB," and those of the formulas (I) to (IV), in which A is a redox group, are labeled with "SA."

(CA-1)
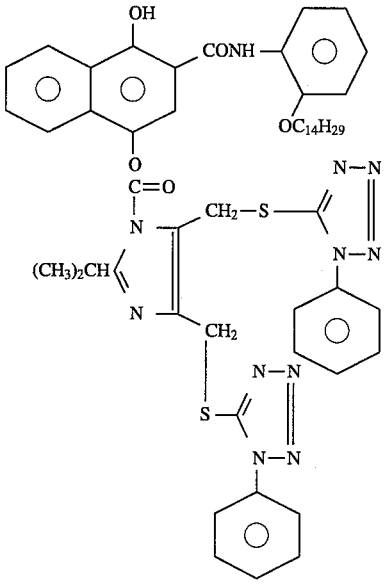
(CA-2)
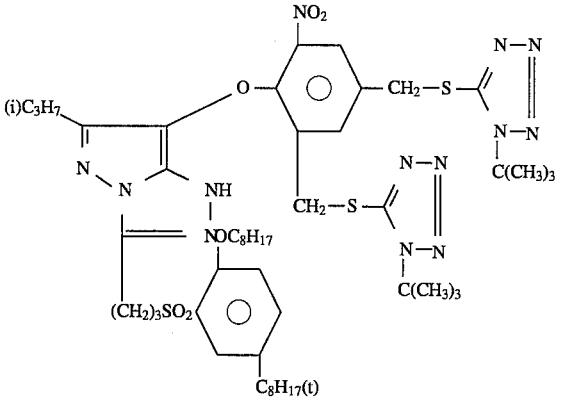
(CA-3)
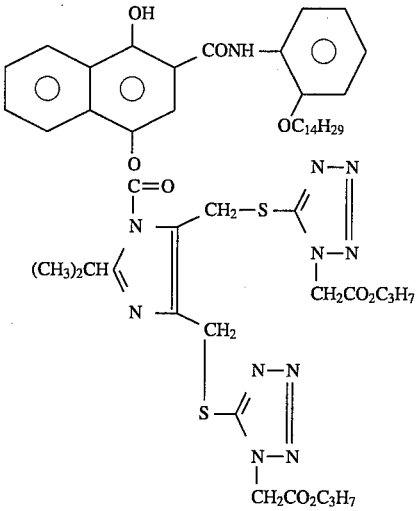

-continued
(CA-4)
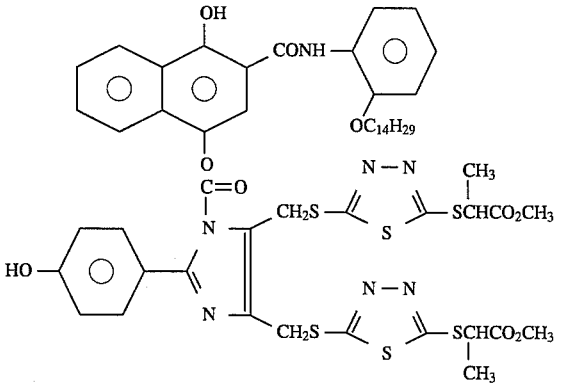
(CA-5)
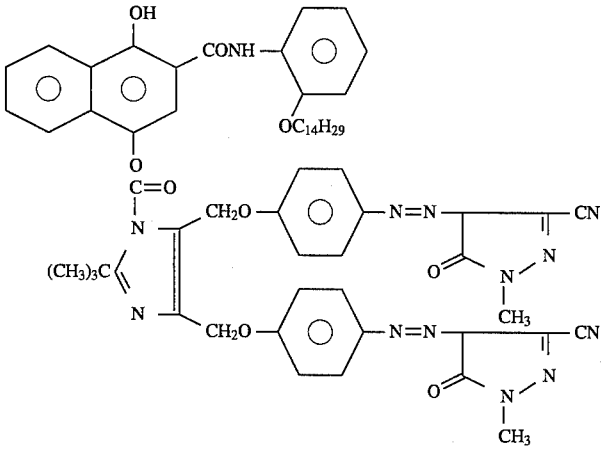
(CA-6)
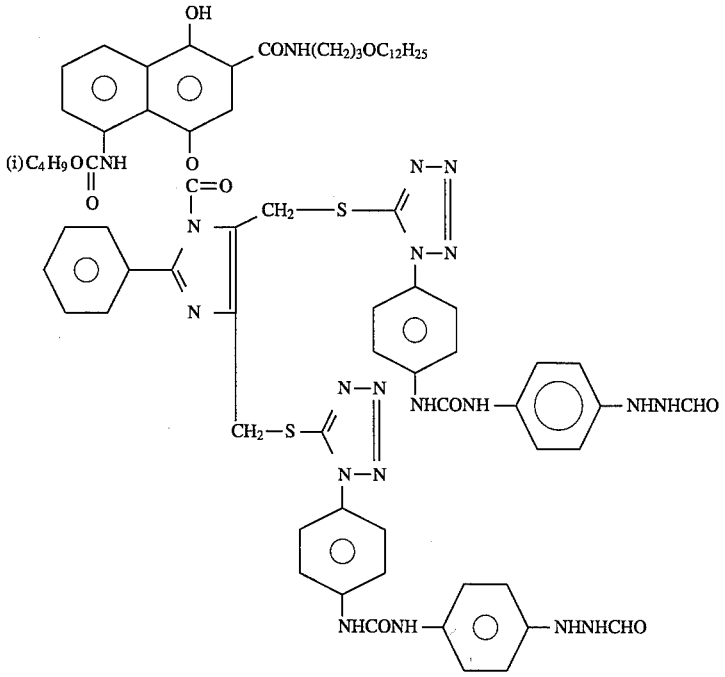

-continued
(CA-7)
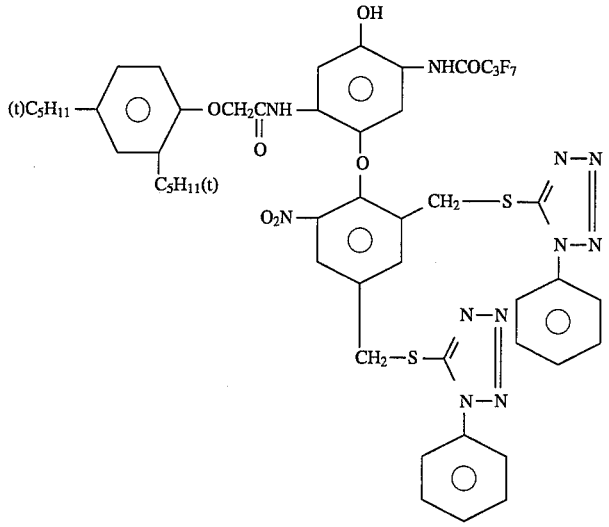
(CA-8)
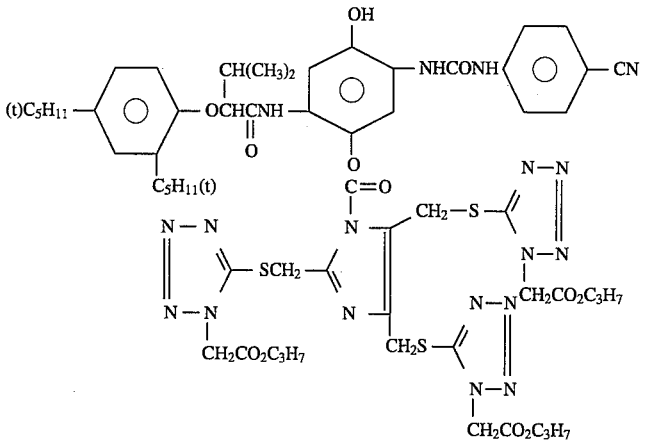
(CA-9)
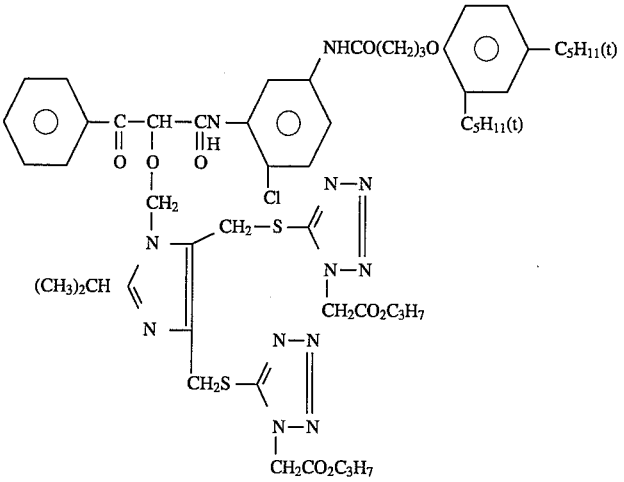

-continued
(CA-10)
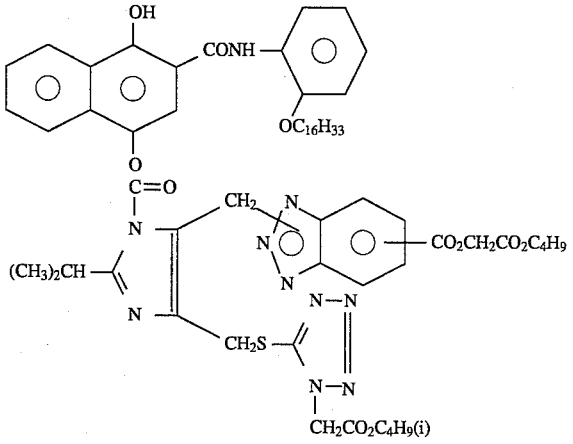
(CA-11)
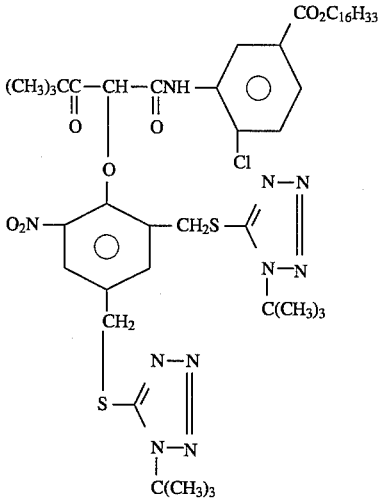
(CA-12)
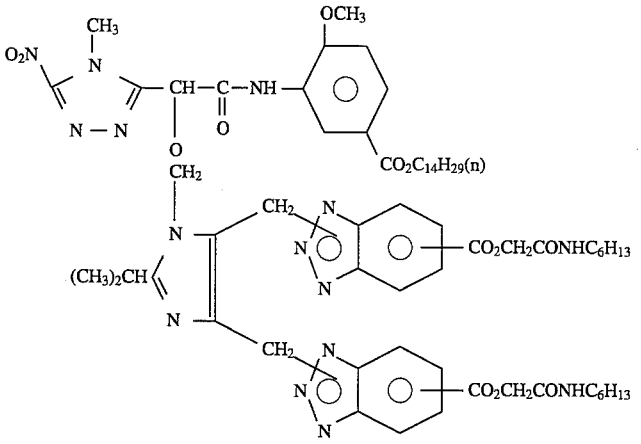

-continued
(CA-13)
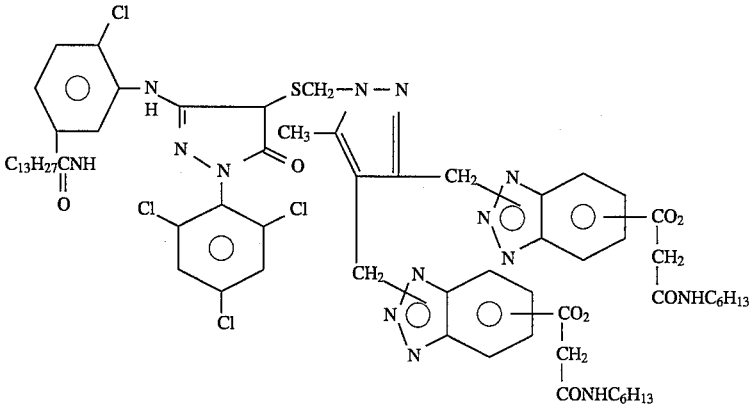
(CA-14)
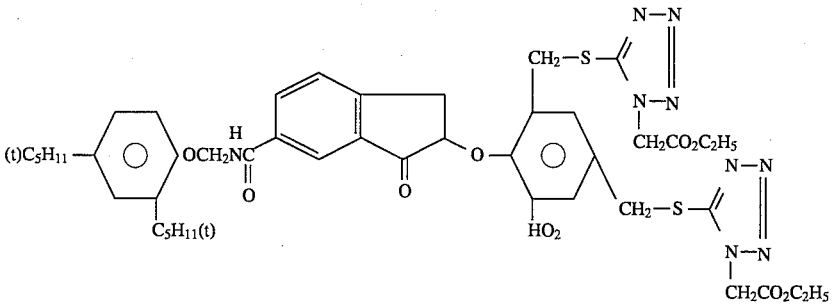
(CA-15)
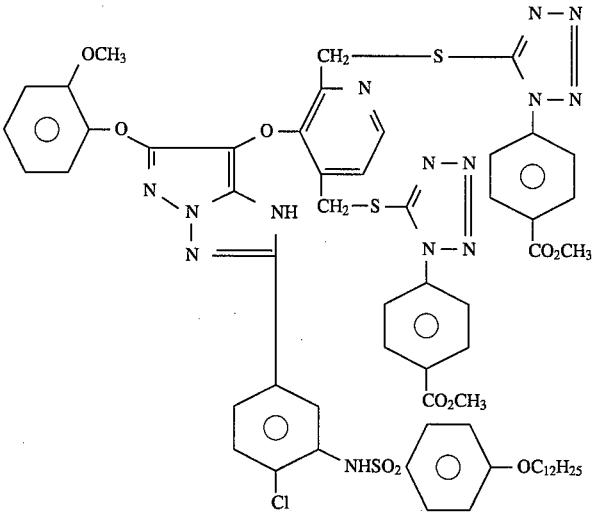
(CA-16)
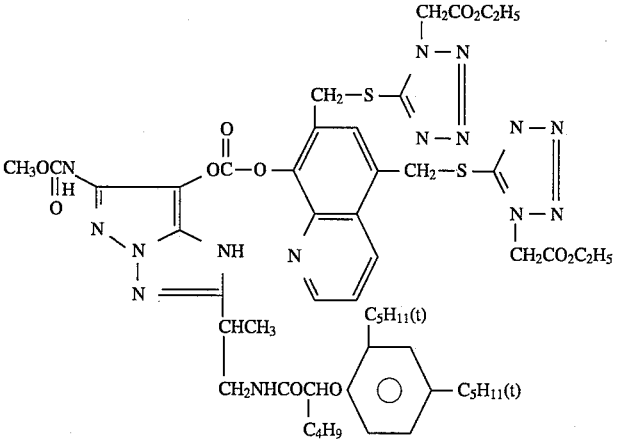

-continued
(CA-17)
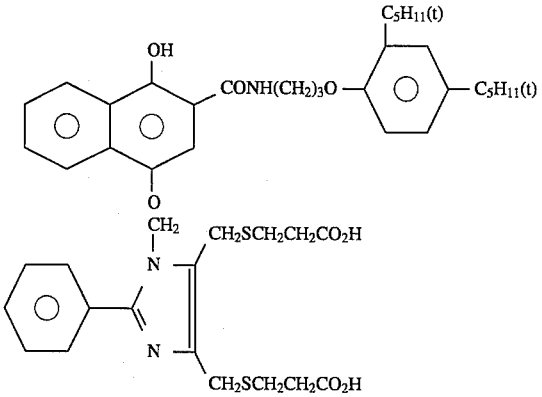
(CA-18)
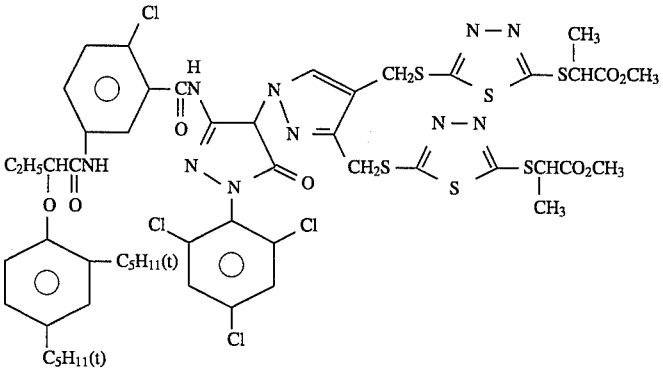
(CA-19)
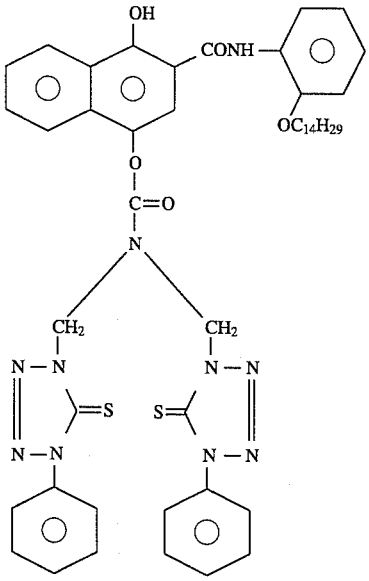
(CA-20)
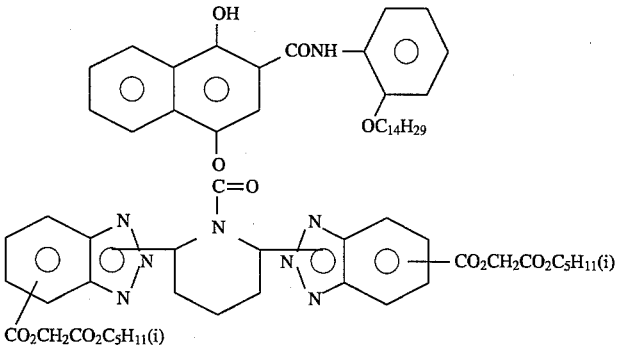

-continued
(CA-21)
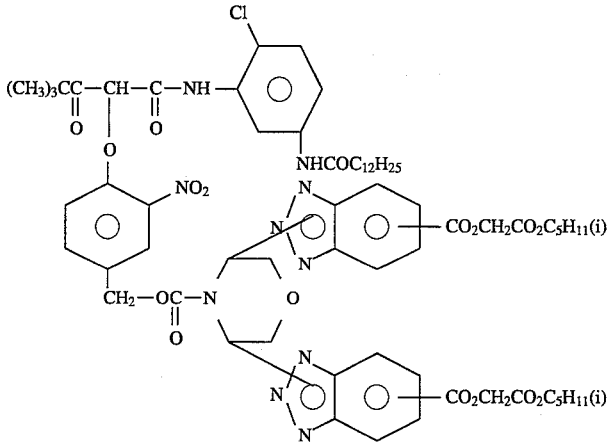
(CA-22)
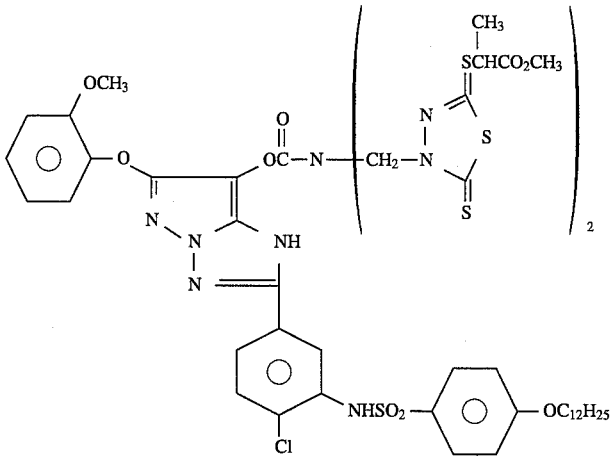
(CA-23)
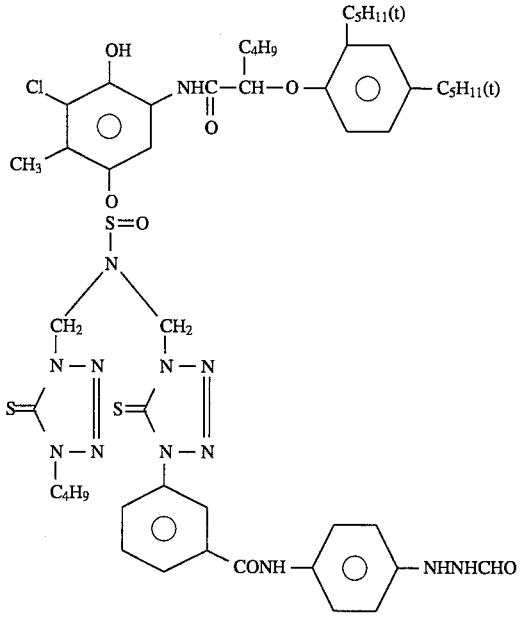

-continued
(CB-1)
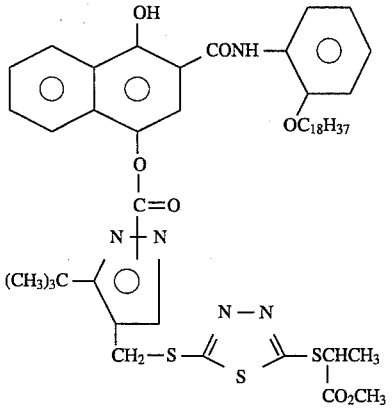
(CB-2)
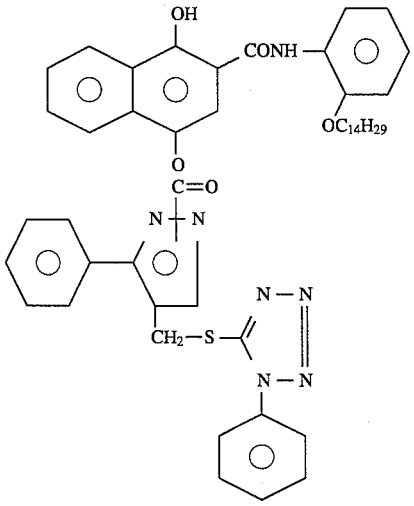
(CB-3)
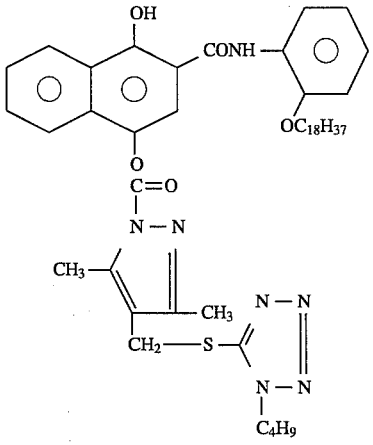

-continued
(CB-4)
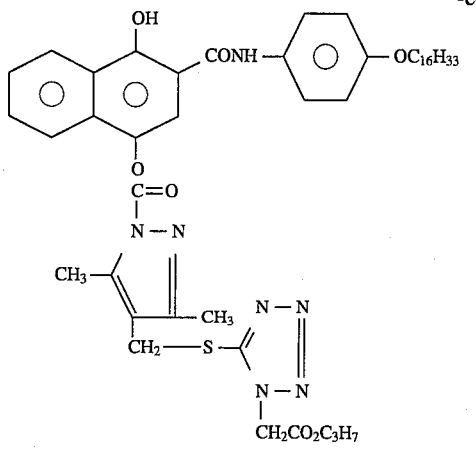
(CB-5)
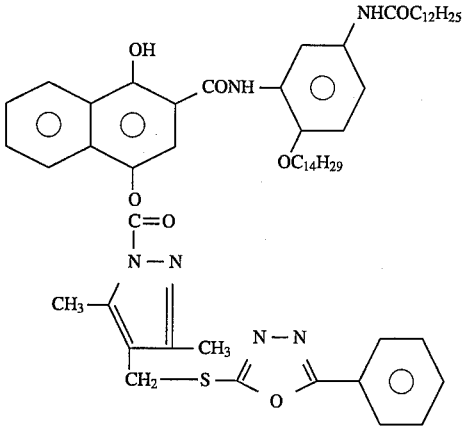
(CB-6)
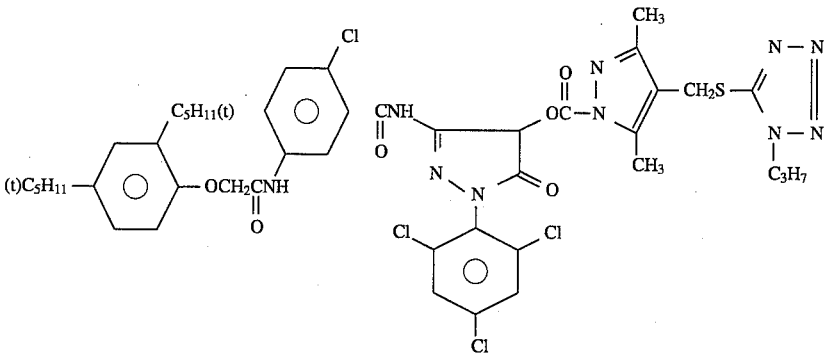
(CB-7)
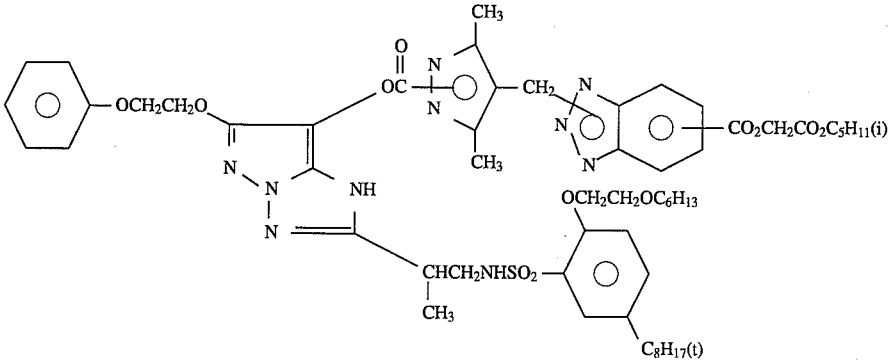

-continued
(CB-8)
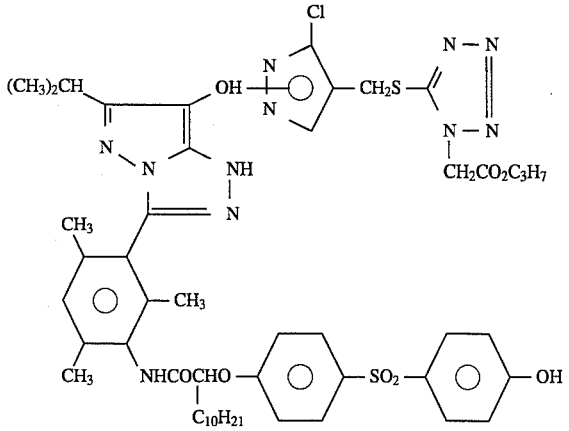
(CB-9)
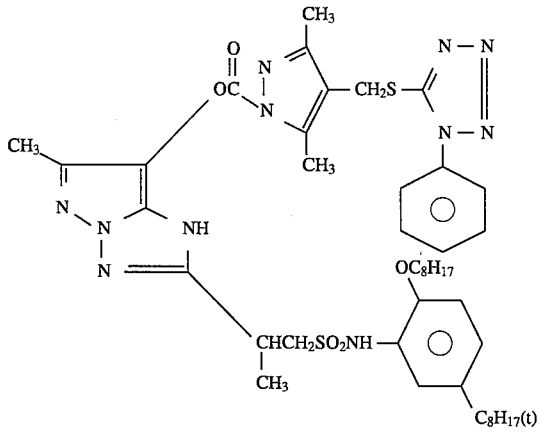
(CB-10)
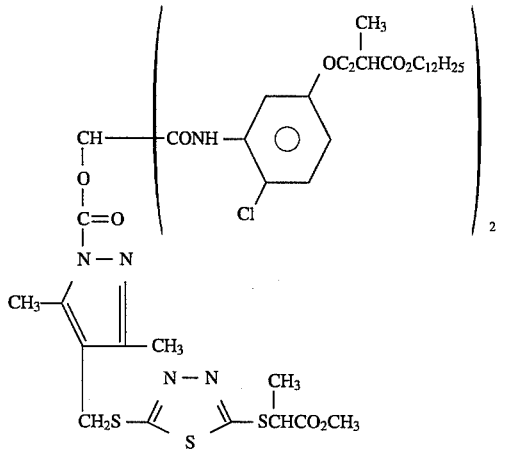
(CB-11)
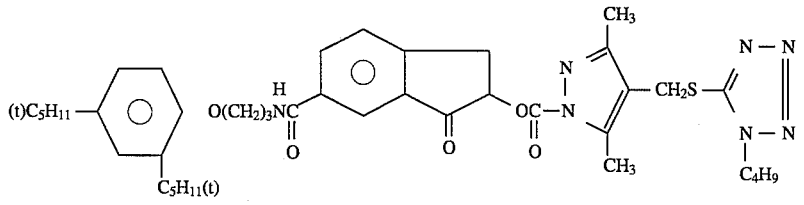

-continued
(CB-12)
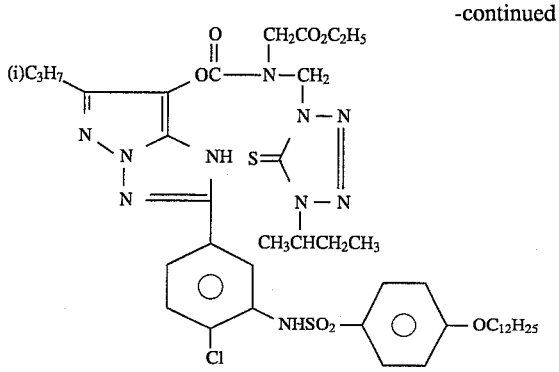
(CB-13)
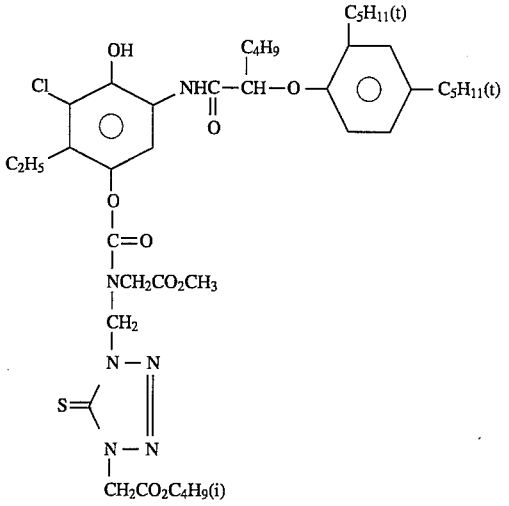
(CB-14)
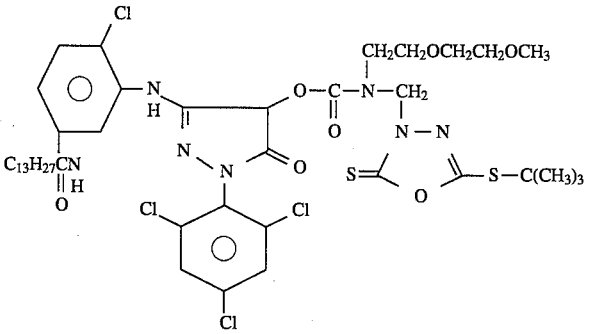
(CB-15)
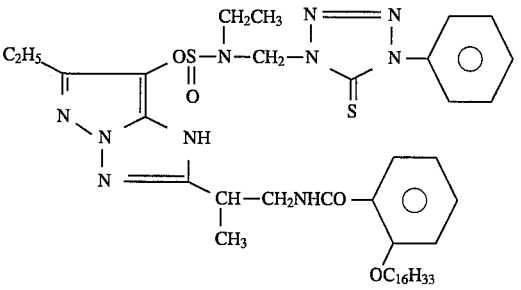

-continued
(CB-16)
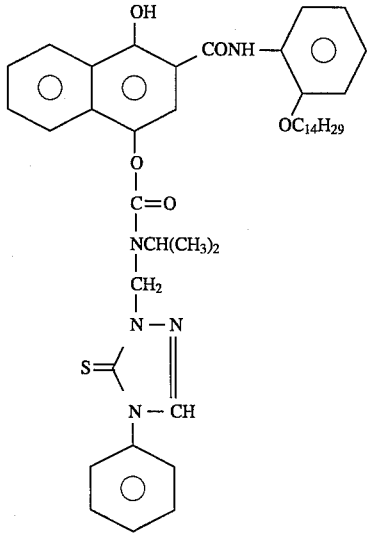
(CB-17)
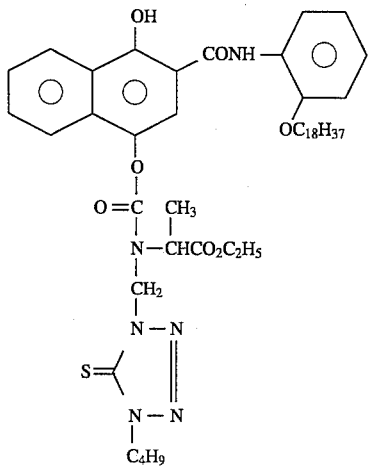
(CB-18)
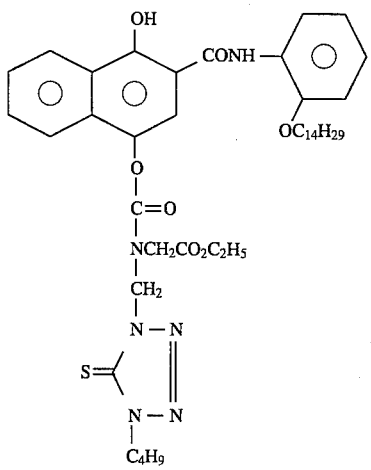

-continued
(CB-19)
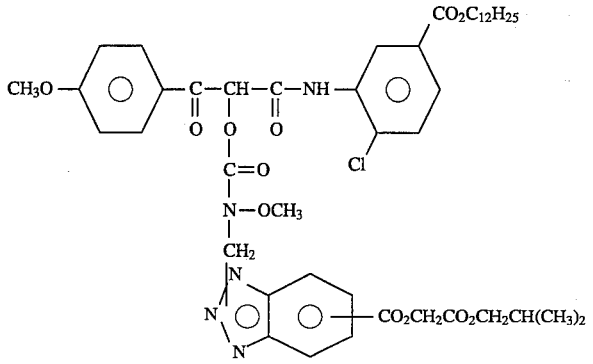
(CB-20)
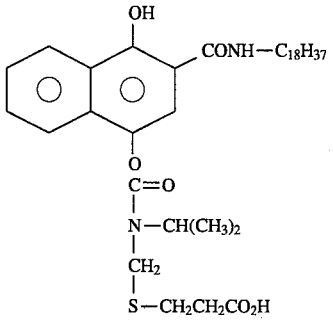
(CB-21)
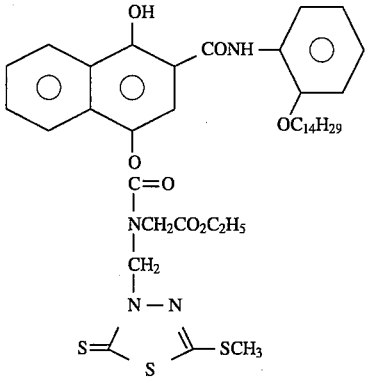
(CB-22)
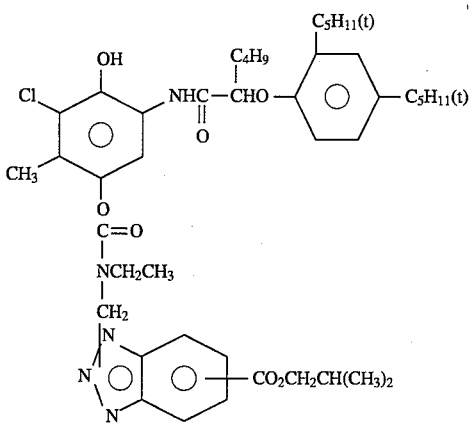

-continued
(CB-23)
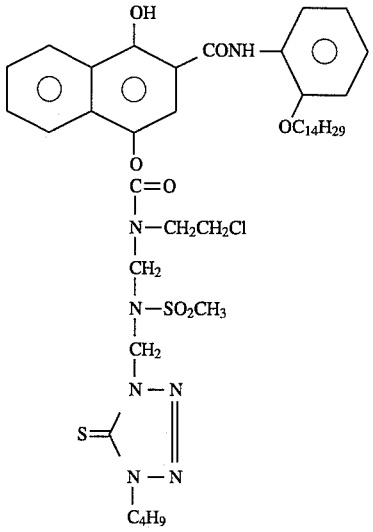
(CB-24)
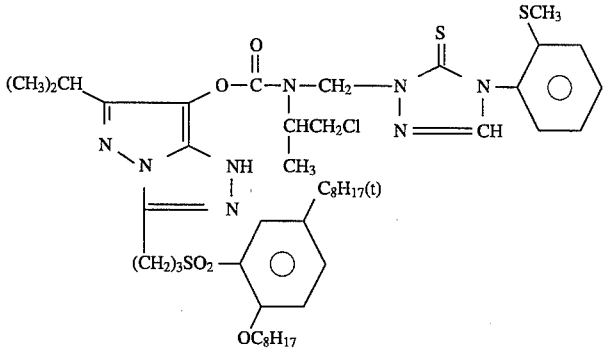
(CB-25)
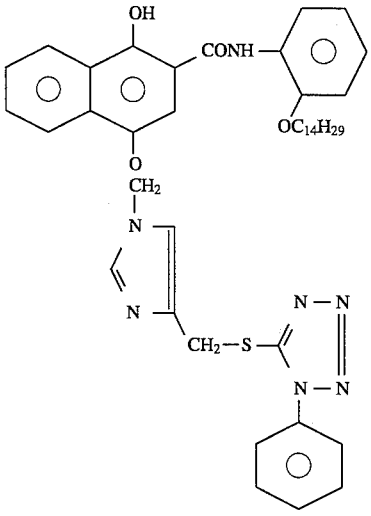

-continued
(CB-26)
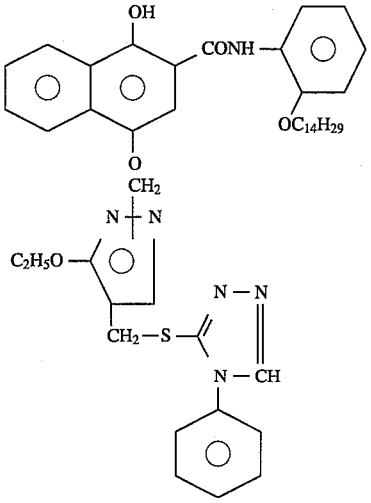
(CB-27)
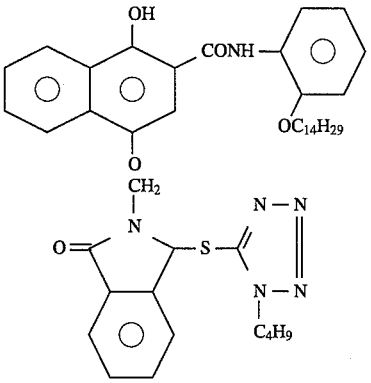
(CB-28)
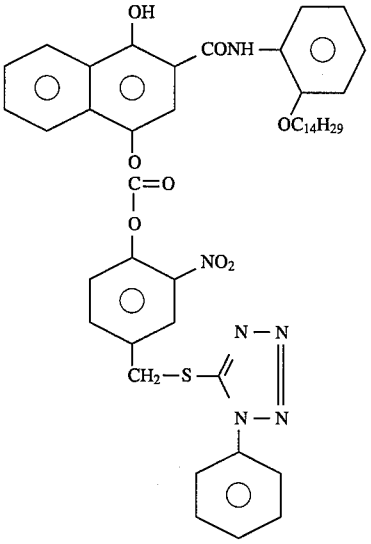

-continued
(CB-29)
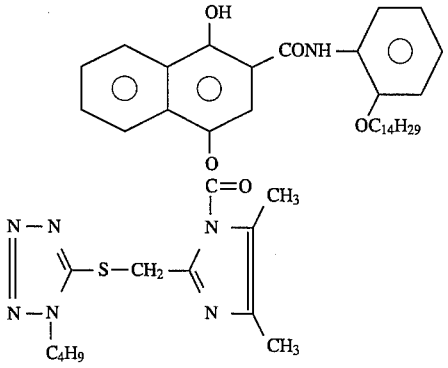
(CB-30)
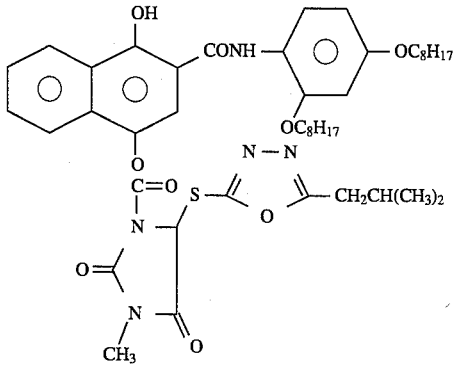
(CB-31)
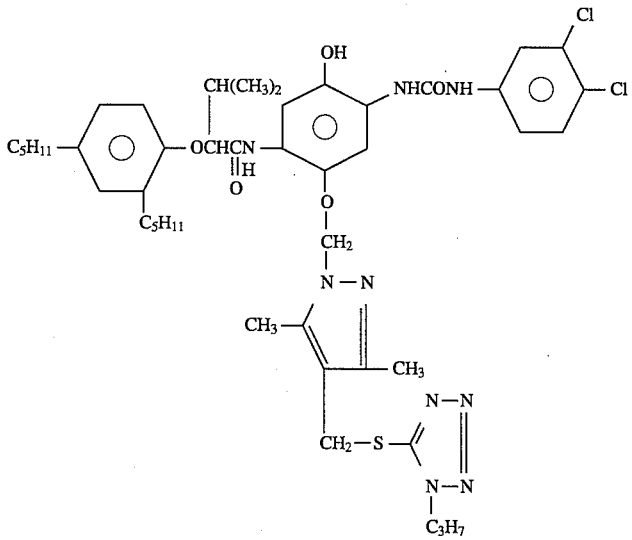
(CB-32)
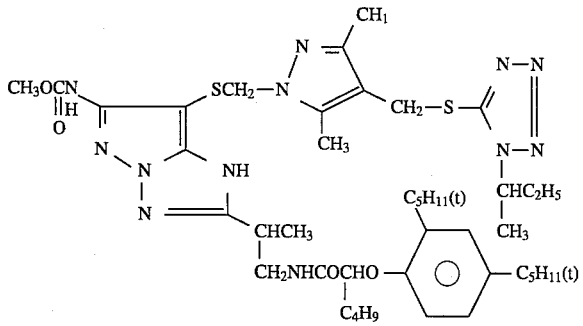

-continued
(CB-33)
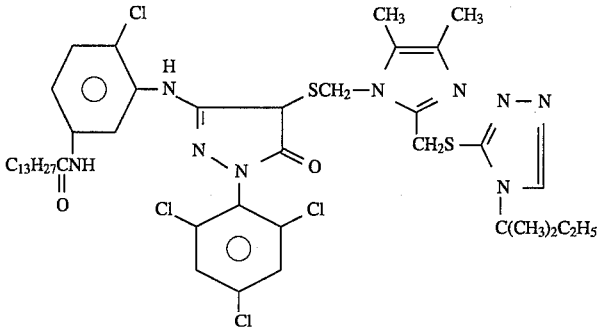
(CB-34)
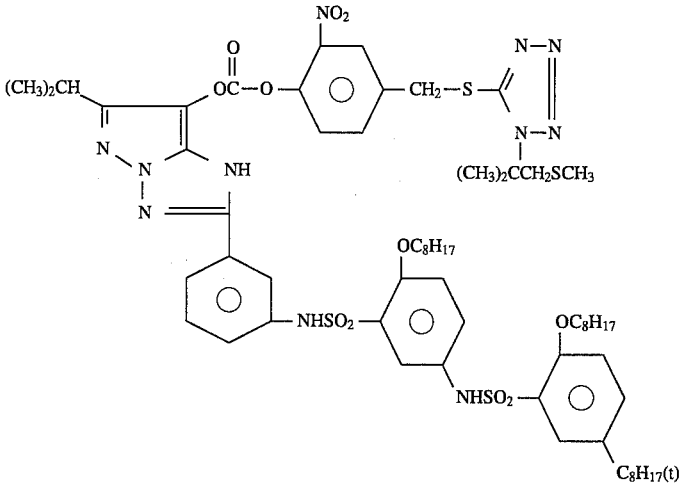
(CB-35)
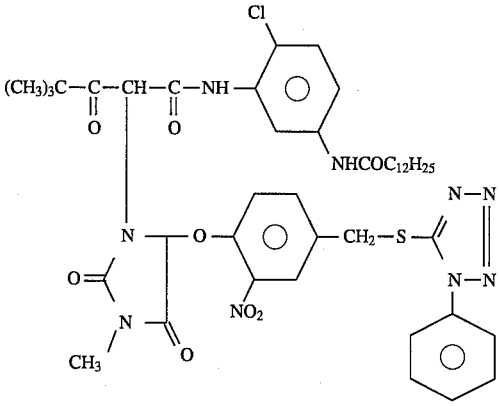
(CB-36)
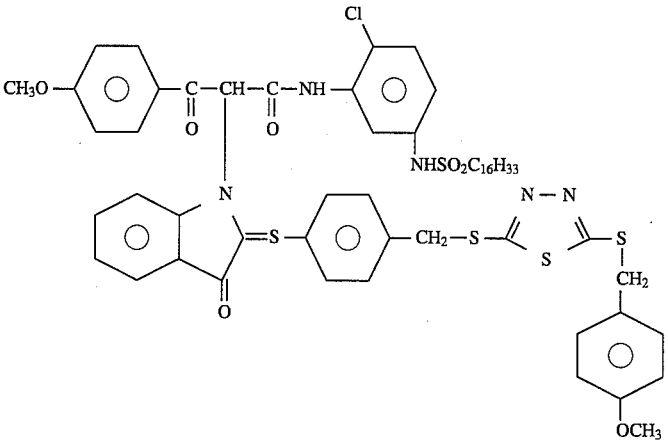

-continued
(CB-37)
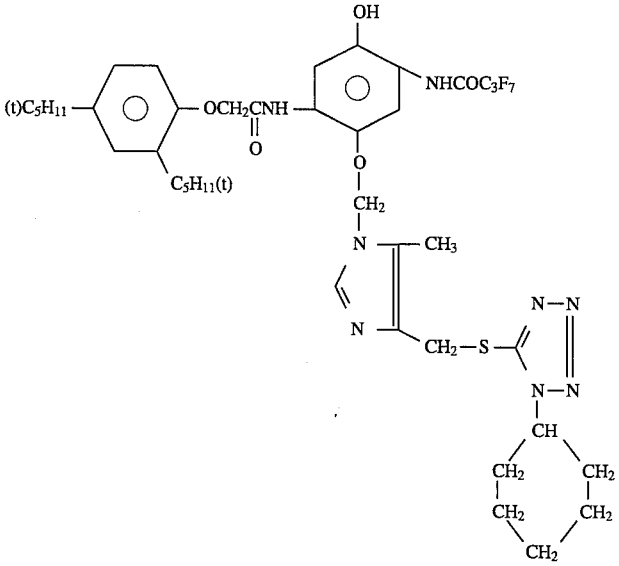
(CB-38)
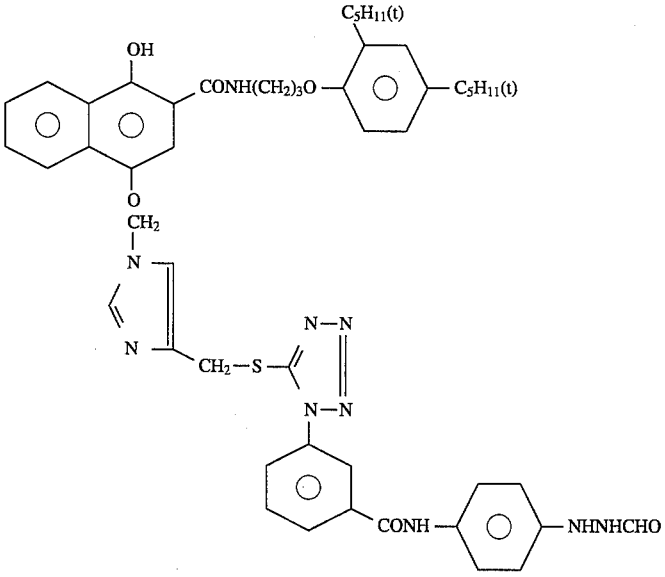
(SA-1)
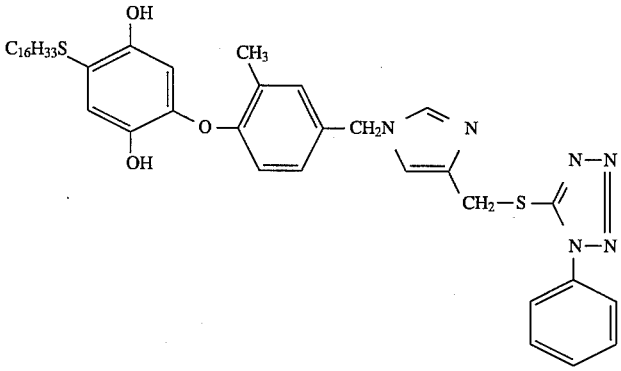

-continued
(SA-2)
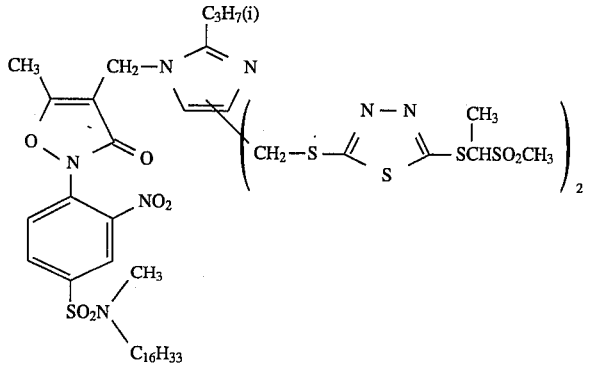
(SA-3)
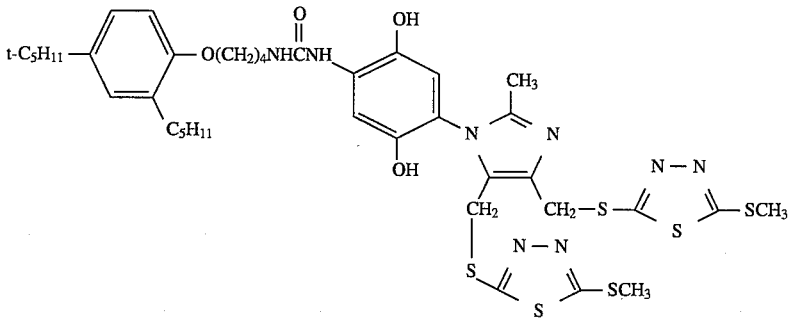
(SA-4)
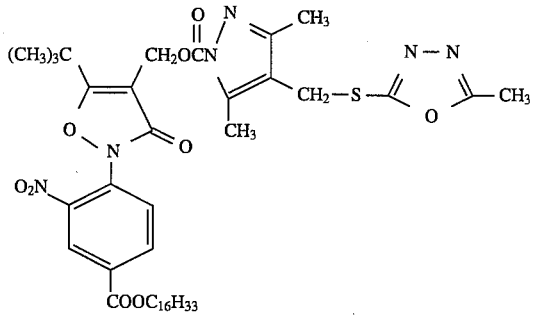
(SA-5)
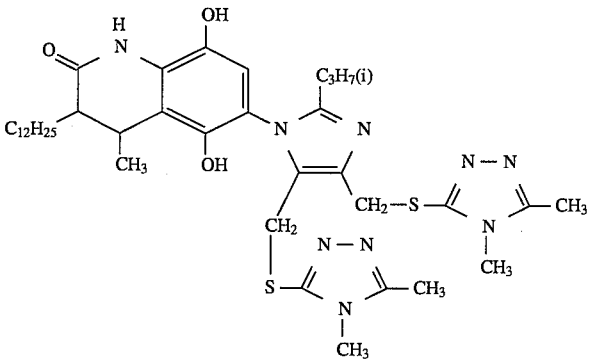

-continued (SA-6)

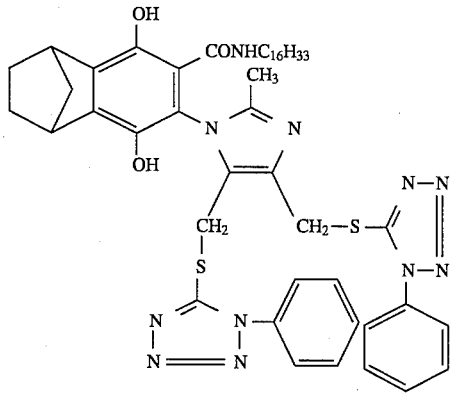

(SA-7)

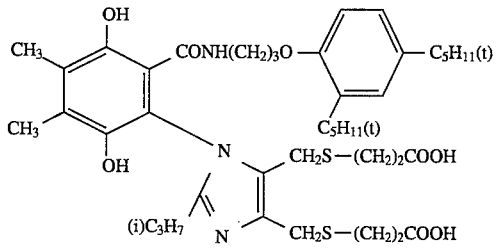

(SA-8)

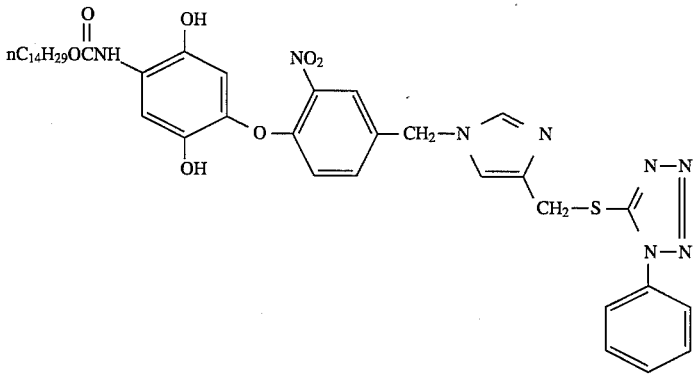

The compounds according of this invention can be synthesized by the methods disclosed in, for example, U.S. Pat. Nos. 4,847,383, 4,770,990, 4,684,604 and 4,886,736, JP-A-60-218645, JP-A-61-230135, JP-A-2-37070, JP-A-2-170832, and JP-A-2-251192, or by methods similar to these.

Actual examples of synthesizing compounds will be described.

(Synthesis 1): Synthesis of Exemplified Compound (CA-1)

The compound (CA-1) was synthesized in the synthesis route 1 illustrated below:

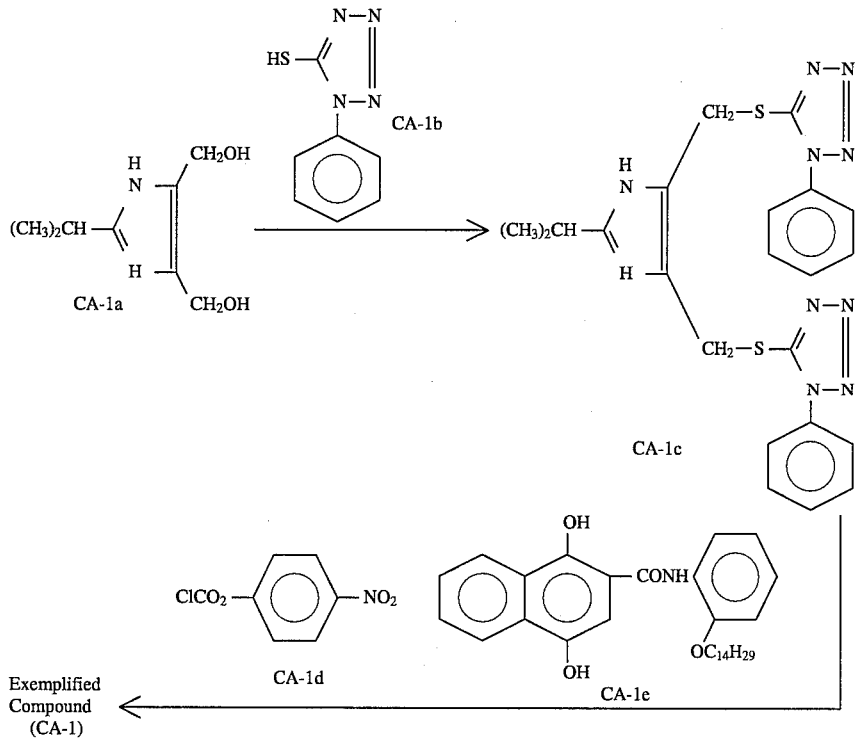

CA-1a (3.40 g) was reacted in thionyl chloride (30 ml) for 1 hour at 60° C. Next, the excessive thionyl chloride was distilled out under reduced pressure. The resultant residue was added to a dimethylformamide solution (0° C.) containing CA-1b (7.48 g) and diisopropylethylamine (10.5 ml). The resultant solution was stirred for 1 hour. Thereafter, the solution was poured into water (500 ml), whereby crystals were precipitated. The crystals were filtered out, thus obtaining 9.8 g of crude crystals of CA-1c. The structure of CA-1c was identified by means of NMR method.

CA-1c (3.20 g) and CA-1d (1.38 g) were reacted for 1 hour in 1,2-dichloroethane (30 ml). Then, an ethyl acetate solution (20 ml) of CA-1e (3.20 g) was added therein under water-cooling. Further, diisopropylethylamine (4.5 ml) was added, and the resultant mixture was stirred for 1 hour.

1N hydrochloric acid was added to terminate the reaction, then chloroform (30 ml) was added to the reaction solution for diluting the same. Thereafter, the reaction solution was water-washed three times, and the organic layer thereof was dried over sodium sulfate. The organic solvent was distilled out, whereby an oily substance was obtained. This substance was refined by means of silica-gel column chromatography (ethyl acetate-hexane=1:5), thereby obtaining 1.20 g of exemplified compound CA-1. The structure of compound CA-1 was identified by means of NMR method. The compound had a melting point of 133.0° to 134.0° C.

(Synthesis 2): Synthesis of Exemplified Compound (CA-19)

The compound (CA-19) was synthesized in the synthesis route 2 illustrated below:

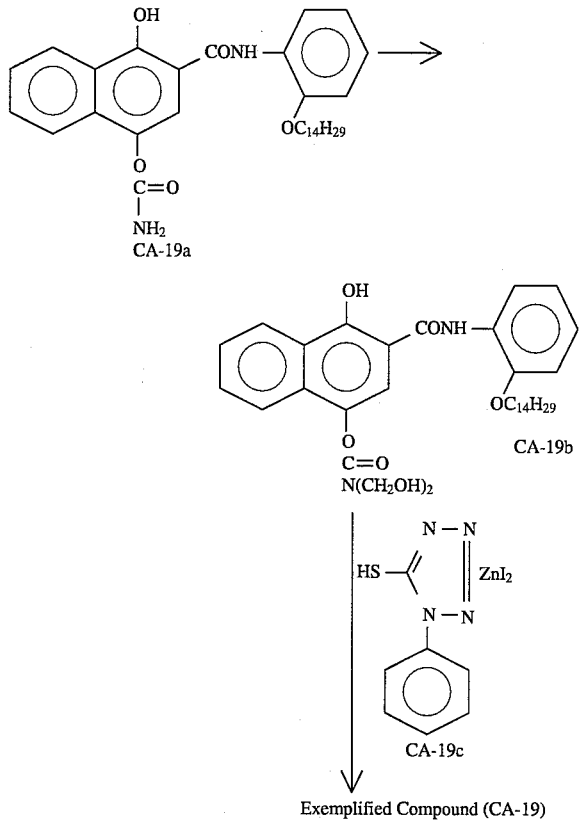

CA-19a (10.7 g) and 37% formalin aqueous solution (30 ml) were reacted for 5 hours at 70° C. in acetic acid (100 ml). The solvent was distilled out. Then, the resultant residue was refined by silica-gel column chromatography (ethyl acetate-hexane=2:1), thus obtaining 6.4 g of CA-19b (yield: 53%).

Next, CA-19b (3.2 g) and CA-19c (2.1 g) were suspended in chloroform (40 ml). Zinc iodide (5.7 g) was added to the suspension, whereby reaction was proceeded for 2 hours at room temperature. 1N hydrochloric acid was added, thus terminating the reaction. The reaction solution was diluted with 40 ml of chloroform and washed twice with water. The resultant organic layer was dried over sodium sulfate and condensed, whereby a residue was obtained. The residue was refined by means of silica-gel column chromatography (ethyl acetate-hexane=1:4). As a result, 4.1 g of compound (CA-19) was obtained (yield: 25%). The structure of this compound was identified by NMR method, mass-spectrum analysis, and element analysis.

(Synthesis 3): Synthesis of Exemplified Compound (CA-2)

The compound (CA-2) was synthesized in the synthesis route 3 shown below:

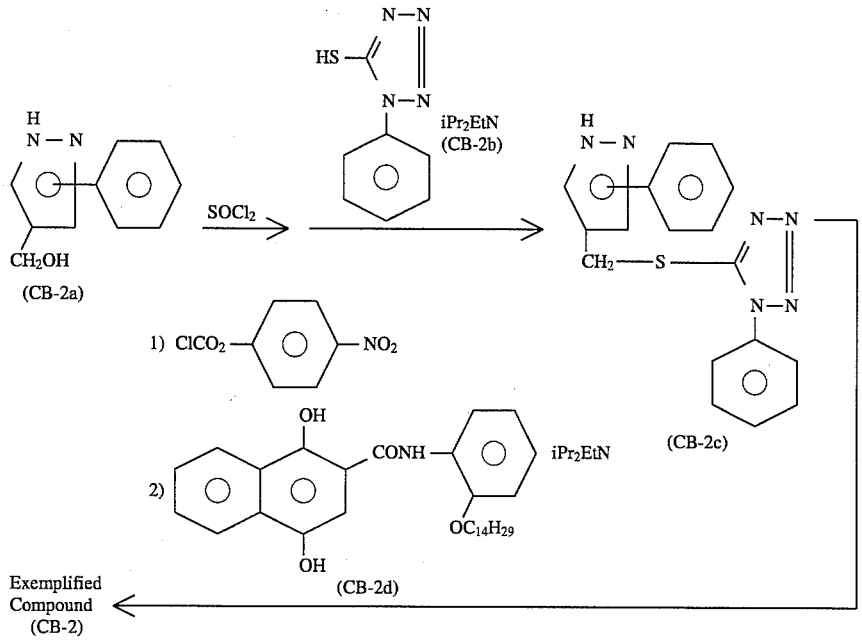

CB-2a (10 mmol) was suspended in chloroform (30 ml), forming a suspension. Thionyl chloride (20 mmol) was added to the suspension. Reaction was proceeded for 1 hour at 50° C. Next, the solvent was distilled out, obtaining a residue. The residue was added to a dimethylformamide solution (30 ml) containing CB-2b (10 mmol) and diisopropylethylamine (20 mmol) and was reacted for 1 hour. The reaction solution was poured into ice water (200 ml). Then, 50 ml of chloroform was added to the solution, which was stirred. Thereafter, the aqueous layer was removed, and the organic layer was water-washed twice, each time with 100 ml of water. The organic layer was dried over sodium sulfate and condensed, whereby compound CB-2c was obtained.

Compound CB-2c, thus obtained, was dissolved in chloroform (30 ml). Nitrophenylchlorocarbonate (10 mmol) was added to the solution, and reaction was proceeded for 1 hour. Next, ethyl acetate solution (50 ml) of CB-2d (10 mmol) was added to the reaction solution, and then diisopropylethylamine (50 mmol) was added to the solution. Reaction was proceeded for 1 hour. 1N hydrochloric acid (10 ml) was added, thereby terminating the reaction. The reaction solution was diluted with ethyl acetate (10 ml). The organic layer was water-washed, dried over sodium sulfate, and condensed, thus obtaining a residue. The residue was refined by means of silica-gel column chromatography (eluate:ethyl acetate-hexane=1:3). As a result, 1.94 g of compound CB-2 was obtained (yield: 23%). Compound CB-2 had a melting point of 101.5° to 102.5° C.

(Synthesis 4): Synthesis of Exemplified Compound (CB-3)

The compound (CB-3) was synthesized in the synthesis route 4 illustrated below:

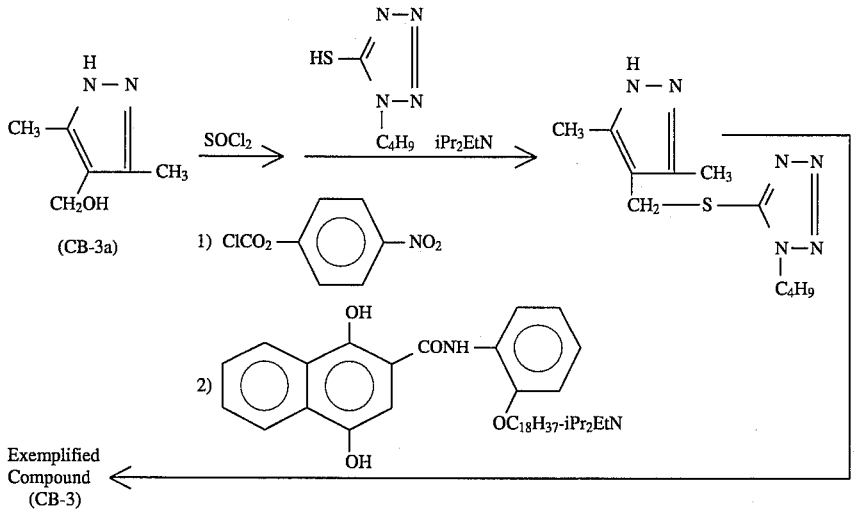

Using CB-3a as starting material, compound CB-3 was synthesized at the yield of 31%, in the same method as compound CB-2. Compound CB-3 had a melting point of 68.0° to 69.0° C.

(Synthesis 5): Synthesis of Exemplified Compound (CB-16)

The compound (CB-16) was synthesized in the route 5 illustrated below:

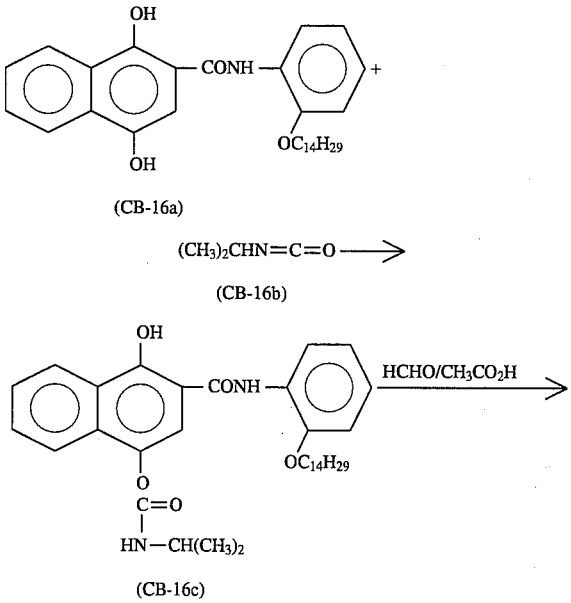

-continued

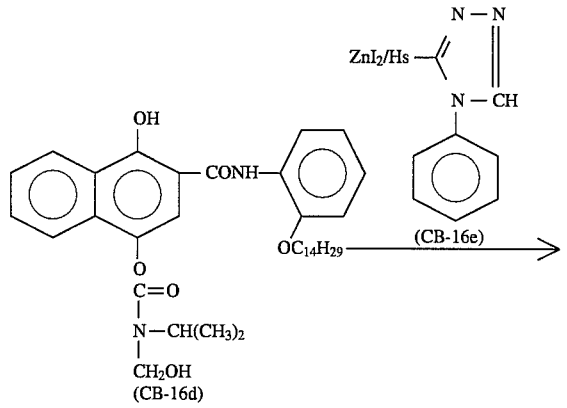

Exemplified Compound (CB-16)

First, 200 g of (CB-16a) and 34.7 g of (CB-16b) were dissolved in ethyl acetate (50 ml), forming a solution. Diisopropylethylamine (142 ml) was added to the solution. The resultant solution was stirred for 4 hours, and crystals were precipitated. The crystals were filtered out and washed with ethyl acetate, whereby 176 g of compound (CB-16c) was obtained (yield: 75%).

Next, 53.6 g of (CB-16c) and 27.9 g of paraformaldehyde were reacted for 4 hours in a mixture of 1,2-dichloroethane (500 ml) and acetic acid (54 ml) under refluxing. The reacted solution was cooled to room temperature, washed with water, dried over anhydrous sodium sulfate, and condensed. A residue thus obtained was refined by means of silica-gel column chromatography using chloroform as eluate, whereby 23.2 g of compound (CB-16d) was obtained (yield: 41.2%).

Then, 23.2 g of (CB-16d) and 6.78 g of (CB-16e) were dissolved in chloroform (250 ml), thus forming a solution. To this solution, 26.88 g of zinc iodide was added. The resultant solution was stirred for 3 hours. 1N hydrochloric acid was added to the solution, and the reaction solution was washed with water. The organic layer was dried over anhydrous sodium sulfate and condensed, obtaining a residue. The residue was refined by means of silica-gel column chromatography (ethyl acetate-hexane=1:4). As a result, 7.0 g of compound (CB-16) was obtained (yield: 23.9%). Compound (CB-16) had a melting point of 117.0° to 118.5° C.

(Synthesis 6): Synthesis of Exemplified Compound (CB-18)

The compound (CB-18) was synthesized in the same method as synthesis 5. Compound (CB-18) had a melting point of 61.5° to 63.0° C.

(Synthesis 7): Synthesis of Exemplified Compound (CB-25)

The compound (CB-25) was synthesized in the same method as synthesis 2 disclosed in JP-A-60-218645. Compound (CB-25) was obtained at yield of 7%,and had a melting point of 115° C.

(Synthesis 8): Synthesis of Exemplified Compound (SA-6)

The compound (SA-6) was synthesized in the synthesis route 6 shown below:

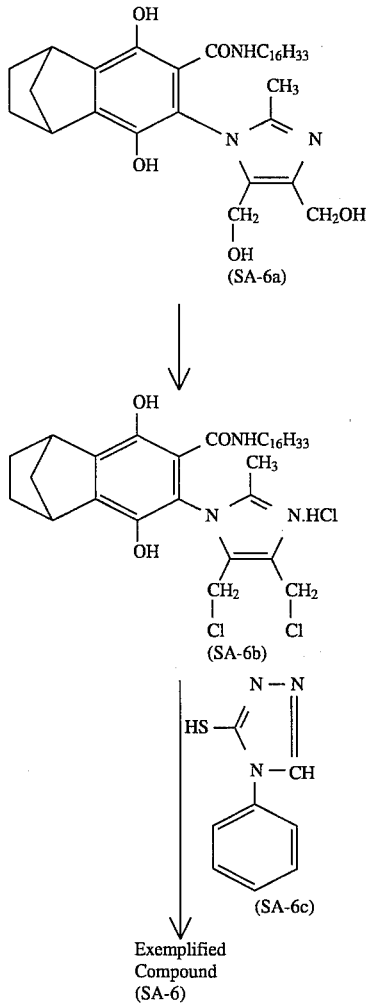

First, 11.6 g of SA-6a (synthesized by the same method as described in JP-A-61-230135) was added to 30 ml of thionyl chloride under water-cooling. Reaction was proceeded for 1 hour at 50° C. in the resultant solution. The excessive thionyl chloride was distilled out under reduced pressure. The crystals precipitated in the solution were washed with a small amount of ice-cooled chloroform, thereby obtaining SA-6b in the form of crude crystal. Next, 13.1 g of SA-6b was added at 0° C. to an N,N-dimethylformamide solution (100 ml) of 7.2 g of SA-6c and 12.1 g of triethylamine. Reaction was effected in the resultant solution for 1 hour at room temperature.

The reaction mixture was poured into an aqueous solution of 60 ml of 2N hydrochloric acid and 300 ml of ice water. Further, 300 ml of ethyl acetate was added to the solution. The resultant solution was stirred. The solution was introduced into a separating funnel, thus collecting the organic layer. The organic layer was then water-washed several times, dried with anhydrous sodium sulfate and condensed, whereby a residue was obtained. The residue was refined by means of silica-gel column chromatography (ethyl acetate-hexane=1/4 to 1/1 (V/V) was used as eluate). As a result, 3.7 g of compound SA-6 was obtained in the amorphous form.

The compound of the formula (I) and/or the compound of the formula (II) are added to the light-sensitive material in an amount of $1\times10^{-7}$ to $5\times10^{-4}$ mol/m$^2$, preferably $1\times10^{-6}$ to $3\times10^{-4}$ mol/m$^2$, more preferably $5\times10^{-6}$ to $2\times10^{-4}$ mol/m$^2$.

Regarding the tabular silver halide emulsion used in the present invention, "aspect ratio" means the ratio of the diameter of the silver halide grain to the thickness thereof. In other words, the aspect ratio of a silver halide grain is obtained by dividing the diameter of the grain by the thickness thereof. Here, the word "diameter" is that of a circle which has the area equal to the projected area of the grain, which is determined by observing the silver halide emulsion by means of a microscope or an electron microscope.

The average aspect ratio is an average value of the aspect ratios of individual silver halide grains. In this case, the projected areas of the respective grains are summed in the order of the aspect ratios from the greatest one to the lowest one, until the summed projected areas reach 50% of the projected areas of all grains.

The tabular silver halide grains used in the silver halide emulsion of this invention have each an aspect ratio of 2 or more, preferably 3 to 20, more preferably 4 to 15, or still more preferably 5 to 10. The total projected area of the tabular grains occupies 50% or more, preferably 70% or more, more preferably 85% or more, of the total projected area of all silver halide grains contained in the emulsion.

The use of such an emulsion serves to provide a silver halide light-sensitive material which has an excellent sharpness, since the light-scattering in the layer of this emulsion is far less prominent than in the layer of a conventional emulsion. This can be easily ascertained by the experimental method which those skilled in the art usually perform. Although why light-scattering is less in a layer of tabular silver halide emulsion is unclear, it is possibly because the major surface of the grains are orientated parallel to the support surface.

It is desirable that the tabular silver halide grains have diameters of 0.02 to 20 μm, preferably 0.3 to 10.0 μm, more preferably 0.4 to 5.0 μm, and thicknesses of 0.5 μm or less. The "diameter" of a tabular silver halide grain is the diameter of a circle having the area equal to the projected area of the grain. The "thickness" of a tabular silver halide grain is the distance between the two parallel surfaces which construct the grain.

In the present invention, more preferable tabular silver halide grains are those which have a diameter of 0.3 to 10.0 μm, a thickness of 0.3 μm or less and the average aspect ratio (diameter thickness) of 5 to 10. If the grains have a greater diameter, a greater thickness and a greater aspect ratio, the light-sensitive material will have, in some cases, abnormal photographic properties when it is bent, is rolled tightly, or contacts a sharp object. Particularly preferable is an emulsion containing silver halide grains having a diameter of 0.4 μm to 5.0 μm, in which grains having an average aspect ratio of 5 or more occupy 85% or more of the total projected area of all grains.

The tabular silver halide grains used in the invention can be silver chloride, silver bromide, silver chlorobromide, silver bromoiodide, or silver bromochloroiodide. Preferable are silver bromide, silver chlorobromide, silver bromoiodide containing 15 mol % or less of silver iodide, or silver bromochloroiodide containing 50 mol % or less of silver chloride and 2 mol % or less of silver iodide. The compositional distribution of mixed silver halide is uniform or localized.

The photographic emulsion for use in the present invention are described in the report of Cugnac, Chateau; G. F. Duffin, "Photographic Emulsion Chemistry", Focal Press, New York (1966), pp. 66–72, and A. P. H. Trivelli, W. F. Smith, ed., "Phot. Journal," 80 (1940), p. 285. They can easily be prepared by the methods disclosed in JP-A-58-113927, JP-A-58-113928. and JP-A-58-127921.

The emulsion can be prepared by, for example, forming seed crystals, 40% or more by weight of which are tabular grains, in atmosphere of relatively high pAg and pBr of 1.3, and then growing the seed crystals while adding silver and a halogen solution simultaneously, and while maintaining similar pBr. It is desirable that silver and a halogen solution be added during the growth of grains, so that no new crystal nuclei are formed.

The size of the tabular silver halide grains can be adjusted by controlling the temperature, selecting a kind of solvent or quality thereof, and the addition rate of silver salt and halide.

If necessary, a silver halide solvent can bee used at the time of forming tabular silver halide grains, thereby to control the grain size, the grain shape (diameter/thickness, etc.), the grain size distribution, and the growth rate of grain. Preferably, the solvent is used in an amount of $10^{-3}$ to 1.0 wt % of the reaction solution. More preferably, it is used in an amount of $10^{-2}$ to $10^{-1}$ wt % of the reaction solution. In the present invention, when the greater the amount of the solvent is used, the distribution of grain size may become monodispersing, and the grain growth speed can be enhanced. There is the tendency that the grains grow thicker as the amount of the solvent is increased.

In the present invention, the silver halide solvent can be a known one. Examples of silver halide solvents often used are: ammonia, thioether, thiourea, thiocyanate salt, and thiazolinethione. The use of thioether is disclosed in U.S. Pat. Nos. 3,271,157, 3,574,628, 3,790,387, and the like. The use of thiourea is described in JP-A-53-82408 and JP-A-55-77737, the use of this cyanate salt is disclosed in U.S. Pat. Nos. 2,222,264, 2,448,534, and 3,320,069. The use of thiazolinethione is disclosed in JP-A-53-144319.

In the process of forming or physical ripening of the silver halide grains, a salt such as cadmium slat, zinc salt, tallium salt, iridium salt, a complex salt of any of these metals, rhodium salt, a complex salt thereof, iron salt, or a complex salt thereof can be used together.

To form tabular silver halide grains for use in the invention, it is recommendable that a silver salt solution (e.g., $AgNO_3$ aqueous solution) and a halide solution (e.g., KBr aqueous solution), both used for accelerating the growth of the grains, be added at higher speeds, in greater amounts, and in higher concentrations. The method of accelerating the growth of grains is described in, for example, U.S. Pat. Nos. 1,335,925, 3,650,757, 3,672,900, and 4,242,445, JP-A-55-142329, and JP-A-55-158124.

If necessary, the tabular silver halide grains of the invention can be chemically sensitized by, for example, the method disclosed in H. Frieser, ed., "Die Grundlagen der Photographischen Prozesse mir Silber-halogeniden," Akademische Verlagsgesellschaft, 1968, pp. 675–735.

More specifically, sulfur sensitization, reduction sensitization, and precious-metal sensitization, can be employed, either singly or in combination. In the sulfur sensitization, use is made of a sulfur-containing compound that can react with silver or active gelatin, such as thiosulfate, thiourea, mercapto compound, or rhodanine. In the reduction sensitization, use is made of a reducing substance such as stannous salt, amine, hydrazine derivative, formamidine sulfinic acid, or silane compound. In the precious-metal sensitization, use is made of gold complex salt or complex salt of a metal of Group VIII (e.g., Pt, Ir, or Pd).

Specific examples of sulfur sensitization are disclosed in U.S. Pat. Nos. 1,574,944, 2,278,947, 2,410,689, 2,728,668, and 3,656,955. Specific examples of reduction sensitization are disclosed in U.S. Pat. Nos. 2,419,974, 2,983,609, and 4,054,458. Specific examples of precious-metal sensitization are described in U.S. Pat. No. 2,399,083, U.S. Pat. No. 2,448,060, and British Patent 618,061.

To save silver, it is particularly recommendable that the tabular silver halide grains of the invention be gold-sensitized or sulfur-sensitized, or both gold-sensitized and sulfur-sensitized.

It is desirable that the tabular silver halide grains of this invention be spectral-sensitized with, for example, methine dyes. The tabular silver halide grains of the invention are characterized by not only the improvement of their sharpness, but also their high spectral speed. Examples of the dyes used are: cyanine dye, melocyanine dye, complex cyanine dye, complex melocyanine dye, holopoler cyanine dye, hemicyanine dye, styryl dye, and hemioxonol dye. Of these dyes, particularly useful are cyanine dye, melocyanine dye, and complex melocyanine dye.

Examples of useful sensitizing dyes are disclosed in German Patent 929,080, U.S. Pat. Nos. 2,493,748, 2,503,776, 2,519,001, 2,912,329, 3,656,959, 3,672,897 and 4,025,349, British Patent 1,242,588, and JP-B-44-14030 ("JP-B" means Published Examined Japanese Patent Application.)

These sensitizing dyes can be used, either singly or in combination. In many cases, they are used in combination, for supersensitization, as is disclosed in U.S. Pat. Nos. 2,688,545, 2,977,229, 3,397,060, 3,522,052, 3,527,641, 3,617,293, 3,628,964, 3,666,480, 3,672,898, 3,679,728, 3,814,609 and 4,026,707, British Patent 1,344,281, JP-B-43-4936, JP-B-53-12375, and JP-A-52-109925, and JP-A-52-110618.

The photographic emulsion used in the invention can contain various compounds to prevent fogging from occurring during the manufacture, storage or processing of the light-sensitive material, and to stabilize the photographic properties. More precisely, compounds known as antifoggants and stabilizing agents can be added to the emulsion. Examples of these compounds are: azoles such as benzothiazolium salt, nitroindazole, triazole, benzotriazole, and benzimidazole (particularly, nitro- or halogen-substituted derivatives); heterocyclic mercapto compounds such as mercaptothiazole, mercaptobenzothiazole, mercaptobenzimidazole, mercaptothiadiazole, mercaptotetrazole (particularly, 1-phenyl-5-mercaptotetrazole), and mercaptopyrimidine; heterocyclic mercapto compound having water-soluble group such as a carboxyl group or a sulfo group; thioketo compounds such as oxazolinethion; azainedines such as triazainedine, tetraazainedine (particularly, 4-hydroxy-substituted (1, 3, 3a, 7) tetrazinedines); benzenethiosulfonic acids; and benzensulfinic acids. Specific examples of these compounds, and methods of using them are disclosed in, for example, U.S. Pat. Nos. 3,954,474, 3,982,947 and 4,021,248, and JP-B-52-28660.

It is desirable that the emulsion of the invention be a monodispersed one.

The monodispersed emulsion according to this invention is an emulsion having the grain size distribution whose variation coefficient with respect to the grain size of silver halide is 0.25 or less. The term "variation coefficient" is a value obtained by dividing the standard deviation of grain size by the average grain size. The average grain size r is:

$$\bar{r} = \frac{\Sigma ni \cdot ri}{\Sigma ni}$$

where ri is the grain size of each emulsion grain, and ni is the number of grains.

The standard deviation S is defined as follows:

$$S = \sqrt{\frac{\Sigma(\bar{r} - ri)^2 \cdot ni}{\Sigma ni}}$$

The "grain size" of each grain is the equivalent-circle diameter corresponding to the projected area which is determined from a micro-photograph taken of the emulsion by the known method (usually by an electron microscope), as is disclosed in T. H. James et al., "The Theory of the Photographic Process," third ed., pp. 36–43, Macmillan Publishing Co., Inc. (1966). As is defined in the book, the term "equivalent-circle diameter of projected area" is the diameter of the circle whose area is equal to the projected area of a silver halide grain. Hence, even if the silver halide grains are not spherical (e.g., cubic, octahedral, tetradecahedral, tabular, potato-shaped), their average size (diameter) r and the standard deviation S thereof can be obtained.

The variation coefficient related to the silver halide grain size is preferably 0.25 or less, more preferably 0.20 or less, and still more preferably 0.15 or less.

Particularly preferred as the tabular silver halide emulsion of the present invention is one containing monodispersed hexagonal tabular silver halide grains. An example of such an emulsion is disclosed in, for example, JP-A-63-151618.

"Hexagonal tabular silver halide grains" are characterized in that the shape of their {1, 1, 1} face is hexagonal, having an adjacent side ratio of 2 or less. The term "adjacent side ratio" means the length ratio of the longest side of a hexagon to the shortest side thereof. The hexagonal tabular silver halide grains of the invention can have slightly rounded corners, provided they have an adjacent side ratio of 2 or less. In the case of hexagonal tabular grains having slightly rounded corners, the length of any side is defined as the distance between the two points of intersection obtained by prolonging the part of the straight line of that side and the part of the straight lines of the two adjacent sides. It is desirable that ½ or more of the each side of hexagonal tabular grain, preferably ⅘ or more of them be substantially straight. In the present invention, the adjacent side ratio of the grains is preferably 1 to 1.5.

The hexagonal tabular silver halide emulsion of the invention comprises a dispersion medium and silver halide grains. The total projected area of hexagonal tabular silver halide grains occupies 50% or more, preferably 70% or more, more preferably 90% or more, of the total projected area of all silver halide grains.

The hexagonal tabular silver halide grains of the invention can be made of silver bromide, silver bromoiodide, silver chlorobromide, or silver bromochloroiodide. Of these, silver bromide and silver bromoiodide are preferred. In the case of grains made of silver bromoiodide, their silver iodide content is preferably 0 to 30 mol %, more preferably 2 to 15 mol %, sill more preferably 4 to 12 mol %. Silver iodide distribution in each grain can be uniform, or different between an internal region and an outer region thereof. Further, each grain can have a so-called "multilayered structure", consisting of two or more layers whose silver iodide contents is different from each others. Preferable grains are those generally known as "internal iodide type grains," in which the outer region contains less silver iodide than the internal region.

The hexagonal tabular silver halide emulsion can be manufactured by the method described in U.S. Pat. No. 4,797,354.

A monodispersed hexagonal tabular silver halide emulsion is manufactured in three steps, i.e., a step of nucleation, a step of Ostwald ripening, and a step of growing grains. During the nucleation, pBr is maintained at 1.0 to 2.5, and nucleation is performed in supersaturated conditions for forming many nuclei (i.e., tabular grain nuclei) each having twined faces as parallel as possible. The supersaturated condition is obtained by adjusting various factors, e.g., temperature, gelatin concentration, addition rate of a silver salt aqueous solution and a halogenated alkali aqueous solution, pBr, iodine ion content, stirring speed, pH, amount of the silver halide solvent used, and salt concentration. During the Ostwald ripening, all grains formed during the nucleation step, with the exception of tabular grain nuclei, are disappeared, and the tabular grain nuclei are made to grow. In the ripening, the temperature, pBr, pH, the gelatin concentration, and the amount of silver halide solvent, are adjusted, in order to form the nuclei which has good monodispersion properties. During the grain-growing step, pBr, amount of silver ions and halogen ions to be added are controlled, thereby enabling to obtain hexagonal tabular silver halide grains which have a desirable aspect ratio and an appropriate size. During the grain-growing step, the addition rate of silver ions and halogen ions is 30 to 100% of the critical crystal growth.

In the emulsion of the invention, it is desirable that 50% of the silver halide grains have 10 or more dislocation lines each.

Dislocation in tabular grains can be observed by a direct method disclosed in J. F. Hamilton, Phot. Sci. Eng., 11, 57 (1967) and T. Shlozawa, J. Soc. Phot. Sci. Jap., 35, 213(1972), in which use is made of a transmission electron microscope at low temperatures. More specifically, silver halide grains separated from the emulsion, not applying a pressure which is so high as to cause dislocation in the grains, are placed on a mesh designed for use in electron microscope observation, and are observed by the transmission method. During the observation, the grain sample is kept cooling in order not to suffer from damages (e.g., printouts) due to electron beams. In this case, the thicker the grains, the more hard it is for electron beams to pass through the grains. Hence, electron microscope of a high-pressure type (for example, 200 KV to the grains of 0.25 μm thick) should better be employed to observe the grains clearly. The position and the number of the dislocation in each grain, which are observed in a direction perpendicular to the major surface of the grain, can be known from the photograph of the grain thus obtained.

In each tabular grain of the invention, dislocation occurs in an annular region defined by the periphery of the grain and the closed curve obtained by connecting positions each of which is away from the center of the long axis by x% of the distance between the center. The value for x is preferably $10 \leqq x < 100$, more preferably $30 \leqq x < 98$, still more preferably $50 \leqq x < 95$. The hexagonal figure formed by connecting the points at which dislocation initiates, i.e., the figure of the closed curve, is substantially similar to the shape of the grain, but not perfectly similar. The line of dislocation extends from the center of the grain toward the side, but it meanders in many cases.

Regarding to the number of dislocation in the tabular grain of the invention, it is preferable that more than 50% by number or more of the tabular grains contained in the silver halide emulsion of the invention have 10 or more dislocation lines each. More preferably, 80% by number or more of the tabular grains have 10 or more dislocation lines each. Still more preferably, 80% by number or more of the tabular grains have 20 or more dislocation lines each.

Also, in the case of the tabular silver halide grains preferably used in the invention, 50% by number or more of which have 10 or more dislocation lines each, the relative standard deviation of silver iodide content of each grain is preferably 30% or less, more preferably 20% or less.

The silver iodide content of each emulsion grain can be measured by analyzing the composition of the gain by means of, for example, an X-ray micro-analyzer. The term "relative standard deviation of silver iodide content of each grain" means the value obtained by measuring the silver iodide contents of at least 100 grains by the X-ray micro-analyzer, calculating the average silver iodide content of these grains and the standard deviation of silver iodide content from the measured value, then by dividing the calculated value of the standard deviation of silver iodide content by the average silver iodide content, and multiplying the resultant value by 100. A method of measuring the silver iodide content of each emulsion grain is described in, for example, European Patent 147,848A.

When the relative standard deviation of silver iodide content is great, the appropriate timings at which to chemically sensitive the individual grains will be different, and it will be impossible to make the best use of the potential properties of all emulsion grains. Also, in this case, the relative standard deviation in terms of the number of dislocation lines among the grains will become to be great.

The silver iodide content Yi (mol %) of each grain and the equivalent-sphere diameter Xi (microns) have correlation in some cases, and have no correlation in other cases. It is desirable that the content Yi and the diameter Xi have no correlation at all.

The structure related with halogen composition of the tabular grains can be identified by using various methods in combination. Among these methods are: X-ray diffraction; EPMA method (also known as "XMA method; ESCA analysis (also known as "XPS method"). In the EPMA method, silver halide grains are scanned with electron beams, thereby to detect the composition of the grains. In the ESCA method, X rays are applied onto grains, and the photoelectrons emanating from the grains are spectroscopically analyzed.

In the present invention, the words "surface of a grain" means the surface region of the grain which is about 50 angstroms deep from the surface. The halogen composition of this region can be usually determined by means of the ESCA method. The words "inner portion of a grain" means the region of the grain other than the "surface" thereof.

The emulsion containing tabular grains each having dislocation lines mentioned above can be prepared by the methods disclosed in JP-A-63-220238 and JP-A-2-310862. Preferably, the silver halide emulsion of the present invention has a narrow grain-size distribution. It can be manufactured, preferably by the method described in JP-A-63-151618, comprising the steps of Nucleation-Ostwald ripening and grain growth.

The individual grains cannot have uniform silver iodide content, however, unless the manufacturing conditions are particularly strictly controlled. To render the silver iodide contents of the grains uniform, it is required that the Ostwald-ripened grains have as uniform sizes and shapes as is possible, and also that a silver nitrate aqueous solution and an alkali halide aqueous solution be added by double-jet method at growth step, while maintaining pAg constant at 6.0 to 10.0. To form a uniform coating on each grain, it is desirable that the solutions being added should have as much supersaturated as is possible. For example, the method disclosed in U.S. Pat. No. 4,242,445 should better be employed, in which the solutions are added which are so supersaturated that the growth rate of the grains is 30 to 100% of the critical crystal growth rate.

The dislocation in the tabular grains of the present invention can be controlled by forming a high-iodine phase within each grain. More specifically, substrate grains are first prepared, then, a high-iodine phase is formed on each substrate grain, and finally a phase containing less iodine is formed, covering the high-iodine phase. To make the silver iodide contents of the grains uniform, it is important to form the high-iodine phase mentioned above under appropriate conditions.

The term "inner high-iodine phase" means a silver halide solid solution containing iodine. Preferable as silver halide is silver iodide, silver bromoiodide, or silver bromochloroiodide. Of these, more preferable are silver iodide or silver bromoiodide (iodine content: 10 to 40 mol %). The most preferable is silver iodide.

It is required that the inner high-iodine phase should not be one uniformly deposited on the surface of the substrate grain, rather it should be locally present on a main surface, a side surface, a ridge, or an apex of the substrate grain. Alternatively, the inner high-iodine phase can be selectively epitaxially orientated at such a position.

To orientate the inner high-iodine phase so, so-called conversion method wherein an iodide salt is singly added, or epitaxial junction method of the type disclosed in, for example, JP-A-59-133540, JP-A-58-108526 and JP-A-59-162540 can be employed. In either method, it is effective to select such condition as follows, in order to make the silver iodide content of each grain uniform. That is, the iodide salt should be added to a solution, at a pAg value of 8.5 to 10.5, more preferably 9.0 to 10.5, at 30° C. to 50° C., in an amount of 1 mol % or more to all silver content used, over 30 second to 5 minutes, under sufficient stirring.

The tabular grain of a substrate has an iodine content lower than that of the high-iodine phase, preferably 0 to 12 mol %, more preferably 0 to 10 mol %.

The outer phase covering the high-iodine phase has an iodine content lower than the high-iodine phase, preferably 0 to 12 mol %, more preferably 0 to 10 mol %, still more preferably 0 to 3 mol %.

It is desirable that the inner high-iodine phase exist in an annular region with the center being identical to that of the grain, the annular region having an inner and an outer boundaries defined as follows, along the long-axis direction of the grain. The inner boundary is defined so that the silver content of the grain inside the boundary corresponds to 5 mol %, preferably 10 mol %, more preferably 20 mol % of the total silver content of the grain, while the outer boundary is defined so that the silver content of the grain inside the boundary corresponds to 80 mol %, preferably 70 mol %, more preferably 60 mol % of the total silver content of the grain.

The term "long axis direction of the grain" means the diameter direction of each tabular grain, in contrast to the short-axis direction which extends in the direction of the thickness of the grain.

The iodine content of the inner high-iodine phase is 5 times or more, preferably 20 times or more, higher than the average iodine content of the silver iodide, silver bromoiodide or silver bromochloroiodide containing the surface layer of the grain.

The silver halide content, which is estimated as an amount of silver, of the inner high-iodide phase is 50 mol % or less, preferably 10 mol % or less, more preferably 5 mol % or less of the total silver content of the grain.

The properties of silver halide grains can be controlled by using various compounds during the precipitation of silver halide. Such compounds can be introduced into a reaction vessel before the precipitation of silver halide. They can be added, along with one or more salts, by the ordinary method. Also, the properties of silver halide can be controlled by using a compound such as a compound of copper, iridium, lead, bismuth, cadmium, zinc, gold, and a Group VII noble metal or a calcogen compound (e.g., a sulfur compound, a selenium compound, or a tellurium compound), during the precipitation of silver halide, as is described in U.S. Pat. Nos. 2,448,060, 2,628,167, 3,737,313, 3,772,031, and Research Disclosure Vol. 134, 13452 (June 1975). The inner portions of the grains in a silver halide emulsion can be reduction-sensitized during the precipitation of silver halide, as is described in JP-B-58-1410 and Moisar et al., "Journal of Photographic Science," Vol. 25, pp. 19–27 (1977).

In the tabular grains used in the present invention, silver halides having different compositions may be joined by an epitaxial junction or a compound other than a silver halide such as silver rhodanide or zinc oxide may be joined. Such emulsion grains are disclosed in, for examples, U.S. Pat. Nos. 4,094,684, 4,142,900 and 4,459,353, British Patent 2,038,792, U.S. Pat. Nos. 4,349,622, 4,395,478, 4,433,501, 4,463,087, 3,656,962 and 3,852,067, and JP-A-59-162540.

The tabular silver halide emulsion of the present invention is usually chemically sensitized.

The chemical sensitization is performed after the silver halide emulsion has been formed. The emulsion can be washed after it has been formed and before it is chemically sensitized.

Examples of chemical sensitization are disclosed in Research Disclosure No. 17643 (December 1978), p. 23, and Research Disclosure No. 18716 (November 1979), p. 648, right column. The chemical sensitization can be achieved with sulfur, selenium, tellurium, gold, platinum, palladium, iridium, or a combination of two or more of these sensitizers, at pAg of 5 to 10, pH of 5 to 8, and at 30° to 80° C.

It is desirable that the tabular silver halide emulsion of the invention be chemically sensitized in the presence of a spectral sensitizing dye. Methods of chemically sensitizing emulsions in the presence of a spectral sensitizing dye are disclosed in, for example, U.S. Pat. Nos. 4,425,426 and 4,442,201, JP-A-59-9658, JP-A-61-103149, and JP-A-61-133941. Any spectral sensitizing dye can be used if it is of the type usually employed in silver halide light-sensitive materials. Examples of such a spectral sensitizing dye are disclosed in Research Disclosure No. 17643, pp. 23 and 24, and Research Disclosure No. 18716, p. 648, right column to page 649, right column. Use can be made of either only one spectral sensitizing dye, or a mixture of two or more spectral sensitizing dyes.

The spectral sensitizing dye or dyes can be added before the chemical sensitization (e.g., during the forming of grains, at the end of forming of grains, or after the washing of grains), during the chemical sensitization, or at the end of the chemical sensitization. The dye or dyes should better added after the forming of grains and before or at the end of the chemical sensitization.

The spectral sensitizing dye or dyes can be added in any amount desired, which is 30 to 100% of the saturated adsorption amount, more preferably 50 to 90% thereof.

The tabular silver halide emulsion of this invention is usually spectrally sensitized. Examples of the spectral sensitizing dye used are disclosed in the two Research Disclosures specified above. To spectrally sensitize the emulsion containing a spectral sensitizing dye or dyes at the time of chemical sensitization, dye or dyes are added or not added, which are either same or different from those contained in the emulsion.

According to the invention, only one emulsion or two or more emulsions having different average grain sizes can be used in light-sensitive emulsion layers. In the case where two or more emulsions are used, they can be used in different light-sensitive layers, respectively, or in the same light-sensitive layer in the form of a mixture. An emulsion having an average aspect ratio falling in the range defined by this invention and an emulsion having an average aspect ratio falling outside the range defined by this invention can be used in combination. Alternatively, a monodispersed emulsion suitable for use in this invention and any other emulsion can be used in combination. Furthermore, an emulsion containing hexagonal tabular silver halide grains, which is suitable for use in the invention, and any other emulsion can be used in combination.

Two or more emulsions should better be used in the form of a mixture, for the purpose of controlling gradation, graininess, and color-development dependency. (The graininess must be controlled over the entire range of exposure amount, from the low exposure-amount region to the high exposure-amount region; the color-development dependency includes time-dependency, pH-dependency and the dependency on the composition of a development solution such as a main developing agent and sodium sulfite.)

Particular preferable as the emulsion of this invention are those which are disclosed in JP-A-60-143332 and JP-A60-254032 and which has a relative standard deviation of 20% or less in terms of silver iodide content between grains contained therein.

It suffices to use the emulsion of the invention in at least one of the light-sensitive material according to the present invention. A coating amount of the emulsion, which is estimated as an amount of silver contained therein, is 0.01 to 5.0 g/m$^2$, preferably 0.10 to 3.0 g/m$^2$, more preferably 0.30 to 2.0 g/m$^2$.

In the present invention, it is particularly desirable that a compound of the following formula (A) be used in order to improve the sensitivity, graininess and readiness of desilvering of the light-sensitive material:

$$Q—SM^1 \qquad \text{Formula (A)}$$

In the formula (A), Q is a heterocyclic residue directly or indirectly bonding a group selected from the group consisting of —$SO_3M^2$, —$COOM^2$, —OH and —$NR^1R^2$. $M^1$ and $M^2$ are independently hydrogen, alkali metal, quaternary ammonium, quarternary phosphonium. $R^1$ and $R^2$ are hydrogen or substituted or unsubstituted alkyl groups.

Examples of the heterocyclic residue represented by Q in the formula (A) are: an oxazole ring, a thiazole ring, an imidazole ring, a selenazole ring, a triazole ring, a tetrazole ring, a thiadiazole ring, an oxadiazole ring, a pentazole ring, a pyrimidine ring, a thiadia ring, a triazine ring, a thiadiazine ring, or a ring bonded to another carbon or hetero ring (e.g., a benzothiazole ring, a benzotriazole ring, a benzimidazole ring, a benzoxazole ring, a benzoselenazole ring, a naphthoxazole ring, a triazaindolizine ring, a diazaindolizine ring, or a tetraazaindolizine ring.)

Of the mercapto heterocyclic compounds represented by the formula (A), particularly preferable can be those represented by the following formulas (B) and (C):

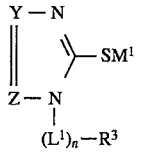

Formula (B)

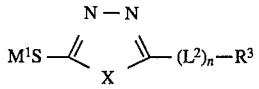

Formula (C)

In the formula (B), Y and Z are independently nitrogen or $CR^4$, where $R^4$ is hydrogen, a substituted or unsubstituted alkyl group, or a substituted or unsubstituted aryl group. $R^3$ is an organic residue substituted by at least one group selected from the group consisting of $—SO_3M^2$, $—COOM^2$, —OH and $—NR^1R^2$. Specific examples of $R^3$ are: an alkyl group having 1 to 20 carbon atoms (e.g., methyl, ethyl, propyl, hexyl, dodecyl, or octadecyl), and an aryl group having 6 to 20 carbon atoms (e.g., phenyl or naphthyl). $L^1$ is a linking group selected from the group which consists of —S—, —O—, —N—, —CO—, —SO— and $—SO^2—$. In formula (B), n is 0 or 1.

The alkyl group and the aryl group, both specified above, can be substituted by other substituent such as a halogen atom (e.g., F, Cl, or Br), an alkoxy group (e.g., methoxy or methoxyethoxy), an aryloxy group (e.g., phenoxy), an alkyl group (if $R^2$ is an aryl group), an aryl group (if $R^2$ is an alkyl group), an amido group (e.g., acetoamido or benzoylamino), a carbamoyl group (e.g., an unsubstituted carbamoyl, phenylcarbamoyl, or methylcarbamoyl), a sulfonamido group (e.g., methanesulfonamido or phenylsulfonamido), a sulfamoyl group (e.g., an unsubstituted sulfamoyl, methylsulfamoyl, or phenylsulfamoyl), a sulfonyl group (e.g., methylsulfonyl or phenylsulfonyl), a sulfinyl group (e.g., methylsulfinyl or phenylsulfinyl), a cyano group, an alkoxycarbonyl group (e.g., methoxycarbonyl), an aryloxycarbonyl group (e.g., phenoxycarbonyl), or a nitro group.

If there are two or more substituents for $R^3$, such as $—SO_3M^2$, $—COOM^2$, —OH or $—NR^1R^2$, they can either same or different.

$M^2$ is of the same meaning as has been explained in conjunction with the formula (A).

In the formula (C), X is sulfur, oxygen, or $—N(R^5)—$, where $R^5$ is hydrogen, a substituted or unsubstituted alkyl group, or a substituted or unsubstituted aryl group.

$L^2$ is $—CONR^6—$, $—NR^6CO—$, $—SO_2NR^6—$, $—NR^6SO_2—$, —OCO—, —COO—, —S—, $NR^6—$, —CO——SO——OCOO—, $—NR^6CONR^7—$, $—NR^6COO—$, $—OCONR^6—$, $OR—NR^6SO_2NR^7—$, where $R^6$ and $R^7$ are each hydrogen, a substituted or unsubstituted alkyl group, or a substituted or unsubstituted aryl group.

$R^3$ and $M^2$ are of the same meaning as has been described in connection with the formulas (A) and (B), and n is 0 or 1.

Examples of the substituents fro the alkyl groups and aryl groups, which are represented by $R^4$, $R^5$, $R^6$, and $R^7$, are those exemplified as the substituent for $R^3$.

In the formula (A), $R^3$ is particularly preferably $—SO_3M^2$ and $—COOM^2$.

Examples (1) to (39) of the preferable compound represented by the formula (A), which is used in the present invention, will be specified below:

(1)

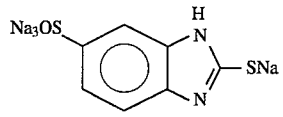

(2)

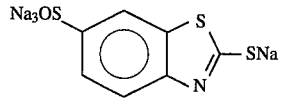

(3)

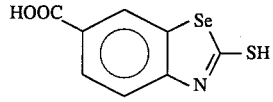

(4)

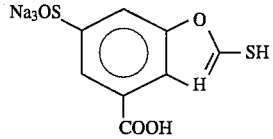

(5)

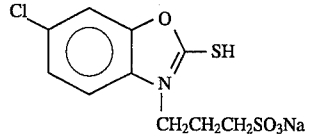

(6)

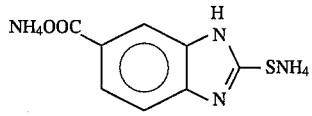

(7)

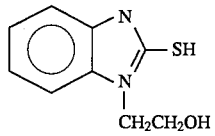

(8)

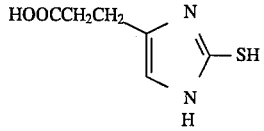

(9)

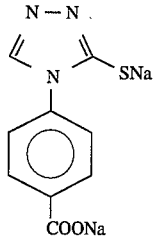

(10)

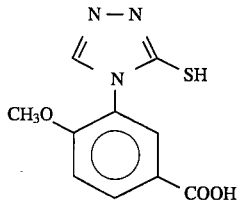

-continued
(11)
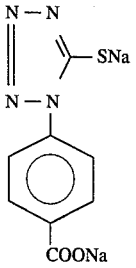
(12)
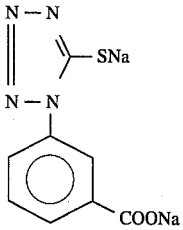
(13)
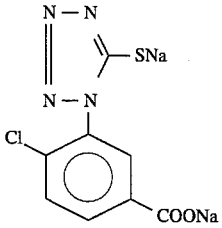
(14)
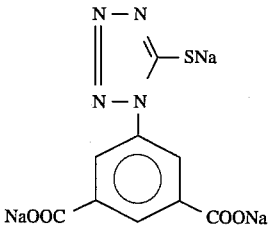
(15)
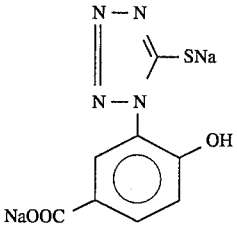
(16)
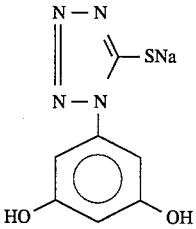
(17)
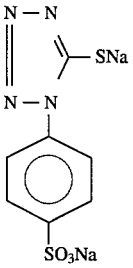
-continued
(18)
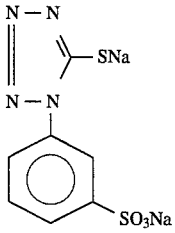
(19)
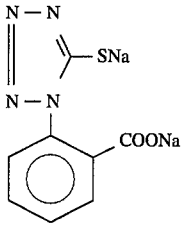
(20)
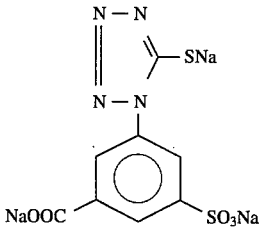
(21)
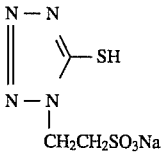
(22)
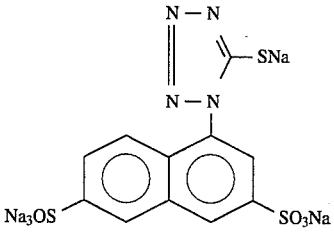
(23)
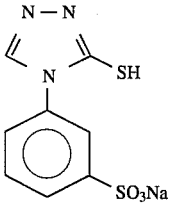
(24)
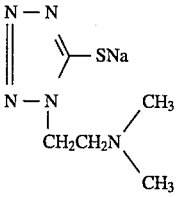
(25)
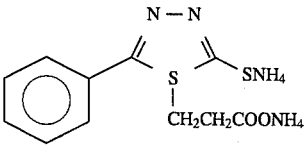

-continued (26)

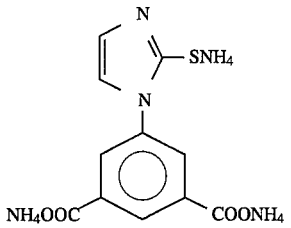

(27)

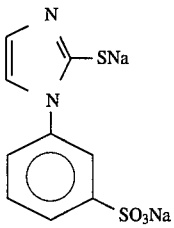

(28)

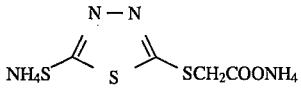

(29)

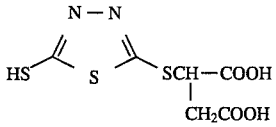

(30)

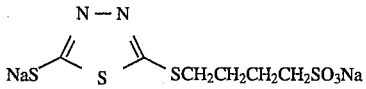

(31)

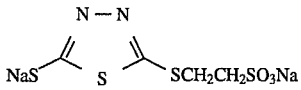

(32)

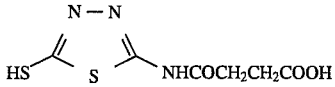

(33)

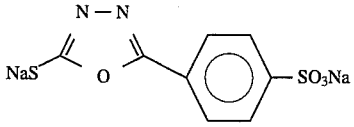

(34)

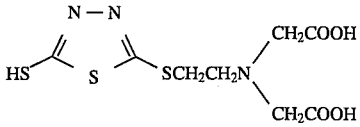

(35)

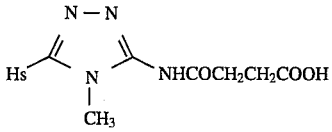

(36)

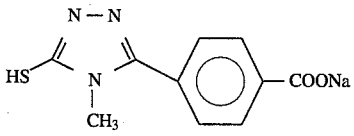

(37)

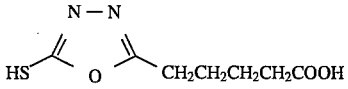

-continued (38)

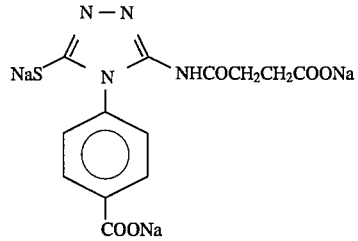

(39)

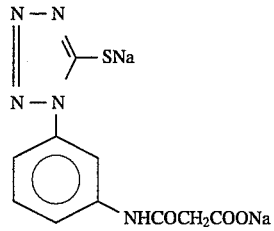

The compound of the formula (A) is known, and can be synthesized by the methods disclosed in U.S. Pat. Nos. 2,585,388 and 2,541,924, JP-B-42-21842, JP-A-53-50169, British Patent 1,275,701, D.A. Berges et al., "Journal of the Heterocyclic Chemistry," Vol. 15, No. 981 (1978), "The Chemistry of Heterocyclic Chemistry Imidazole and Derivatives, Part I", pp. 336–9, "Chemical Abstract," Vol. 58, No. 7921 (1963), p. 394, E. Hoggarth, "Journal of Chemical Society," pp. 1160–7 (1949), S. R. Saudler, W. Karo, "Organic Functional Group Preparation," Academic Press, pp. 312–5 (1968), M. Chamdon, et al., "Bulletin de la Societe Chimique de France," 723 (1954), D. A. Shirley, D. W. Alley, "Journal of American Chemical Society," 79, 4922 (1954), A. Wohl, W. Marchwald, "Berichte" (Journal of German Chemical Society), Vol. 22, pp. 568 (1889), Journal of American Chemical Society, 44, pp. 1502–10, U.S. Pat. No. 3,017,270, British Patent 940,169, JP-B-49-8334, JP-A-55-59463, "Advanced in Heterocyclic Chemistry," 9, 165–209 (1968), West German Patent 27,16,707, "The Chemistry of Heterocyclic Compounds Imidazole and Derivatives," Vol. 1, p. 384, "Organic Synthesis," IV., 569 (1963), "Berichte," 9, 465 (1976), "Journal of American Chemical Society," 45, 2390 (1923), JP-A-50-89034, JP-A-53-28426, JP-A-55-21007, and JP-A-40-28496.

Preferably, the compound of the formula (A) is contained in an silver halide emulsion layer and a hydrophilic colloid layer (e.g., an inter-layer, a surface protective layer, an yellow filter layer, an anti-halation layer). More preferably, the compound is contained in a silver halide emulsion layer or a layer formed adjacent thereto.

The compound is used in an amount of $1\times10^{-7}$ to $1\times10^{-3}$ mol/m$^2$, preferably $5\times10^{-7}$ to $1\times10^{-4}$ mol/m$^2$, more preferably $1\times10^{-6}$ to $3\times10^{-5}$ mol/m$^2$.

The light-sensitive material of the present invention needs only to have at least one of silver halide emulsion layers, i.e., a blue-sensitive layer, a green-sensitive layer, and a red-sensitive layer, formed on a support. The number or order of the silver halide emulsion layers and the non-light-sensitive layers are particularly not limited. A typical example is a silver halide photographic light-sensitive material having, on a support, at least one light-sensitive layers comprising a plurality of silver halide emulsion layers which are sensitive to essentially the same color sensitivity but has different sensitivities. The light-sensitive layers are unit light-sensitive layer sensitive to blue, green or red. In a multilayered silver halide color photographic light-sensitive material, the unit light-sensitive layers are generally arranged such that red-, green-, and blue-sensitive layers are formed from a support side in the order named. However, this order may be reversed or a layer sensitive to one color may be sandwiched between layers sensitive to another color in accordance with the application.

Non-light-sensitive layers such as various types of inter-layers may be formed between the silver halide light-sensitive layers and as the uppermost layer and the lowermost layer.

The inter-layer may contain, e.g., couplers and DIR compounds as described in JP-A-61-43748, JP-A-59-113438, JP-A-59-113440, JP-A-61-20037, and JP-A-61-20038 or a color mixing inhibitor which is normally used.

As a plurality of silver halide emulsion layers constituting each unit light-sensitive layer, a two-layered structure of high- and low-speed emulsion layers can be preferably used as described in West German Patent 1,121,470 or British Patent 923,045. In this case, layers are preferably arranged such that the sensitivity is sequentially decreased toward a support, and a non-light-sensitive layer may be formed between the silver halide emulsion layers. In addition, as described in JP-A-57-112751, JP-A-62-200350, JP-A-62-206541, and JP-A-62-206543, layers may be arranged such that a low-speed emulsion layer is formed remotely from a support and a high-speed layer is formed close to the support.

More specifically, layers may be arranged from the farthest side from a support in an order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), an order of BH/BL/GL/GH/RH/RL, or an order of BH/BL/GH/GL/RL/RH.

In addition, as described in JP-B-55-34932, layers may be arranged from the farthest side from a support in an order of blue-sensitive layer/GH/RH/GL/RL. Furthermore, as described in JP-A-56-25738 and JP-A-62-63936, layers may be arranged from the farthest side from a support in an order of blue-sensitive layer/GL/RL/GH/RH.

As described in JP-B-49-15495, three layers may be arranged such that a silver halide emulsion layer having the highest sensitivity is arranged as an upper layer, a silver halide emulsion layer having sensitivity lower than that of the upper layer is arranged as an inter-layer, and a silver halide emulsion layer having sensitivity lower than that of the inter-layer is arranged as a lower layer, i.e., three layers having different sensitivities may be arranged such that the sensitivity is sequentially decreased toward the support. When a layer structure is constituted by three layers having different sensitivities, these layers may be arranged in an order of medium-speed emulsion layer/high-speed emulsion layer/low-speed emulsion layer from the farthest side from a support in a layer sensitive to one color as described in JP-A-59-202464.

Also, an order of, for example, high-speed emulsion layer/low-speed emulsion layer/medium-speed emulsion layer or low-speed emulsion layer/medium-speed emulsion layer/high-speed emulsion layer may be adopted. Furthermore, the arrangement can be changed as described above even when four or more layers are formed.

To improve the color reproduction, a donor layer (CL) of interimage effects can be arranged near to, or arranged adjacent to, a main light-sensitive layer BL, GL or RL. The donor layer should have a spectral sensitivity distribution which is different from that of the main light-sensitive layer. Donor layers of this type are disclosed in U.S. Pat. No. 4,663,271, U.S. Pat. No. 4,705,744, U.S. Pat. No. 4,707,436, JP-A-62-160448, and JP-A-63-89850.

As described above, various layer configuration and arrangements can be selected in accordance with the application of the light-sensitive material.

Halide emulsions other than the silver halide emulsion of this invention will be described.

A preferable silver halide contained in photographic emulsion layers of the photographic light-sensitive material of the present invention is silver bromoiodide, silver chloroiodide, or silver bromochloro iodide containing about 30 mol % or less of silver iodide. The most preferable silver halide is silver bromolodide or silver bromochloroiodide containing about 2 mol % to about 10 mol % of silver iodide.

Silver halide grains contained in the photographic emulsion may have regular crystals such as cubic, octahedral, or tetradecahedral crystals, irregular crystals such as spherical or tabular crystals, crystals having defects such as crystal twinning faces, or composite shapes thereof.

The silver halide may comprise fine grains having a grain size of about 0.2 μm or less or large grains having a diameter of a projected surface area of up to about 10 μm, and the emulsion may be either a polydispersed or monodispersed emulsion.

The silver halide photographic emulsion which can be used in the present invention can be prepared by methods described in, for example, Research Disclosure (RD) No. 17,643 (December, 1978), pp. 22 to 23, "I. Emulsion preparation and types", RD No. 18,716 (November, 1979), page 648, and RD No. 307,105 (November, 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodispersed emulsions described in, for example, U.S. Pat. Nos. 3,574,628 and 3,655,364 and British Patent 1,413,748 are also preferred.

Also, tabular grains having an aspect ratio of about 3 or more can be used in the present invention. The tabular grains can be easily prepared by methods described in, e.g., Gutoff, "Photographic Science and Engineering", Vol. 14, PP. 248 to 257 (1970); U.S. Pat. Nos. 4,434,226, 4,414,310, 4,433,048, and 4,439,520, and British Patent 2,112,157.

The crystal structure may be uniform, may have different halogen compositions in the interior and the surface thereof, or may be a layered structure. Alternatively, a silver halide having a different composition may be joined by an epitaxial junction or a compound except for a silver halide such as silver rhodanide or zinc oxide may be joined. A mixture of grains having various types of crystal shapes may be used.

The above emulsion may be of any of a surface latent image type in which a latent image is mainly formed on the surface of each grain, an internal latent image type in which a latent image is formed in the interior of each grain, and a type in which a latent image is formed on the surface and in the interior of each grain. However, the emulsion must be of a negative type. When the emulsion is of an internal latent image type, it may be a core/shell internal latent image type emulsion described in JP-A-63-264740. A method of preparing this core/shell internal latent image type emulsion is described in JP-A-59-133542. Although the thickness of a shell of this emulsion changes in accordance with development or the like, it is preferably 3 to 40 nm, and most preferably, 5 to 20 nm.

A silver halide emulsion layer is normally subjected to physical ripening, chemical ripening, and spectral sensitization steps before it is used. Additives for use in these steps are described in Research Disclosure Nos. 17,643, 18,716, and 307,105 and they are summarized in the following table A.

In the light-sensitive material of the present invention, two or more types of emulsions different in at least one characteristic of a grain size, a grain size distribution, a halogen composition, a grain shape, and sensitivity can be mixed in one layer.

A surface-fogged silver halide grain described in U.S. Pat. No. 4,082,553, an internally fogged silver halide grain described in U.S. Pat. No. 4,626,498 or JP-A-59-214852, and colloidal silver can be preferably used in a light-sensitive silver halide emulsion layer and/or a substantially non-light-sensitive hydrophilic colloid layer. The internally fogged or surface-fogged silver halide grains are silver halide grains which can be uniformly (non-imagewise) developed in either a non-exposed portion or an exposed portion of the light-sensitive material. A method of preparing the internally fogged or surface-fogged silver halide grain is described in U.S. Pat. No. 4,626,498 or JP-A-59-214852.

A silver halide which forms the core of an internally fogged core/shell type silver halide grain may have the same halogen composition as or a different halogen composition from that of the other portion. Examples of the internally-fogged or surface-fogged silver halide are silver chloride, silver chlorobromide, silver bromoiodide, and silver bromochloroiodide. Although the grain size of these fogged silver halide grains is not particularly limited, an average grain size is 0.01 to 0.75 μm, and most preferably, 0.05 to 0.6 μm. The grain shape is also not particularly limited but may be a regular grain shape. Although the emulsion may be a poly-dispersed emulsion, it is preferably a mono-dispersed emulsion (in which at least 95% in weight or number of silver halide grains have a grain size falling within the range of 40% of an average grain size).

In the present invention, a non-light-sensitive fine grain silver halide is preferably used. The non-light-sensitive fine grain silver halide means silver halide fine grains not sensitive upon imagewise exposure for obtaining a dye image and essentially not developed in development. The non-light-sensitive fine grain silver halide is preferably not fogged beforehand.

The fine grain silver halide contains 0 to 100 mol % of silver bromide and may contain silver chloride and/or silver iodide as needed. Preferably, the fine grain silver halide contains 0.5 to 10 mol % of silver iodide.

An average grain size (an average value of equivalent-circle diameters of projected surface areas) of the fine grain silver halide is preferably 0.01 to 0.5 μm, and more preferably, 0.02 to 0.2 μm.

The fine grain silver halide can be prepared by a method similar to a method of preparing normal light-sensitive material silver halide. In this preparation, the surface of a silver halide grain need not be subjected to either optical sensitization or spectral sensitization. However, before the silver halide grains are added to a coating solution, a known stabilizer such as a triazole compound, an azaindene compound, a benzothiazolium compound, a mercapto compound, or a zinc compound is preferably added. This fine grain silver halide grain containing layer preferably contains a colloidal silver.

A coating silver amount of the light-sensitive material of the present invention is preferably 6.0 g/m$^2$ or less, and most preferably, 4.5 g/m$^2$ or less.

Known photographic additives usable in the present invention are also described in the above three RDs, and they are summarized in the following Table A:

TABLE A

| Additives | RD17643 | RD18716 | RD307105 |
|---|---|---|---|
| 1. Chemical sensitizers | page 23 | page 648, right column | page 866 |
| 2. Sensitivity increasing agents | | page 648, right column | |
| 3. Spectral sensitizers, super sensitizers | pp. 23–24 | page 648, right column to page 649, right column | pp. 866–868 |
| 4. Brighteners | page 24 | page 647, right column | page 868 |
| 5. Antifoggants and stabilizers | pp. 24–25 | page 649. right column | pp. 868–870 |
| 6. Light absorbent. filter dye. ultraviolet absorbents | pp. 25–26 | page 649, right column to page 650. left column | page 873 |
| 7. Stain preventing agents | page 25, right column | page 650. left to right columns | page 872 |
| 8. Dye image stabilizer | page 25 | page 650, left column | page 872 |
| 9. Hardening agents | page 26 | page 651. left column | pp. 874–875 |
| 10. Binder | page 26 | page 651. left column | pp. 873–874 |
| 11. Plasticizers. lubricants | page 27 | page 650, right column | page 876 |
| 12. Coating aids. surface active agents | pp. 26–27 | page 650, right column | pp. 875–876 |
| 13. Antistatic agents | page 27 | page 650, right column | pp. 876–877 |
| 14. Matting agent | | page 650, right column | pp. 878–879 |

In order to prevent degradation in photographic properties caused by formaldehyde gas, a compound described in U.S. Pat. No. 4,411,987 or U.S. Pat. No. 4,435,503, which can react with formaldehyde and fix the same, is preferably added to the light-sensitive material.

The light-sensitive material of the present invention preferably contains mercapto compounds described in U.S. Pat. Nos. 4,740,454 and 4,788,132, JP-A-62-18539, and JP-A-1-283551.

The light-sensitive material of the present invention preferably contains compounds for releasing a fogging agent, a development accelerator, a silver halide solvent, or precursors thereof described in JP-A-1-106052 regardless of a developed silver amount produced by the development.

The light-sensitive material of the present invention preferably contains dyes dispersed by methods described in WO 88/04794 and JP-A-1-502912 or dyes described in European Patent 317,308A, U.S. Pat. No. 4,420,555, and JP-A-1-259358.

Various color couplers can be used in the present invention, and specific examples of these couplers are described in patents described in above-mentioned Research Disclosure (RD), No. 17643, VII-C to VII-G and RD No. 307105, VII-C to VII-G.

Preferable examples of a yellow coupler are described in, e.g., U.S. Pat. Nos. 3,933,501, 4,022,620, 4,326,024, 4,401,752, and 4,248,961, JP-B-58-10739, British Patents 1,425,020 and 1,476,760, U.S. Pat. Nos. 3,973,968, 4,314,023, and 4,511,649, and EP 249,473A.

Examples of a magenta coupler are preferably 5-pyrazolone and pyrazoloazole compounds, and more preferably, the compounds described in, e.g., U.S. Pat. Nos. 4,310,619 and 4,351,897, European Patent 73,636, U.S. Pat. Nos. 3,061,432 and 3,725,067, Research Disclosure No. 24220 (June 1984), JP-A-60-33552, Research Disclosure No. 24230 (June 1984), JP-A-60-43659, JP-A-61-72238, JP-A-60-35730, JP-A-55-118034, and JP-A-60-185951, U.S. Pat. Nos. 4,500,630, 4,540,654, and 4,556,630, and WO 88/04795.

Examples of a cyan coupler are phenol and naphthol couplers. Of these, preferable are those described in, e.g., U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German Laid-open Patent Application 3,329,729, European Patents 121, 365A and 249,453A, U.S. Pat. Nos. 3,446,622, 4,333,999, 4,775,616, 4,451,559, 4,427,767, 4,690,889, 4,254,212, and 4,296,199, and JP-A-61-42658. Also, the pyrazoloazole-series couplers disclosed in JP-A-64-553, JP-A-64-554, JP-A-64-555 and JP-A-64-556, and imidazole-series couplers disclosed in U.S. Pat. No. 4,818,672 can be used as cyan coupler in the present invention.

Typical examples of a polymerized dye-forming coupler are described in U.S. Pat. Nos. 3,451,820, 4,080,221, 4,367,282, 4,409,320, and 4,576,910, British Patent 2,102,137, and EP 341,188A.

Preferable examples of a coupler capable of forming colored dyes having proper diffusibility are those described in U.S. Pat. No. 4,366,237, British Patent 2,125,570, EP 96,570, and West German Laid-open Patent Application No. 3,234,533.

Preferable examples of a colored coupler for correcting additional, undesirable absorption of a colored dye are those described in Research Disclosure No. 17643, VII-G, No. 307105 VII-G, U.S. Pat. No. 4,163,670, JP-B-57-39413, U.S. Pat. Nos. 4,004,929 and 4,138,258, and British Patent 1,146,368. A coupler for correcting unnecessary absorption of a colored dye by a fluorescent dye released upon coupling described in U.S. Pat. No. 4,774,181 or a coupler having a dye precursor group which can react with a developing agent to form a dye as a split-off group described in U.S. Pat. No. 4,777,120 may be preferably used.

Compounds releasing a photographically useful residue upon coupling are preferably used in the present invention. DIR couplers, i.e., couplers releasing a development inhibitor are described in the patents cited in the above-described RD No. 17643, VII-F, RD No. 307105, VII-F, JP-A-57-151944, JP-A-57-154234, JP-A-60-184248, JP-A-63-37346, JP-A-63-37350, and U.S. Pat. Nos. 4,248,962 and 4,782,012 in addition to the compounds represented by the formula (I) and (II) of the present invention.

Research Disclosures Nos. 11449 and 24241, and JP-A-61-201247, for example, disclose couplers which release breaching accelerator. These couplers effectively serve to shorten the time of any process that involves breaching. They are effective, particularly when added to light-sensitive material containing tabular silver halide grains. Preferable examples of a coupler for imagewise releasing a nucleating agent or a development accelerator are described in British Patents 2,097,140 and 2,131,188, JP-A-59-157638, and JP-A-59-170840. In addition, compounds for releasing a fogging agent, a development accelerator, or a silver halide solvent upon redox reaction with an oxidized form of a developing agent, described in JP-A-60-107029, JP-A-60-252340, JP-A-1-44940, and JP-A-1-45687, can also be preferably used.

Examples of a coupler which can be used in the light-sensitive material of the present invention are competing couplers described in, e.g., U.S. Pat. No. 4,130,427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, e.g., JP-A-60-185950 and JP-A-62-24252; couplers releasing a dye which turns to a colored form after being released described in EP 173,302A and 313,308A; a ligand releasing coupler described in, e.g., U.S. Pat. No. 4,555,477; a coupler releasing a leuco dye described in JP-A-63-75747; and a coupler releasing a fluorescent dye described in U.S. Pat. No. 4,774,181.

The couplers for use in this invention can be added to the light-sensitive material by various known dispersion methods.

Examples of a high-boiling solvent to be used in the oil-in-water dispersion method are described in e.g. U.S. Pat. No. 2,322,027. Examples of a high-boiling organic solvent to be used in the oil-in-water dispersion method and having a boiling point of 175° C. or more at atmospheric pressure are phthalate esters (e.g., dibutylphthalate, dicyclohexylphthalate, di-2-ethylhexylphthalate, decylphthalate, bis(2,4-di-t-amylphenyl) phthalate, bis(2,4-di-t-amylphenyl) isophthalate, bis(1,1-di-ethylpropyl) phthalate); phosphate or phosphonate esters (e.g., triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethylhexylphenylphosphonate); benzoate esters (e.g., 2-ethylhexylbenzoate, dodecylbenzoate, and 2-ethylhexyl-p-hydroxybenzoate); amides (e.g., N,N-diethyldodecaneamide, N,N-diethyllaurylamide, and N-tetradecylpyrrolidone); alcohols or phenols (e.g., isostearylalcohol and 2,4-di-tertamylphenol), aliphatic carboxylate esters (e.g., bis(2-ethylhexyl) sebacate, dioctylazelate, glyceroltriburylate, isostearyllactate, and trioctylcitrate); aniline derivative (e.g., N,N-dibutyl-2-butoxy-5-tertoctylaniline); and hydrocarbons (e.g., paraffin, dodecylbenzene, and diisopropylnaph thalene). An organic solvent having a boiling point of about 30° C. or more, and preferably, 50° C. to about 160° C. can be used as an auxiliary solvent. Typical examples of the auxiliary solvent are ethyl acetate, butyl acetate, ethyl propionate, methylethylketone, cyclohexanone, 2-ethoxyethylacetate, and dimethylformamide.

Steps and effects of a latex dispersion method and examples of a loadable latex are described in, e.g., U.S. Pat. No. 4,199,363 and German Laid-open Patent Application Nos. 2,541,274 and 2,541,230.

Various types of antiseptics and fungicides are preferably added to the color light-sensitive material of the present invention. Examples of the antiseptics and the fungicides are phenetyl alcohol, and 1,2-benzisothiazoline-3-one, n-butyl-p-hydroxybenzoate, phenol, 4-chloro-3,5-dimethylphenol, 2-phenoxyethanol, and 2-(4-thiazolyl) benzimidazole described in JP-A-63-257747, JP-A-62-272248, and JP-A-1-80941.

The present invention can be applied to various color light-sensitive materials. Examples of the material are a color negative film for a general purpose or a movie, a color reversal film for a slide or a television, color paper, a color positive film, and color reversal paper.

A support which can be suitably used in the present invention is described in, e.g., RD. No. 17643, page 28, RD. No. 18716, from the right column, page 647 to the left column, page 648, and RD. No. 307105, page 879.

In the light-sensitive material of the present invention, the sum total of film thicknesses of all hydrophilic colloidal layers at the side having emulsion layers is preferably 28 μm or less, more preferably, 23 μm or less, much more preferably, 18 μm or less, and most preferably, 16 μm or less. A film swell speed T½ is preferably 30 sec. or less, and more preferably, 20 sec. or less. The film thickness means a film thickness measured under moisture conditioning at a temperature of 25° C. and a relative humidity of 55% (two days). The film swell speed T½ can be measured in accordance with a known method in the art. For example, the film swell speed T½ can be measured by using a swell meter described in Photographic Science & Engineering, A. Green et al., Vol. 19, No. 2, pp. 124 to 129. When 90% of a maximum swell film thickness reached by performing a treatment by using a color developing agent at 30° C. for 3 min. and 15 sec. is defined as a saturated film thickness, T½ is defined as a time required for reaching ½ of the saturated film thickness.

The film swell speed T½ can be adjusted by adding a film hardening agent to gelatin as a binder or changing aging conditions after coating. A swell ratio is preferably 150% to 400%. The swell ratio is calculated from the maximum swell film thickness measured under the above conditions in accordance with a relation: (maximum swell film thickness—film thickness)/film thickness.

In the light-sensitive material of the present invention, hydrophilic colloid layers (called back layers) having a total dried film thickness of 2 to 20 μm are preferably formed on the side opposite to the side having emulsion layers. The back layers preferably contain, e.g., the light absorbent, the filter dye, the ultraviolet absorbent, the antistatic agent, the film hardener, the binder, the plasticizer, the lubricant, the coating aid, and the surfactant described above. The swell ratio of the back layers is preferably 150% to 500%.

The color photographic light-sensitive material according to the present invention can be developed by conventional methods described in RD. No. 17643, pp. 28 and 29, RD. No. 18716, the left to right columns, page 651, and RD. No. 307105, pp. 880 and 881.

A color developer used in development of the light-sensitive material of the present invention is an aqueous alkaline solution containing as a main component, preferably, an aromatic primary amine-based color developing agent. As the color developing agent, although an aminophenol-based compound is effective, a p-phenylenediamine-based compound is preferably used. Typical examples of the p-phenylenediamine-based compound are: 3-methyl-4-amino-N,N-diethylaniline, 3-methyl-4-amino-N-ethyl-N-β-hydroxyethylaniltne, 3-methyl-4-amino-N-ethyl-N-β-methoxyethylaniline, 3-methyl-4-amino-N-ethyl-N-β-methoxyethyl aniline, and sulfates, hydrochlorides and p-toluene sulfonates thereof. Of these compounds, 3-methyl-4-amino-N-ethyl-N-β-hydroxyethyl aniline, is preferred in particular. These compounds can be used in a combination of two or more thereof in accordance with the application.

In general, the color developer contains a pH buffering agent such as a carbonate, a borate, or a phosphate of an alkali metal, and a development restrainer or an antifoggant such as a chloride, a bromide, an iodide, a benzimidazole, a benzothiazole, or a mercapto compound. If necessary, the color developer may also contain a preservative such as hydroxylamine, diethylhydroxylamine, a sulfite, a hydrazine such as N,N-biscarboxymethyl hydrazine, a phenylsemicarbazide, triethanolamine, or a catechol sulfonic acid; an organic solvent such as ethyleneglycol or diethyleneglycol; a development accelerator such as benzyl alcohol, polyethyleneglycol, a quaternary ammonium salt or an amine; a dye-forming coupler; a competing coupler; an auxiliary developing agent such as 1-phenyl-3-pyrazolidone; a viscosity-imparting agent; and a chelating agent such as aminopolycarboxylic acid, an aminopolyphosphonic acid, an alkylphosphonic acid, or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, and ethylenediamine-di(O-hydroxyphenylacetic acid), and salts thereof.

In order to perform reversal development, black-and-white development is performed and then color development is performed. As a black-and-white developer, well-known black-and-white developing agents, e.g., a dihydroxybenzene such as hydroquinone, a 3-pyrazolidone such as 1-phenyl-3-pyrazolidone, and an aminophenol such as N-methyl-p-aminophenol can be used singly or in a combination of two or more thereof. The pH of the color and black-and-white developers is generally 9 to 12. Although the quantity of replenisher of the developer depends on a color photographic light-sensitive material to be processed, it is generally 3 liters or less per $m^2$ of the light-sensitive material. The quantity of replenisher can be decreased to be 500 ml or less by decreasing a bromide ion concentration in a replenisher. In order to decrease the quantity of the replenisher, a contact area of a processing tank with air is preferably decreased to prevent evaporation and oxidation of the solution upon contact with air.

The contact area of the solution with air in a processing tank can be represented by an aperture efficiency defined below:

Aperture efficiency=[The value of contact area of processing solution with air represented by $cm^2$ unit]/[The value of volume of the solution represented by $cm^3$ unit]

The above aperture efficiency is preferably 0.1 or less, and more preferably, 0.001 to 0.05. In order to reduce the aperture efficiency, a shielding member such as a floating cover may be provided on the surface of the photographic processing solution in the processing tank. In addition, a method of using a movable cover described in JP-A-1-82033 or a slit developing method described in JP-A-63-216050 may be used. The aperture efficiency is preferably reduced not only in color and black-and-white development steps but also in all subsequent steps, e.g., bleaching, bleach-fixing, fixing, washing, and stabilizing steps. In addition, the quantity of replenisher can be reduced by using a means of suppressing storage of bromide ions in the developing solution.

A color development time is normally 2 to 5 minutes. The processing time, however, can be shortened by setting a high temperature and a high pH and using the color developing agent at a high concentration.

The photographic emulsion layer is generally subjected to bleaching after color development. The bleaching may be performed either simultaneously with fixing (bleach-fixing) or independently thereof. In addition, in order to increase a processing speed, bleach-fixing may be performed after bleaching. Also, processing may be performed in a bleach-fixing bath having two continuous tanks, fixing may be performed before bleach-fixing, or bleaching may be performed after bleach-fixing, in accordance with the application. Examples of the bleaching agent are a compound of a multivalent metal, e.g., iron(III), peroxides; quinones; and a nitro compound. Typical examples of the bleaching agent are an organic complex salt of iron(III), e.g., a complex salt of iron(III) and an aminopolycarboxylic acid such as ethylenediaminetetraacetic acid, diethylenetriaminepentaacetic acid, cyclohexanediaminetetraacetic acid, methyliminodiacetic acid, and 1,3-diaminopropanetetraacetic acid, and glycoletherdiaminetetraacetic acid; or a complex salt of iron(III) and citric acid, tartaric acid, or malic acid. Of these compounds, an iron(III) complex salt of aminopolycarboxylic acid such as an iron(III) complex salt of ethylenediaminetetraacetic acid or 1,3-diaminopropanetetraacetic acid is preferred because it can increase a processing speed and prevent an environmental contamination. The iron(III) complex salt of aminopolycarboxylic acid is useful in both the bleaching and bleach-fixing solutions. The pH of the bleaching or bleach-fixing solution using the iron(III) complex salt of aminopolycarboxylic acid is normally 4.0 to 8. In order to increase the processing speed, however, processing can be performed at a lower pH.

A bleaching accelerator can be used in the bleaching solution, the bleach-fixing solution, and their pre-bath, if necessary. Useful examples of the bleaching accelerator are: compounds having a mercapto group or a disulfide group described in, e.g., U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, and JP-A-53-141623, and JP-A-53-28426, and Research Disclosure No. 17,129 (July, 1978); a thiazolidine derivative described in JP-A-50-140129; thiourea derivatives described in JP-B-45-8506, JP-A-52-20832, JP-A-53-32735, and U.S. Patent 3,706,561; iodide salts described in West German Patent 1,127,715 and JP-A-58-16235; polyoxyethylene compounds described in West German Patents 966,410 and 2,748,430; a polyamine compound described in JP-B-45-8836; compounds described in JP-A-49-40943, JP-A-49-59644, JP-A-53-94927, JP-A-54-35727, JP-A-55-26506, and JP-A-58-163940; and a bromide ion. Of these compounds, a compound having a mercapto group or a disulfide group is preferable since the compound has a large accelerating effect. In particular, compounds described in U.S. Pat. No. 3,893,858, West German Patent 1,290,812, and JP-A-53-95630 are preferred. A compound described in U.S. Pat. No. 4,552,834 is also preferable. These bleaching accelerators may be added in the light-sensitive material. These bleaching accelerators are useful especially in bleach-fixing of a photographic color light-sensitive material.

The bleaching solution or the bleach-fixing solution preferably contains, in addition to the above compounds, an organic acid in order to prevent a bleaching stain. The most preferable organic acid is a compound having an acid dissociation constant (pKa) of 2 to 5, e.g., acetic acid, propionic acid, or hydroxy acetic acid.

Examples of the fixing agent to be used in the fixing solution or the bleach-fixing solution are thiosulfate, a thiocyanate, a thioether-based compound, a thiourea and a large amount of an iodide. Of these compounds, a thiosulfate, especially, ammonium thiosulfate can be used in the widest range of applications. In addition, a combination of thiosulfate and a thiocyanate, a thioether-based compound, or thiourea is preferably used. As a preservative of the fixing solution or the bleach-fixing solution, a sulfite, a bisulfite, a carbonyl bisulfite adduct, or a sulfinic acid compound described in EP 294,769A is preferred. In addition, in order to stabilize the fixing solution or the bleach-fixing solution, various types of aminopolycarboxylic acids or organic phosphonic acids are preferably added to the solution.

In the present invention, 0.1 to 10 mol/l of a compound having a pKa of 6.0 to 9.0 are preferably added to the fixing solution or the bleach-fixing solution in order to adjust the pH. Preferable examples of the compound are imidazoles such as imidazole, 1-methylimidazole, 1-ethylimidazole, and 2-methylimidazole.

The total time of a desilvering step is preferably as short as possible as long as no desilvering defect occurs. A preferable time is one to three minutes, and more preferably, one to two minutes. A processing temperature is 25° C. to 50° C., and preferably, 35° C. to 45° C. Within the preferable temperature range, a desilvering speed is increased, and generation of a stain after the processing can be effectively prevented.

In the desilvering step, stirring is preferably as strong as possible. Examples of a method of intensifying the stirring are a method of colliding a jet stream of the processing solution against the emulsion surface of the light-sensitive material described in JP-A-62-183460, a method of increasing the stirring effect using rotating means described in JP-A-62-183461, a method of moving the light-sensitive material while the emulsion surface is brought into contact with a wiper blade provided in the solution to cause disturbance on the emulsion surface, thereby improving the stirring effect, and a method of increasing the circulating flow amount in the overall processing solution. Such a stirring improving means is effective in any of the bleaching solution, the bleach-fixing solution, and the fixing solution. It is assumed that the improvement in stirring increases the speed of supply of the bleaching agent and the fixing agent into the emulsion film to lead to an increase in desilvering speed. The above stirring improving means is more effective when the bleaching accelerator is used, i.e., significantly increases the accelerating speed or eliminates fixing interference caused by the bleaching accelerator.

An automatic developing machine for processing the light-sensitive material of the present invention preferably has a light-sensitive material conveyer means described in JP-A-60-191257, JP-A-60-191258, or JP-A-60-191259.

As described in JP-A-60-191257, this conveyer means can significantly reduce carry-over of a processing solution from a pre-bath to a post-bath, thereby effectively preventing degradation in performance of the processing solution. This effect significantly shortens especially a processing time in each processing step and reduces the quantity of replenisher of a processing solution.

The photographic light-sensitive material of the present invention is normally subjected to washing and/or stabilizing steps after desilvering. An amount of water used in the washing step can be arbitrarily determined over a broad range in accordance with the properties (e.g., a property determined by the materials used, such as a coupler) of the light-sensitive material, the application of the material, the temperature of the water, the number of water tanks (the number of stages), a replenishing scheme representing a counter or forward current, and other conditions. The relationship between the amount of water and the number of water tanks in a multi-stage counter-current scheme can be obtained by a method described in "Journal of the Society of Motion Picture and Television Engineers", Vol. 64, pp. 248–253 (May, 1955). In the multi-stage counter-current scheme disclosed in this reference, the amount of water used for washing can be greatly decreased. Since washing water stays in the tanks for a long period of time, however, bacteria multiply and floating substances may be adversely attached to the light-sensitive material. In order to solve this problem in the process of the color photographic light-sensitive material of the present invention, a method of decreasing calcium and magnesium ions can be effectively utilized, as described in JP-A-62-288838. In addition, a germicide such as an isothiazolone compound and thiabendazol described in JP-A-57-8542, a chlorine-based germicide such as chlorinated sodium isocyanurate, and germicides such as benzotriazole described in Hiroshi Horiguchi et al., "Chemistry of Antibacterial and Antifungal Agents", (1986), Sankyo Shuppan, EiseigiJutsu-Kai ed., "Sterilization, Antibacterial, and Antifungal Techniques for Microorganisms", (1982), KogyogiJutsu-Kai, and Nippon Bokin Bokabi Gakkai ed., "Dictionary of Antibacterial and Antifungal Agents", (1986), can be used.

The pH of the water for washing the photographic light-sensitive material of the present invention is 4 to 9, and preferably, 5 to 8. The water temperature and the washing time can vary in accordance with the properties and applications of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing agent in place of washing. All known methods described in JP-A-57-8543, JP-A-58-14834, and JP-A-60-220345 can be used in such stabilizing processing.

In some cases, stabilizing is performed subsequently to washing. An example is a stabilizing bath containing a dye stabilizing agent and a surface-active agent to be used as a final bath of the photographic color light-sensitive material. Examples of the dye stabilizing agent are formalin, an aldehyde such as glutaraldehyde, an N-methylol compound, hexamethylenetetramine, and an adduct of aldehyde sulfite. Various cheleting agents and fungicides can be added to the stabilizing bath.

An overflow solution produced upon washing and/or replenishment of the stabilizing solution can be resued in another step such as a desilvering step.

In the processing using an automatic developing machine or the like, if each processing solution described above is condensed by evaporation, water is preferably added to correct condensation.

The silver halide color light-sensitive material of the present invention may contain a color developing agent in order to simplify processing and increases a processing speed. For this purpose, various types of precursors of a color developing agent can be preferably used. Examples of the precursor are an indoaniline-based compound described in U.S. Pat. No. 3,342,597, Schiff base compounds described in U.S. Pat. No. 3,342,599 and Research Disclosure (RD) Nos. 14,850 and 15,159, an aldol compound described in RD No. 13,924, a metal salt complex described in U.S. Pat. No. 3,719,492, and an urethane-based compound described in JP-A-53-135628.

The silver halide color light-sensitive material of the present invention may contain various 1-phenyl-3-pyrazolidones in order to accelerate color development, if necessary. Typical examples of the compound are described in, for example, JP-A-56-64339, JP-A-57-144547, and JP-A-58-115438.

Each processing solution in the present invention is used at a temperature of 10° C. to 50° C. Although a normal processing temperature is 33° C. to 38° C., processing may be accelerated at a higher temperature to shorten a processing time, or image quality or stability of a processing solution may be improved at a lower temperature.

The present invention will be described in more detail below by way of its examples, but the present invention is not limited to these examples.

EXAMPLE 1

(Preparation of Emulsions)

First, 30 g of inactive gelatin and 6 g of potassium bromide were dissolved in 1 liter of distilled water, forming an aqueous solution. While stirring this aqueous solution and maintaining it at 75° C. , 35 cc of an aqueous solution containing 5.0 g of silver nitrate, and 35 cc of an aqueous solution containing 3.2 g of potassium bromide and 0.98 g of potassium iodide were added at the rate of 70 cc/min over 30 seconds. Then, pAg was increased to 10, and the solution was repined for 30 minutes, thereby obtaining a seed emulsion.

Further, a predetermined portion of 1 liter of an aqueous solution containing 145 g of silver nitrate, and an aqueous solution of a mixture of potassium bromide and potassium iodide were intermittently added, in equimolar amount each time, at a predetermined temperature and a predetermined pAg, at a addition speed close to the critical grow speed, thereby preparing tabular core emulsion. The remainder of the silver nitrate solution and a solution of a mixture of potassium bromide and potassium iodide whose compositions are different from those used to prepare the tabular core solution, were intermittently added, in equimolar amount each time, at a speed close to the critical growth speed, thus forming a coating on the cores. As a result, emulsions 1 to 5, each containing core/shell type grains of silver biomoiodide were prepared.

The aspect ratio of each of emulsions 1 to 5 was adjusted by selecting a propor aAg value at the time of preparing the core and the shell. The properties of emulsions 1 to 5, thus prepared, are as is shown in Table 1.

TABLE 1

| Emulsion | Average aspect ratio 1) | Average aspect ratio 2) | Average grain size (μm) | Average grain thickness (μm) | Average iodine content (mol %) |
|---|---|---|---|---|---|
| 1 | 1.5/1 | 1.2/1 | 0.86 | 0.67 | 7.6 |
| 2 | 2.8/1 | 2.2/1 | 1.01 | 0.55 | 7.6 |
| 3 | 4.6/1 | 3.6/1 | 1.63 | 0.36 | 7.6 |
| 4 | 6.7/1 | 5.2/1 | 1.74 | 0.30 | 7.6 |
| 5 | 11.7/1 | 9.8/1 | 2.10 | 0.21 | 7.6 |

1) An average value of the aspect ratios of individual grains obtained as follows; the projected area of 1000 grains are measured and the measure value are summed in the order of the measured value from the greatest one to the lowest one, until the summed projected area reach 50% of the projected areas of all grains.

2) An average value of the aspect ratios of the grains corresponding to 85% of the projected areas of all grains which is obtained by the same method as above.

A plurality of layers having the following compositions were coated on an undercoated triacetylcellulose film support, forming a multilayered color light-sensitive material (hereinafter referred to as "Sample 101").

(Compositions of light-sensitive layers)

Numerals corresponding to each component indicates a coating amount represented in units of g/m$^2$. The coating amount of a silver halide is represented by the coating amount of silver. The coating amount of a sensitizing dye is represented in units of moles per mole of a silver halide in the same layer.

(Sample 101)

| | |
|---|---|
| Layer 1: Antihalation layer | |
| Black colloidal silver | silver 0.18 |
| Gelatin | 0.50 |
| Layer 2: Inter-layer | |

| | | |
|---|---|---|
| 2,5-di-t-pentadecylhydroquinone | | 0.18 |
| EX-1 | | 0.18 |
| EX-3 | | 0.020 |
| EX-12 | | $2.0 \times 10^{-3}$ |
| U-1 | | 0.060 |
| U-2 | | 0.080 |
| U-3 | | 0.10 |
| HBS-1 | | 0.10 |
| HBS-2 | | 0.020 |
| Gelatin | | 0.80 |
| Layer 3: First red-sensitive emulsion layer | | |
| Emulsion A | silver | 0.15 |
| Emulsion B | silver | 0.35 |
| Sensitizing dye I | | $6.9 \times 10^{-5}$ |
| Sensitizing dye II | | $1.8 \times 10^{-5}$ |
| Sensitizing dye III | | $3.1 \times 10^{-4}$ |
| EX-2 | | 0.17 |
| EX-10 | | 0.020 |
| EX-14 | | 0.17 |
| U-1 | | 0.070 |
| U-2 | | 0.050 |
| U-3 | | 0.070 |
| HBS-1 | | 0.020 |
| Gelatin | | 0.75 |
| Layer 4: Second red-sensitive emulsion layer | | |
| Emulsion G | silver | 0.30 |
| Emulsion D | | 0.50 |
| Sensitizing dye I | | $5.1 \times 10^{-5}$ |
| Sensitizing dye II | | $1.4 \times 10^{-5}$ |
| Sensitizing dye III | | $2.3 \times 10^{-4}$ |
| EX-2 | | 0.20 |
| EX-3 | | 0.050 |
| EX-10 | | 0.015 |
| EX-14 | | 0.20 |
| EX-15 | | 0.050 |
| U-1 | | 0.020 |
| U-2 | | 0.010 |
| U-3 | | 0.020 |
| Gelatin | | 1.00 |
| Layer 5: Third red-sensitive emulsion layer | | |
| Emulsion 1 | silver | 1.40 |
| Sensitizing dye I | | $5.4 \times 10^{-5}$ |
| Sensitizing dye II | | $1.4 \times 10^{-5}$ |
| Sensitizing dye III | | $2.4 \times 10^{-4}$ |
| Exemplified compound (11) | | $6.0 \times 10^{-4}$ |
| EX-16 | | 0.070 |
| EX-2 | | 0.097 |
| EX-3 | | 0.010 |
| EX-4 | | 0.080 |
| HBS-1 | | 0.10 |
| HBS-2 | | 0.10 |
| Gelatin | | 1.30 |
| Layer 6: Inter-layer | | |
| EX-17 | | 0.060 |
| HBS-1 | | 0.020 |
| Gelatin | | 0.50 |
| Layer 7: First green-sensitive emulsion layer | | |
| Emulsion A | silver | 0.10 |
| Emulsion B | silver | 0.20 |
| Sensitizing dye IV | | $3.0 \times 10^{-5}$ |
| Sensitizing dye V | | $1.0 \times 10^{-4}$ |
| Sensitizing dye VI | | $3.8 \times 10^{-4}$ |
| EX-1 | | 0.021 |
| EX-6 | | 0.26 |
| EX-7 | | 0.030 |
| EX-8 | | 0.010 |
| Compound (CB-3) of invention | | 0.030 |
| HBS-1 | | 0.10 |
| HBS-3 | | 0.010 |
| Gelatin | | 0.63 |
| Layer 8: Second green-sensitive emulsion layer | | |
| Emulsion C | silver | 0.25 |
| Emulsion E | silver | 0.20 |
| Sensitizing dye IV | | $2.1 \times 10^{-5}$ |

| | | |
|---|---|---|
| Sensitizing dye V | | $7.0 \times 10^{-5}$ |
| Sensitizing dye VI | | $2.6 \times 10^{-4}$ |
| EX-6 | | 0.094 |
| EX-7 | | 0.026 |
| EX-8 | | 0.015 |
| Compound (CB-3) of invention | | 0.025 |
| HBS-1 | | 0.16 |
| HBS-3 | | $8.0 \times 10^{-3}$ |
| Gelatin | | 0.50 |
| Layer 9: Third green-sensitive emulsion layer | | |
| Emulsion 1 | silver | 1.20 |
| Sensitizing dye IV | | $3.5 \times 10^{-5}$ |
| Sensitizing dye V | | $8.0 \times 10^{-5}$ |
| Sensitizing dye VI | | $3.0 \times 10^{-4}$ |
| EX-1 | | 0.013 |
| EX-11 | | 0.065 |
| EX-13 | | 0.019 |
| Compound (CB-3) of invention | | 0.010 |
| HBS-1 | | 0.05 |
| HBS-2 | | 0.10 |
| Gelatin | | 1.00 |
| Layer 10: Yellow filter layer | | |
| Yellow colloid silver | | 0.050 |
| EX-5 | | 0.080 |
| HBS-1 | | 0.030 |
| Gelatin | | 0.50 |
| Layer 11: First blue-sensitive emulsion layer | | |
| Emulsion A | silver | 0.080 |
| Emulsion B | silver | 0.070 |
| Emulsion F | silver | 0.070 |
| Sensitizing dye VII | | $3.5 \times 10^{-4}$ |
| EX-8 | | 0.085 |
| EX-9 | | 0.72 |
| HBS-1 | | 0.20 |
| Gelatin | | 1.10 |
| Layer 12: Second blue-sensitive emulsion layer | | |
| Emulsion 1 | silver | 0.45 |
| Sensitizing dye VII | | $2.1 \times 10^{-4}$ |
| EX-8 | | 0.050 |
| EX-9 | | 0.15 |
| EX-10 | | $7.0 \times 10^{-3}$ |
| HBS-1 | | 0.050 |
| Gelatin | | 0.50 |
| Layer 13: Third blue-sensitive emulsion layer | | |
| Emulsion H | silver | 0.50 |
| Emulsion G | silver | 0.20 |
| Sensitizing dye VII | | $2.2 \times 10^{-4}$ |
| Exemplified compound (18) | | $5.0 \times 10^{-4}$ |
| EX-9 | | 0.20 |
| HBS-1 | | 0.070 |
| Gelatin | | 0.69 |
| Layer 14: First protective layer | | |
| Emulsion I | silver | 0.20 |
| U-4 | | 0.11 |
| U-5 | | 0.17 |
| HBS-1 | | $5.0 \times 10^{-2}$ |
| Gelatin | | 1.00 |
| Layer 15: Second protective layer | | |
| H-1 | | 0.40 |
| B-1 (diameter: 1.7 μm) | | $5.0 \times 10^{-2}$ |
| B-2 (diameter: 1.7 μm) | | 0.10 |
| B-3 | | 0.10 |
| S-1 | | 0.20 |
| Gelatin | | 0.60 |

Further, all layers of Sample 101 contained W-1, w-2, W-3, B-4, B-5, F-1, F-2, F-3, F-4, F-5, F-6, F-7, F-8, F-9, F-10, F-11, F-12, F-13, iron salt, lead salt, gold salt, platinum salt, iridium salt, and rhodium salt, so that they may have improved storage stability, may be more readily processed, may be more resistant to pressure, more antibacterial and more antifungal, may be better protected against electrical charging, and may be more readily coated.
The structures of the compounds used in Sample 101 are as follows:
Ex-1
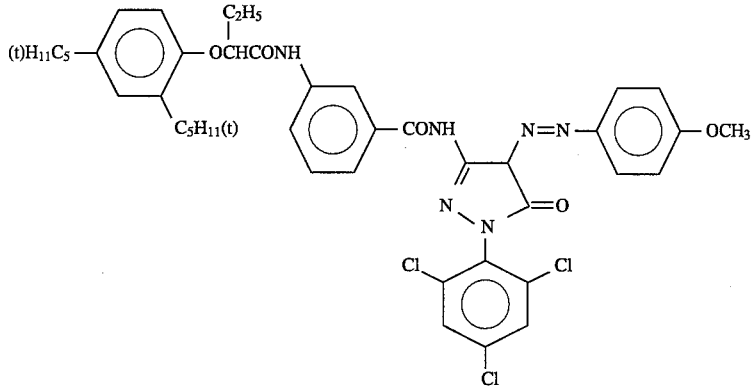
Ex-2
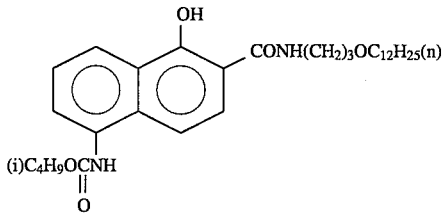
Ex-3
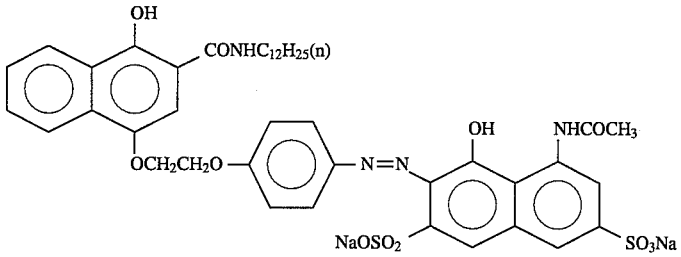
Ex-4
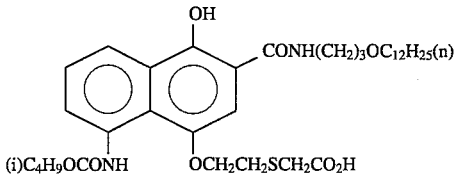
EX-5
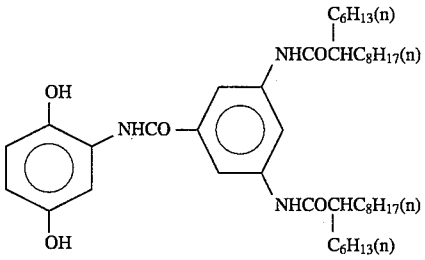

-continued
EX-6
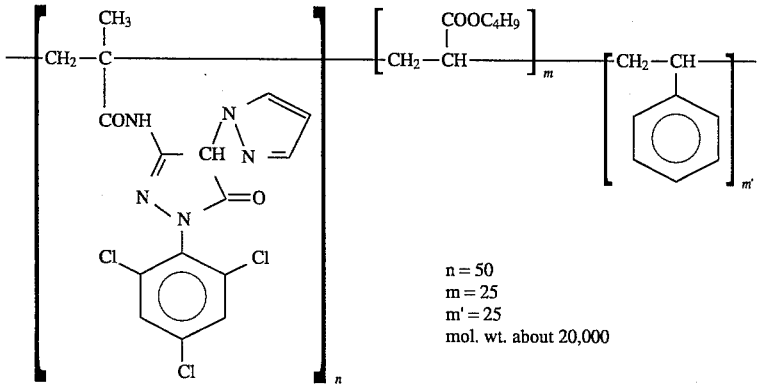
n = 50
m = 25
m' = 25
mol. wt. about 20,000
Ex-7
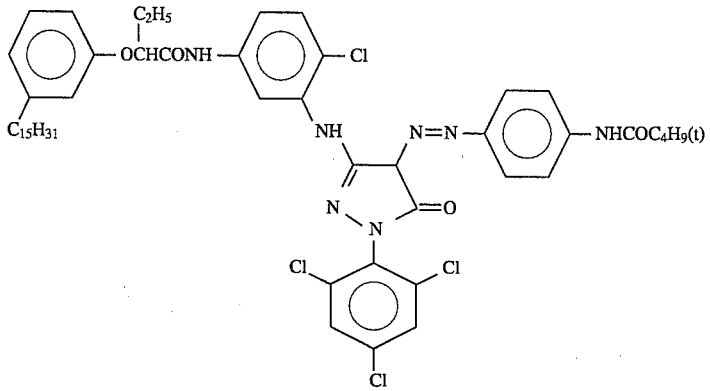
EX-8
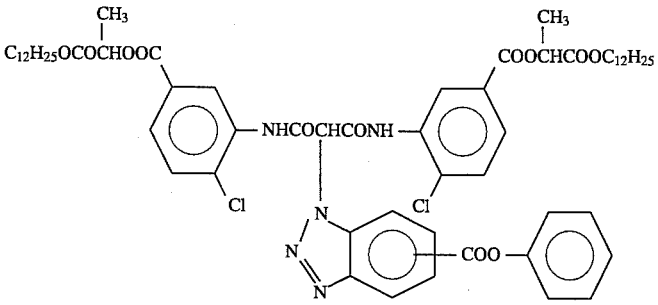
EX-9
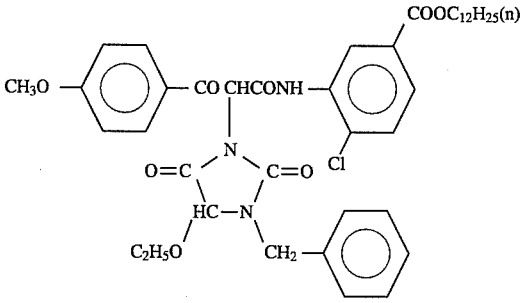

-continued
EX-10
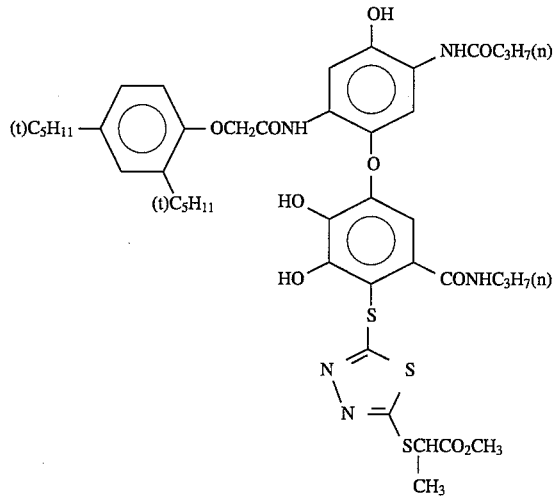
EX-11
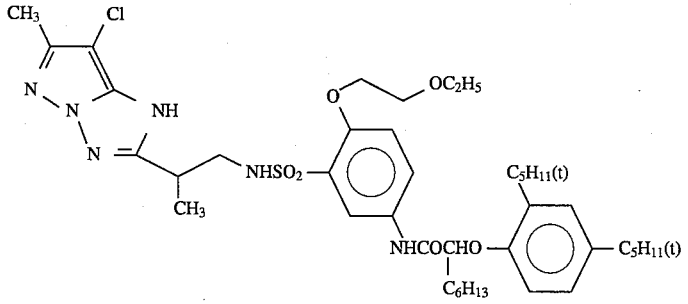
EX-12
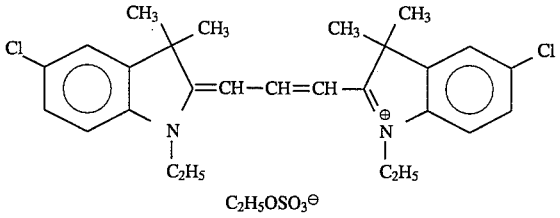
EX-13
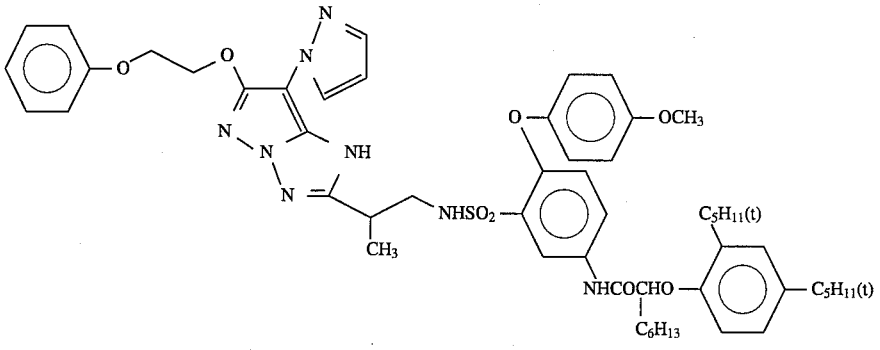
EX-14
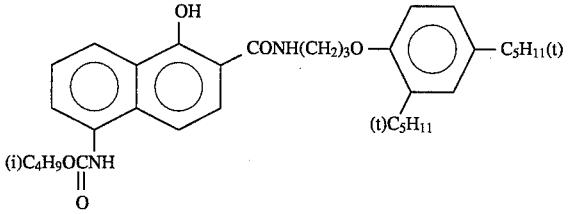

-continued
EX-15
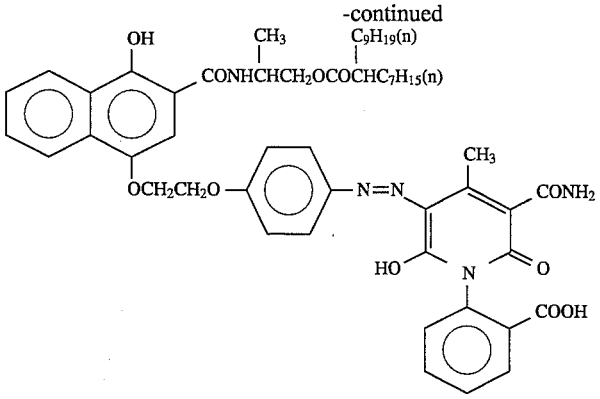
EX-16
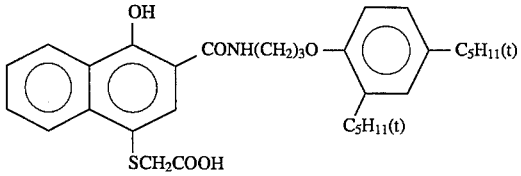
EX-17
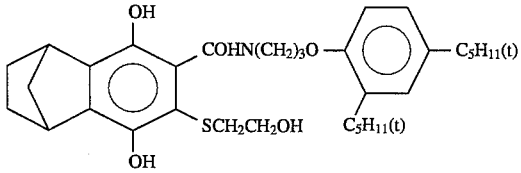
U-1
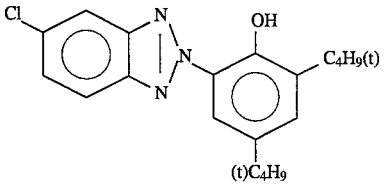
U-2
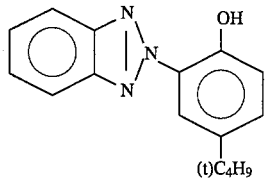
U-3
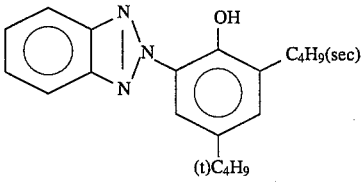
U-4
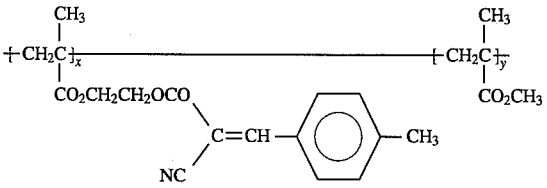
X:Y = 70:30 (wt %)
U-5
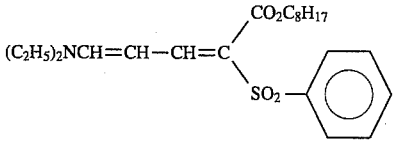

-continued
Tricresylphosphate HBS-1
di-n-butylphthalate HBS-2
HBS-3
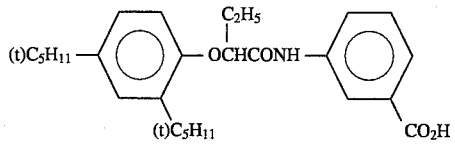
Sensitizing dye I
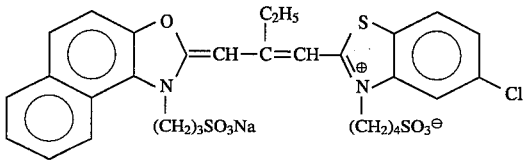
Sensitizing dye II
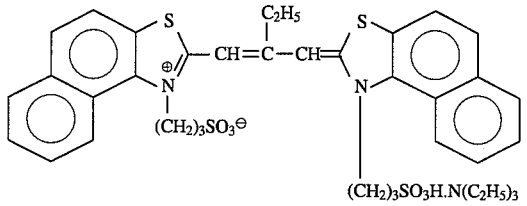
Sensitizing dye III
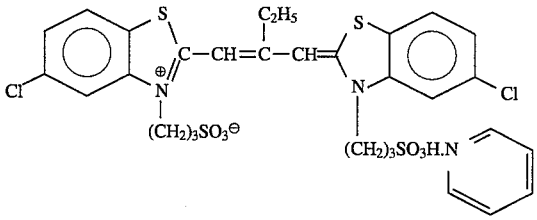
Sensitizing dye IV
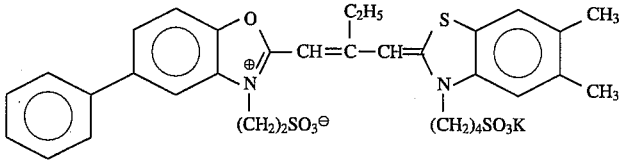
Sensitizing dye V
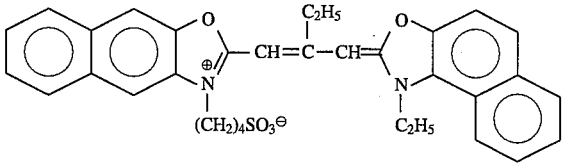
Sensitizing dye VI
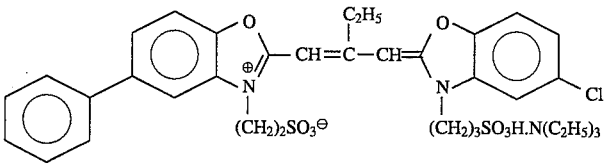
Sensitizing dye VII
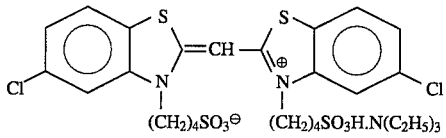
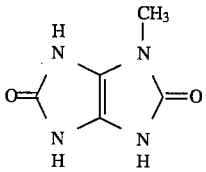
S-1
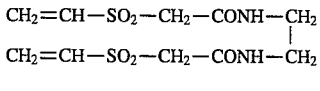
H-1

-continued
B-1
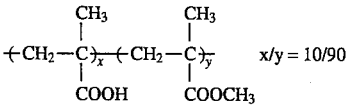
B-2
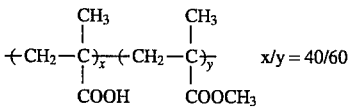
B-3
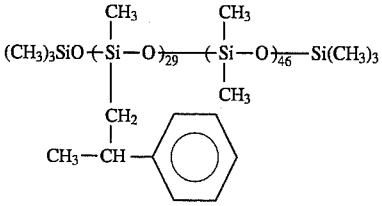
B-4
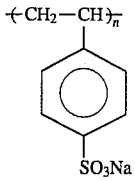
B-5
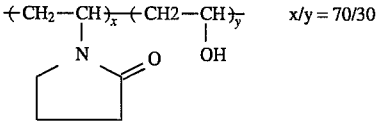
W-1
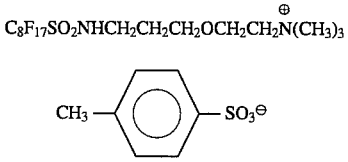
W-2
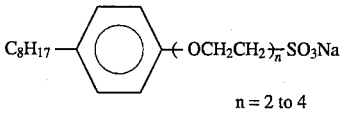
W-3
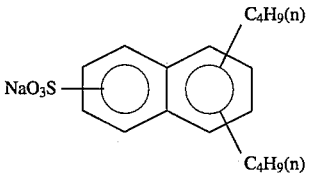
F-1
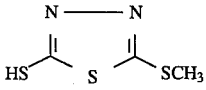
F-2
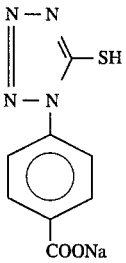
F-3
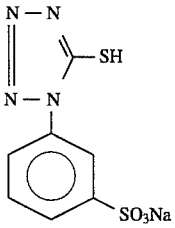
F-4
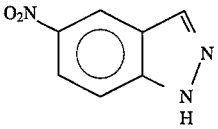
F-5
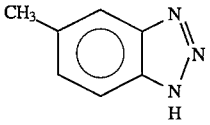
F-6
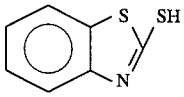
F-7
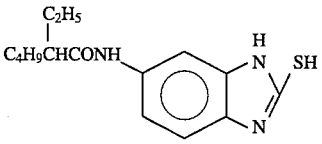
F-8
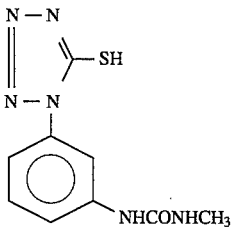
F-9
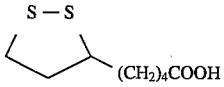
F-10
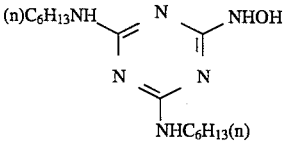

-continued

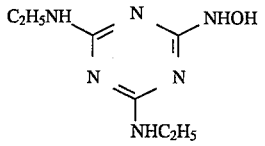

F-11

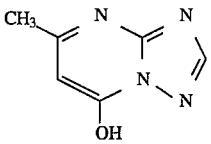

F-12

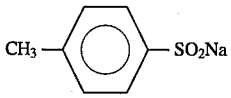

F-13

The emulsions A to I used in Sample 101 are as is shown in the following Table 2:

TABLE 2

| | Average AgI Content (%) | Average Grain Size (μm) | Variation Coefficient Relating to Grain Size (%) | Diameter/ Thickness Ratio | Silver Amount Ratio (AgI Content %) |
|---|---|---|---|---|---|
| Emulsion A | 4.0 | 0.45 | 27 | 1 | Core/Shell = 1/3 (13/1), Double structure grain |
| Emulsion B | 8.9 | 0.70 | 14 | 1 | Core/Shell = 3/7 (25/2), Double structure grain |
| Emulsion C | 10 | 0.75 | 17 | 1 | Core/Shell = 1/2 (24/3), Double structure grain |
| Emulsion D | 16 | 0.95 | 22 | 1 | Core/Shell = 4/6 (40/0), Double structure grain |
| Emulsion E | 10 | 0.95 | 18 | 1 | Core/Shell = 1/2 (24/3), Double structure grain |
| Emulsion F | 4.0 | 0.25 | 28 | 1 | Core/Shell = 1/3 (13/1), Double structure grain |
| Emulsion G | 14.0 | 0.75 | 17 | 1 | Core/Shell = 1/2 (42/0), Double structure grain |
| Emulsion H | 14.5 | 1.20 | 18 | 1 | Core/Shell = 37/63 (34/3), Double structure grain |
| Emulsion I | 1 | 0.07 | 15 | 1 | Uniform grain |

(Samples 102 to 105)

Samples 102 to 105 were prepared which were identical to Sample 101, except that their layers 5 and 9 were not formed of emulsion 1, but of emulsions 2 to 5, respectively.

(Samples 106 to 110)

Samples 106 to 110 were prepared which were identical to Samples 101 to 105, except that the layers 8 and 9 contained the compound (C-1) specified below, respectively, in place of the compound (CB-3) of the invention.

C-1 (Compound I disclosed in JP-A-60-218645)

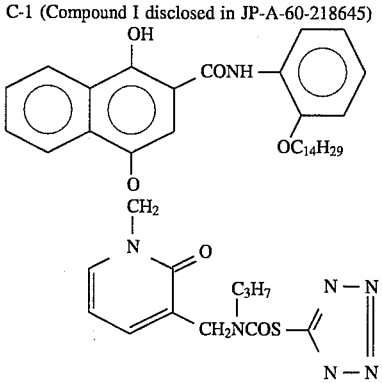

C-2 (Compound 6 disclosed in JP-A-63-37346)

-continued

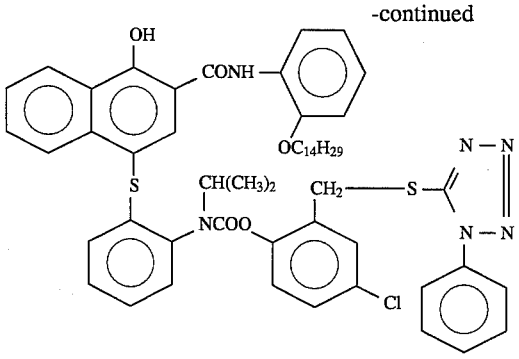

C-3 (Compound 3 disclosed in JP-A-1-280755)

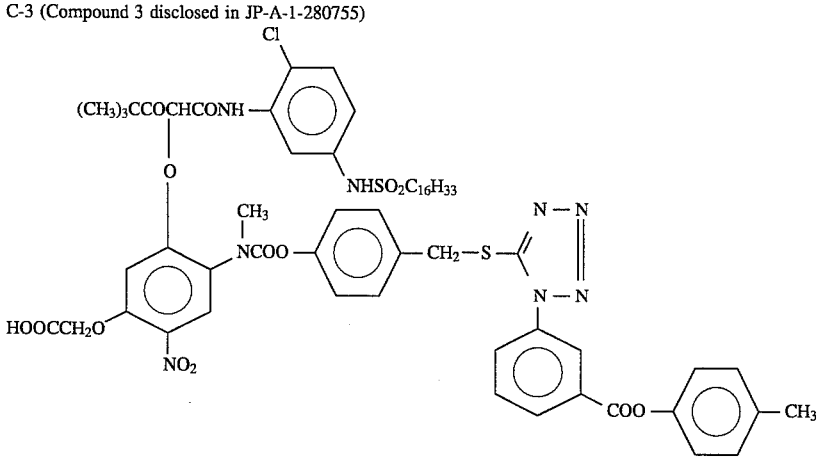

C-4 (Compound T-1 disclosed in JP-A-2-230139)

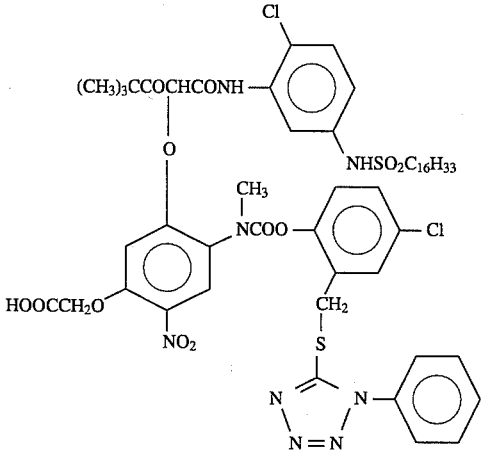

(Samples 111 to 118)

Samples 111 to 118 were prepared which were identical to Sample 108, except that the layers 8 and 9 contained the compounds shown in Table 4, respectively, in place of the compound (C-1) of the invention. These compounds were added in such amounts that the layers 8 and 9 had substantially the same gamma value.

(Sample 119)

Sample 119 was prepared which was identical to Sample 118, except that neither the compound (11) nor the compound (18) were not used at all.

Samples 101 to 119, thus prepared, were exposed imagewise to white light. Then, they were color-developed in the conditions which will be specified later. The relative sensitivity of each sample were evaluated, as the logarithmic value of the reciprocal of the exposure amount which achieved magenta density of fog +0.5. Also, the samples were left to stand at 45° C. and relative humidity of 80% for 7 days, and developed, thereby detecting the change in fog occurring during the 7-day period. Further, the RMS value of each sample, indicating the graininess, (i.e., a value at the magenta density (fog +0.5) at aperture of 48 μm diameter) was measured. Also, the MTF value of the magenta image formed on each sample, which represents the sharpness, was measured. Still further, the samples were uniformly exposed to blue light at 1 lux/sec and then exposed imagewise to green light. The color turbidities were shown in Table 3, which was obtained by subtracting the yellow densities in the magenta fog densities from the yellow densities in the exposure amounts which provide magenta densities equal to the value of (fog +1.0).

TABLE 3

| Sample | Emulsion of layers 5, 9 and 12 | Emulsion of layers 7, 8 and 9 | Compound in layer 5 | Compound in layer 13 | Relative sensitivity | RMS value ×1000 | MTF value (magent image) 25 cycles/mm | Color turbidity | Change in Fog |
|---|---|---|---|---|---|---|---|---|---|
| 101 (Comp.) | 1 | CB-3 | (11) | (18) | 0.00 | 28.5 | 0.61 | −0.07 | 0.04 |
| 102 (Invention) | 2 | " | " | " | 0.00 | 27.4 | 0.63 | −0.05 | 0.02 |
| 103 (Invention) | 3 | " | " | " | 0.01 | 26.9 | 0.65 | −0.04 | 0.02 |
| 104 (Invention) | 4 | " | " | " | 0.02 | 26.9 | 0.65 | −0.04 | 0.02 |
| 105 (Invention) | 5 | " | " | " | 0.03 | 26.8 | 0.65 | −0.04 | 0.02 |
| 106 (Comp.) | 1 | C-1 | " | " | −0.03 | 29.1 | 0.57 | −0.02 | 0.08 |
| 107 (Comp.) | 2 | " | " | " | −0.03 | 28.1 | 0.59 | −0.01 | 0.07 |
| 108 (Comp.) | 3 | " | " | " | −0.02 | 27.5 | 0.61 | 0.00 | 0.07 |
| 109 (Comp.) | 4 | " | " | " | −0.01 | 27.5 | 0.61 | 0.00 | 0.07 |
| 110 (Comp.) | 5 | " | " | " | 0.00 | 27.5 | 0.61 | 0.00 | 0.07 |
| 111 (Comp.) | 3 | C-2 | (11) | (18) | −0.01 | 27.3 | 0.61 | 0.00 | 0.08 |
| 112 (Comp.) | 3 | C-3 | " | " | 0.00 | 27.6 | 0.60 | 0.01 | 0.10 |
| 113 (Comp.) | 3 | C-4 | " | " | 0.00 | 27.6 | 0.60 | 0.03 | 0.08 |
| 114 (Invention) | 3 | CA-1 | " | " | 0.02 | 26.8 | 0.63 | −0.02 | 0.04 |
| 115 (Invention) | 3 | CA-19 | " | " | 0.02 | 26.8 | 0.63 | −0.02 | 0.03 |
| 116 (Invention) | 3 | CB-2 | " | " | 0.02 | 26.9 | 0.65 | −0.04 | 0.02 |
| 117 (Invention) | 3 | CB-16 | " | " | 0.02 | 26.9 | 0.64 | −0.04 | 0.02 |
| 118 (Invention) | 3 | CB-18 | " | " | 0.02 | 26.8 | 0.65 | −0.04 | 0.02 |
| 119 (Invention) | 3 | " | — | — | 0.00 | 27.2 | 0.65 | −0.04 | 0.04 |

Samples 101 to 119 were color-developed by means of an automatic developing machine, by the method specified below, until the accumulated quantity of replenisher reached three times the volume of the mother solution tank.

| | Processing Method | | | |
|---|---|---|---|---|
| Process | Time | Temp. | Quantity* of replenisher | Tank volume |
| Color development | 3 min. 15 sec. | 38° C. | 33 ml. | 20 l |
| Bleaching | 6 min. 30 sec. | 38° C. | 25 ml | 40 l |
| Washing | 2 min. 10 sec. | 24° C. | 1200 ml | 20 l |
| Fixing | 4 min. 20 sec. | 38° C. | 25 ml | 30 l |
| Washing (1) | 1 min. 05 sec. | 24° C. | ** | 10 l |
| Washing (2) | 1 min. 00 sec. | 24° C. | 1200 ml | 10 l |
| Stabilization | 1 min. 05 sec. | 38° C. | 25 ml | 10 l |
| Drying | 4 min. 20 sec. | 55° C. | | |

*Note:
The quantity of replenisher is per meter of a 35-mm wide sample.
**Note:
The washing (1) was carried out in counter flow, from the step (2) to the step (1).

The compositions of the solutions used in the color-developing process are as follows:

| | Mother Solution (g) | Replenisher (g) |
|---|---|---|
| (Color Developing Solution): | | |
| Diethylenetriamine-pentaacetate | 1.0 | 1.1 |
| 1-hydroxyethylidene-1,1-diphosphonic acid | 3.0 | 3.2 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-[N-ethyl-N-β-hydroxylethylamino]-2-methylaniline sulfate | 4.5 | 5.5 |
| Water to make | 1.0 l | 1.0 l |
| pH | 10.05 | 10.10 |
| (Bleaching Solution): | | |
| Sodium ferric ethylenediamine tetraacetate trihydrate | 100.0 | 120.0 |
| Disodium ethylenediamine tetraacetate | 10.0 | 10.0 |
| Ammonium bromide | 140.0 | 160.0 |
| Ammonium nitrate | 30.0 | 35.0 |
| Ammonia water (27%) | 6.5 ml | 4.0 ml |
| Water to make | 1.0 l | 1.0 l |
| pH | 6.0 | 5.7 |
| (Fixing Solution): | | |
| Disodium ethylenediamine tetraacetate | 0.5 | 0.7 |
| Sodium sulfite | 7.0 | 8.0 |
| Sodium bisulfite | 5.0 | 5.5 |
| Ammonium thiosulfate aqueous solution (70%) | 170.0 ml | 200.0 ml |
| Water to make | 1.0 l | 1.0 l |
| pH | 6.7 | 6.6 |
| (Stabilizing Solution): | | |
| Formalin (37%) | 2.0 ml. | 3.0 ml |
| Polyoxyethylene-p-monononylphenyl-ether (polymerization degree: 10) | 0.3 | 0.45 |
| Disodium ethylenediamine tetraacetate | 0.05 | 0.08 |
| Water to make | 1.0 l | 1.0 l |
| pH | 5.0–8.0 | 5.0–8.0 |

As is evident from Table 3, the samples according to the present invention had high sensitivity, excelled in graininess, sharpness and color reproduction, and had their fog changed little while being stored. In particular, the samples which contained the compounds (11) and (18) exhibited good graininess, sensitivity, and storage stability.

EXAMPLE 2

Emulsion 6 (This Invention)

First, 25 cc of gelatin-containing 2M silver nitrate aqueous solution and 25 cc of gelatin-containing 2M potassium bromide aqueous solution were simultaneously added to 1 liter of 0.7 wt % gelatin solution containing 0.04M of potassium bromide over 1 minutes, while vigorously stirring the gelatin solution at 30° C. The resultant mixture solution was heated to 75° C., and 300 cc of 10-wt % gelatin solution was added to the solution. Thereafter, 30 cc of 1M silver nitrate aqueous solution was added over 5 minutes and then 10 cc of 25-wt % ammonia water was added to the solution. The resultant mixture solution was ripened at 75° C. After the ripening, ammonia was neutralized and, 1M silver nitrate aqueous solution and 1M potassium bromide aqueous solution were added to and mixed with the solution at an increasing rate (The final rate was 5 times the initial rate), while maintaining the solution at 2.3 pBr. The amount of the silver nitrate aqueous solution used was 600 cc. The emulsion, thus prepared, was washed with ordinary flocculation, and dispersed gelatin was added to the emulsion, thereby preparing 800 g of silver halide emulsion (i.e., seed emulsion A) containing hexagonal tabular grains. The seed emulsion A contained monodispersed hexagonal tabular grains which had average equivalent-circle diameter (grain size) of 1.0 μm, average thickness of 0.18 μm, and variation coefficient of 11%. Next, 800 cc of distilled water, 30 g of gelatin, and 6.5 g of potassium bromide were added to 250 g of seed emulsion A, thus forming a solution. This solution was heated to 75° C. and subsequently stirred. 1M silver nitrate aqueous solution and 1M silver halide alkali aqueous solution (containing 90 mol % of potassium bromide and 10 mol % of potassium iodide) were simultaneously added to the solution, at an increasing rate (The final rate was 3 times the initial rate), while maintaining the solution at 1.6 pBr, thereby mixing the silver nitrate aqueous solution and the silver halide alkali aqueous solution with the solution. The amount of the silver nitrate aqueous solution used was 600 cc. Further, 1M silver nitrate aqueous solution and 1M potassium bromide aqueous solution were simultaneously added to the resultant solution at an increasing rate (The final rate was 1.5 times the initial rate), while maintaining the solution at pBr 1.6. The amount of the silver nitrate aqueous solution used was 200 cc.

The emulsion thus obtained was washed with water by the above-mentioned method. Dispersed gelatin was added to the emulsion, thereby preparing silver halide emulsion containing monodispersed hexagonal tabular grains (emulsion 6). The hexagonal tabular grains occupied 92% of the total projected area of all grains contained in emulsion 6, had an average grain size of 1.75 μm, an average thickness of 0.29 μm, an average aspect ratio of 6:1, and a variation coefficient of 16%.

Emulsion 7 (This Invention)

Seed emulsion B was obtained by the same method as in the preparation of emulsion 6, except that 1M silver nitrate aqueous solution for the second time and ammonia water were added in an amount of 20 cc and an amount of 8 cc, respectively. The grains in the seed emulsion B were grown in the same way as in the preparation of emulsion 6, except that pBr was maintained at 1.5 during the growth of grains. As a result, emulsion 7 was prepared which contained hexagonal tabular grains occupying 90% of the total projected area of all grains. The hexagonal tabular grains had an average size of 2.1 μm, an average thickness of 0.21 μm, an average aspect ratio of 10:1 and a variation coefficient of 19%.

Emulsion 8 (This Invention)

Seed emulsion C was obtained by the same method as in the preparation of emulsion 6, except that 1M silver nitrate aqueous solution for the second time was added in an amount of 10 cc, not 30 cc, and no ammonia water was added at all, and that pBr for the third time was maintained at 1.7, not 2.3. Then, the grains in the seed emulsion C were grown in the same way as in the preparation of emulsion 6. As a result, emulsion 8 was prepared which contained hexagonal tabular grains occupying 62% of the total projected area of all grains. The hexagonal tabular grains had an average size of 2.0 μm, an average thickness of 0.17 μm, an average aspect ratio of 12:1, and a variation coefficient of 37%.

A mixture of the sensitizing dyes IV, V, and VI used in ratio of 0.2:0.1:0.3 was added to emulsions 6, 7, 8, and 1 in such an amount which was 70% of the saturated adsorption amount to each emulsion. Emulsions 6, 7, 8 and 1 were left to stand for 20 minutes at 60° C., and were then appropriately sensitized chemically with sodium thiosulfate, chloroauric acid, and potassium thiocyanate at 60° C. at pH value of 6.5. As a result, emulsions 6-1, 7-1, 8-1, and 1-1 were prepared, the properties of which were as is shown in the following Table 4.

TABLE 4

| Emulsion | Average aspect ratio 1) | Average aspect ratio 2) | Average aspect ratio 3) | Average grain size (μm) | Average grain size (μm) | Variation Coefficient Relating to grain size | Ratio of hexagonal tabular grains (%) | Relative standard deviation of intra-grain of AgI content |
|---|---|---|---|---|---|---|---|---|
| 6-1 | 7.9/1 | 7.2/1 | 6.0/1 | 1.75 | 0.29 | 0.15 | 92 | 13 |
| 7-1 | 13/1 | 11/1 | 10/1 | 2.10 | 0.21 | 0.19 | 90 | 16 |
| 8-1 | 21/1 | 17/1 | 12/1 | 2.00 | 0.17 | 0.37 | 62 | 24 |
| 1-1 | 1.5/1 | 1.2/1 | 1.1/1 | 0.86 | 0.67 | 0.25 | 10 | 22 |

1), 2) These are values measured in the same way as those shown in Table 1.
3) The average value for all grains contained in the emulsion.
4) Ratio of the total projected area of hexagonal grains to that of all grains.
5) The values measured by the method disclosed in JP-A-60-143332.

(Samples 201 to 204)

Samples 201 to 204 were prepared in the same method as Sample 101, except that emulsions 6-1, 7-1, 8-1, and 1-1 were used in the layer 9, in place of emulsion 1, that the sensitizing dyes IV, V, VI were not used in the layer 9 at all, and that the compound (CB-3) of this invention was added to the layer 5 in an amount of 0.015 g/m$^2$.

(Samples 205 to 208)

Samples 205 to 208 were prepared in the same way as Samples 201 to 204, respectively, except that the compound (CB-18) was added to the layers 5, 7, 8 and 9, in place of the compound (CB-3) in an equimolar amount.

(Samples 209 and 210)

Samples 209 and 210 were prepared in the same way as Sample 205, except that emulsion 6–1 and another emulsion was added in an mixing ratio of 1:1.

Samples 201 to 210, thus prepared, were processed in the method specified below, for their relative sensitivities, their MTF values of magenta images, and their RMS values. The results were as is shown in the following Table 5.

| Processing Method | | | | |
|---|---|---|---|---|
| Process | Time | Temp. | Quantity* of replesnisher | Tank volume |
| Color development | 3 min. 15 sec. | 37.8° C. | 25 ml | 10 l |
| Bleaching | 45 sec. | 38° C. | 5 ml | 4 l |
| Bleach-fixing (1) | 45 sec. | 38° C. | — | 4 l |
| Bleach-fixing (2) | 45 sec. | 38° C. | 30 ml | 4 l |
| Washing (1) | 20 sec. | 38° C. | — | 2 l |
| Washing (2) | 20 sec. | 38° C. | 30 ml | 2 l |
| Stabili-zation | 20 sec. | 38° C. | 20 ml | 2 l |
| Drying | 1 min. | 55° C. | | |

*Note:
The quantity of replenisher is per meter of a 35-mm wide sample.

The bleach fixing and washing step were carried out in counter flow, from the step (2) to the step (1), and the overflowing bleach solution was used in the bleach fixing (2).

The amount of the bleach-fixing solution left over to the washing was 2 ml per meter of the 35 mm wide light-sensitive material.

| | Mother Solution (g) | Replenisher (g) |
|---|---|---|
| (Color Developing Solution): | | |
| Diethylenetriamine-pentaacetate | 5.0 | 6.0 |
| Sodium sulfite | 4.0 | 5.0 |
| Potassium carbonate | 30.0 | 37.0 |
| Potassium bromide | 1.3 | 0.5 |
| Potassium iodide | 1.2 mg | — |
| Hydroxylamine sulfate | 2.0 | 3.6 |
| 4-[N-ethyl-N-β-hydroxyethylamino] -2-methylaniline sulfate | 4.7 | 6.2 |
| Water to make | 1.0 l | 1.0 l |
| pH | 10.00 | 10.15 |
| (Bleaching Solution): | | |
| Ammonium ferric 1,3-diaminopropane tetraacetate monohydrate | 144.0 | 206.0 |
| 1,3-diaminopropane tetraacetic acid | 2.8 | 4.0 |
| Ammonium bromide | 84.0 | 120.0 |
| Ammonium nitrate | 17.5 | 25.0 |
| Ammonia water (27%) | 10.0 ml | 1.8 ml |
| Acetic acid (98%) | 51.1 | 73.0 |
| Water to make | 1.0 l | 1.0 l |
| pH | 4.3 | 3.4 |
| (Bleach-fixing Solution): | | |
| Ammonium ferric ethylenediamine tetraacetate dihydrate | 50.0 | — |
| Disodium ethylene-diamine tetraacetate | 5.0 | 25.0 |
| Ammonium sulfite | 12.0 | 20.0 |
| Ammonium thiosulfate aqueous solution (700 g/l) | 290.0 ml | 320.0 ml |

-continued

| | Mother Solution (g) | Replenisher (g) |
|---|---|---|
| Ammonia water (27%) | 6.0 ml | 15.0 ml |
| Water to make | 1.0 l | 1.0 l |

(Washing Solution): The same solution used for mother solution and the replenisher (Washing Solution): The same solution used for mother solution and the replenisher The washing solution was prepared by passing tap water through a mixed-bed column filled with H-type strong-acid cation exchange resin (Amberlite IR-120B of Rohm and Haas, Inc.) and OH-type strong-base anion exchange resin (Amberlite IRA-400 of Rohm and Haas, Inc.), thereby adjusting the calcium and magnesium ion concentrations to 3 mg/l or less, and then by adding 20 mg/l of dichloro isocyanurate and 150 mg/l of sodium sulfate were added to the water thus processed, thereby obtaining the washing solution. The washing solution had pH value ranging from 6.5 to 7.5.

| (Stabilizing Solution): The same solution used for mother solution and replenisher (unit g) | |
|---|---|
| Surfactant $[C_{10}H_{21}—O(CH_2CH_2O_{10}—H]$ | 1.2 ml |
| Ethyleneglycol | 0.4 |
| Water to make | 1.0 l |
| pH | 5.0 to 7.0 |

TABLE 5

| Sample | Emulsion of layer 9 | Emulsion in layers 5, 7, 8 and 9 | Relative sensitivity | RMS value ×1000 | MTF value |
|---|---|---|---|---|---|
| 201 (Invention) | 6-1 | CB-3 | 0.00 | 26.8 | 0.63 |
| 202 (Invention) | 7-1 | " | 0.03 | 27.0 | 0.64 |
| 203 (Invention) | 8-1 | " | −0.02 | 27.2 | 0.64 |
| 204 (Comp.) | 1-1 | " | −0.05 | 28.9 | 0.61 |
| 205 (Invention) | 6-1 | CB-18 | 0.01 | 26.9 | 0.64 |
| 206 (Invention) | 7-1 | " | 0.03 | 27.1 | 0.65 |
| 207 (Invention) | 8-1 | " | −0.02 | 27.2 | 0.65 |
| 208 (Comp.) | 1-1 | " | −0.05 | 29.0 | 0.61 |
| 209 (Invention) | 6-1/7-1 | " | 0.02 | 27.0 | 0.65 |
| 210 (Invention) | 6-1/9-1 | " | −0.01 | 27.6 | 0.63 |

As is evident from Table 5, the samples of the invention had higher sensitivities and better graininesses than the samples using the emulsions which fell outside the scope of the present invention. In particular, the samples using emulsions 6-1 and 7-1 which contained many hexagonal tabular grains excelled in sensitivity and graininess.

EXAMPLE 3

Preparation of Emulsions

An aqueous solution was prepared by dissolving 6 g of potassium bromide and 23 g of inactive gelatin in 3.7 liters of distilled water. While this solution was stirred, 14% potassium bromide aqueous solution and 20% silver nitrate aqueous solution were added to the solution at a prescribed flow rate over 1 minute at 45° C. and pAg value of 9.6 by means of double-jet method, thus forming a mixture solution. (In this addition (I), 2.40% of all silver used was consumed.) Next, 3300 cc of 17% gelatin aqueous solution was added to the mixture solution. The solution was stirred at 45° C. Then, 20% silver nitrate aqueous solution was added at a predetermined flow rate, until the pAg value reached 8.40. (In this addition (II), 5.0% of all silver used was consumed.) The resultant solution was heated to 75° C., and 35 μl of 25% $NH_3$ aqueous solution was added to the solution. The solution was left to stand for 15 minutes. Thereafter, 510 μl of 1N $H_2SO_4$ was added, thereby neutralizing the solution. Further, 20% potassium bromide solution containing potassium iodide and 33% silver nitrate aqueous solution were added to the solution over 80 minutes by means of double-jet method, thus adding 8.3 g of potassium iodide, thereby forming an emulsion. (In this addition (III), 92.6% of all silver used was consumed.) During the addition (III), the solution was maintained at 75° C. and pAg value of 8.10. The total amount of silver nitrate used in the emulsion was 425 g. The emulsion was desilvered by ordinary flocculation, and was subjected to an appropriate gold-sulfur sensitization in the presence of sensitizing dyes S'-5 and S'-6, thereby preparing tabular AgBrI emulsion 1' (AgI=2.0 mol %).

Emulsion 2' was prepared in the same way as emulsion 1', except that in the addition (III), potassium bromide aqueous solution containing no potassium iodide and silver nitrate aqueous solution were added to the solution until 40% of all silver used was consumed. Then, the addition of silver nitrate and potassium bromide solutions was stopped and 830 ml of 1% potassium iodide aqueous solution was added to the solution over about 90 seconds. Thereafter, the remainder of the potassium bromide and silver nitrate aqueous solutions was added to the solution at 3 times the flow rate.

Emulsion 3' was prepared by the same method as emulsion 2', except that potassium bromide aqueous solution was added to the solution just before adding potassium iodide aqueous solution, and that the pAg value was adjusted to 9.0.

Emulsion 4' was prepared in the same way as emulsion 2', except that the temperature of the solution was set at 30° C. just before potassium iodide aqueous solution was added to the solution. Potassium bromide and silver nitrate aqueous solutions were added after the addition of the potassium iodide aqueous solution, by double-jet method at 30° C. and pAg value of 8.1.

Emulsions 1' to 4', thus prepared, contained grains having equivalent-sphere diameters of about 0.7 μm and a ratio of average grain diameter/grain thickness of 6.5 to 7.0.

Emulsions 1' to 4' were directly examined by the method used in in Example 1-(2) described in JP-A-63-220238,by means of a transmission electron microscope, to see whether or not dislocation had occurred in the grains. No dislocation was found in the grains contained in emulsion 1'. Ten or more dislocation lines were observed in 50% or more of the grains contained in emulsions 2' to 4'. Unlike in the grains of emulsion 2', a similar number of dislocation lines were observed in the grains of emulsions 3' and 4'.

Intra-grain iodine distribution of emulsions 1' and 4' were further evaluated by the methods described in European Patent 147868A. The results were as is shown in the following Table 6:

TABLE 6

| Emulsion | 1' | 2' | 3' | 4' |
|---|---|---|---|---|
| Intra-grain Distribution of iodine (%) | 20 | 65 | 30 | 15 |

Preparation of Sample 301

A plurality of layers having the following compositions were coated on a triacetylcellulose film support undercoated on both sides and having a thickness of 205 μm, thereby forming a multilayered color light-sensitive material (hereinafter referred to as "Sample 301").

(Compositions of light-sensitive layers)

Numerals corresponding to each component indicates a coating amount represented by the values per 1 $m^2$ of the sample. The coating amount of a silver halide and colloidal silver are represented by the coating amount of silver.

(Sample 301)

| | |
|---|---|
| Layer 1: Antihalation layer | |
| Black colloidal silver | 0.25 g |
| Gelatin | 1.9 g |
| UV absorbent U'-1 | 0.04 g |
| UV absorbent U'-2 | 0.1 g |
| UV absorbent U'-3 | 0.1 g |
| UV absorbent U'-4 | 0.1 g |
| UV absorbent U'-6 | 0.1 g |
| Additive P-1 | 0.1 g |
| Additive F'-10 | 0.2 g |
| Organic solvent having a high-boiling point Oil-1 | 0.1 g |
| Layer 2: Inter-layer | |
| Gelatin | 0.40 g |
| Compound Cpd-D | 10 mg |
| Dye D-4 | 0.4 mg |
| Organic solvent having a high-boiling point Oil-3 | 40 mg |
| Dye D-6 | 0.1 g |
| Layer 3: Inter-layer | |
| Additive M-1 | 0.05 g |
| Gelatin | 0.4 g |
| Layer 4: Low red-sensitive emulsion layer | |
| Emulsion A' | silver 0.2 g |
| Emulsion B' | silver 0.3 g |
| Additive F'-14 | 1 mg |
| Gelatin | 0.8 g |
| Compound Cpd-K | 0.05 g |
| Coupler C'-1 | 0.15 g |
| Coupler C'-2 | 0.05 g |
| Coupler C'-9 | 0.05 g |
| Coupler C'-10 | 0.10 g |
| Compound Cpd-D | 10 mg |
| Additive F'-2 | 0.1 mg |
| Organic solvent having a high-boiling point Oil-2 | 0.10 g |
| Additive F'-12 | 0.5 mg |
| Layer 5: Medium red-sensitive emulsion layer | |
| Emulsion B' | silver 0.2 g |
| Emulsion C' | silver 0.3 g |
| Gelatin | 0.8 g |
| Additive F'-13 | 0.05 mg |
| Coupler C'-1 | 0.2 g |
| Coupler C'-2 | 0.05 g |
| Coupler C'-3 | 0.2 g |
| Additive F'-2 | 0.1 mg |
| Organic solvent having a high-boiling point Oil-2 | 0.1 g |
| Layer 6: High red-sensitive emulsion layer | |

| | |
|---|---|
| Emulsion D' | silver 0.4 g |
| Gelatin | 1.1 g |
| Coupler C'-3 | 0.7 g |
| Coupler C'-1 | 0.3 g |
| Additive P-1 | 0.1 g |
| Additive F'-1 | 0.1 mg |
| Layer 7: Inter-layer | |
| Gelatin | 0.6 g |
| Color-mixing inhibitor Cpd-L | 0.05 g |
| Additive F'-1 | 1.5 mg |
| Additive F'-7 | 2.0 mg |
| Additive Cpd-N | 0.02 g |
| Additive M-1 | 0.3 g |
| Color-mixing inhibitor Cpd-K | 0.05 g |
| UV absorbent U'-1 | 0.1 g |
| UV absorbent U'-6 | 0.1 g |
| Dye D'-1 | 0.02 g |
| Dye D'-6 | 0.05 g |
| Layer 8: Inter-layer | |
| Silver bromoiodide emulsion containing surface- and internally-fogged grains (av. grain size: 0.06 μm; variation coefficient: 16%; AgI content: 0.3 mol %) | silver 0.02 g |
| Gelatin | 1.0 g |
| Additive P-1 | 0.2 g |
| Color-mixing inhibitor Cpd-J | 0.1 g |
| Color-mixing inhibitor Cpd-M | 0.05 g |
| Color-mixing inhibitor Cpd-A | 0.1 g |
| Layer 9: Low green-sensitive emulsion layer | |
| Silver bromoiodide emulsion containing internally-fogged grains (av. grain size: 0.1 μm; AgI content: 0.1 mol %) | silver 0.05 g |
| Emulsion E' | silver 0.3 g |
| Emulsion F' | silver 0.1 g |
| Emulsion G' | silver 0.1 g |
| Gelatin | 0.5 g |
| Coupler C'-4 | 0.20 g |
| Coupler C'-7 | 0.10 g |
| Coupler C'-8 | 0.10 g |
| Coupler C'-11 | 0.10 g |
| Compound Cpd-B | 0.03 g |
| Compound Cpd-E | 0.02 g |
| Compound Cpd-F | 0.02 g |
| Compound Cpd-G | 0.02 g |
| Compound Cpd-H | 0.02 g |
| Compound Cpd-D | 10 mg |
| Additive F'-5 | 0.1 mg |
| Additive F'-3 | 0.2 mg |
| Additive F'-11 | 0.5 mg |
| Organic solvent having a high-boiling Oil-2 | 0.2 g |
| Layer 10: Medium green-sensitive emulsion layer | |
| Emulsion G' | silver 0.3 g |
| Emulsion H' | silver 0.1 g |
| Gelatin | 0.6 g |
| Coupler C'-4 | 0.1 g |
| Coupler C'-7 | 0.1 g |
| Coupler C'-8 | 0.1 g |
| Coupler C'-11 | 0.05 g |
| Compound Cpd-B | 0.03 g |
| Compound Cpd-E | 0.02 g |
| Compound Cpd-F | 0.02 g |
| Compound Cpd-G | 0.05 g |
| Compound Cpd-H | 0.05 g |
| Additive F'-5 | 0.08 mg |
| Organic solvent having a high-boiling point Oil-2 | 0.01 g |
| Layer 11: High green-sensitive emulsion layer | |
| Emulsion I' | silver 0.5 g |
| Gelatin | 1.1 g |
| Coupler C'-4 | 0.4 g |
| Coupler C'-7 | 0.2 g |
| Coupler C'-8 | 0.2 g |

| | |
|---|---|
| Coupler C'-12 | 0.1 g |
| Coupler C'-9 | 0.05 g |
| Compound Cpd-B | 0.08 g |
| Compound Cpd-E | 0.02 g |
| Compound Cpd-F | 0.02 g |
| Compound Cpd-G | 0.02 g |
| Compound Cpd-H | 0.02 g |
| Additive F'-2 | 0.3 mg |
| Organic solvent having a high-boiling point Oil-2 | 0.04 g |
| Additive F'-13 | 0.05 mg |
| Layer 12: Inter-layer | |
| Gelatin | 0.8 g |
| Additive F'-1 | 2.0 mg |
| Additive F'-8 | 2.0 mg |
| Dye D'-1 | 0.1 g |
| Dye D'-3 | 0.07 g |
| Dye D'-8 | 0.03 g |
| Dye D'-2 | 0.05 g |
| Layer 13: Yellow filter layer | |
| Yellow colloidal silver | silver 0.1 g |
| Gelatin | 1.3 g |
| Dye D'-5 | 0.05 g |
| Color-mixing inhibitor Cpd-A | 0.01 g |
| Additive F'-4 | 0.3 mg |
| Organic solvent having a high-boiling point Oil-1 | 0.01 g |
| Dye D'-7 | 0.03 g |
| Additive M-2 | 0.01 g |
| Layer 14: Inter-layer | |
| Gelatin | 0.6 g |
| Dye D'-9 | 0.02 g |
| Layer 15: Low blue-sensitive emulsion layer | |
| Emulsion K' | silver 0.2 g |
| Emulsion L' | silver 0.2 g |
| Gelatin | 0.9 g |
| Coupler C'-5 | 0.6 g |
| Additive F'-2 | 0.2 mg |
| Additive F'-5 | 0.4 mg |
| Addivive F'-8 | 0.05 mg |
| Layer 16: Medium blue-sensitive emulsion layer | |
| Emulsion L' | silver 0.1 g |
| Emulsion M' | silver 0.4 g |
| Gelatin | 0.7 g |
| Coupler C'-6 | 0.5 g |
| Additive F'-2 | 0.04 mg |
| Additive F'-8 | 0.04 mg |
| Layer 17: High blue-sensitive emulsion layer | |
| Emulsion N' | silver 0.4 g |
| Gelatin | 0.7 g |
| Coupler C'-6 | 0.5 g |
| Additive F'-2 | 0.4 mg |
| Additive F'-8 | 0.02 mg |
| Additive F'-9 | 1.0 mg |
| Layer 18: First protective layer | |
| Gelatin | 0.9 g |
| UV absorbent U'-1 | 0.04 g |
| UV absorbent U'-2 | 0.01 g |
| UV absorbent U'-3 | 0.03 g |
| UV absorbent U'-4 | 0.03 g |
| UV absorbent U'-5 | 0.05 g |
| UV absorbent U'-6 | 0.05 g |
| Organic solvent having a high-boiling point Oil-1 | 0.02 g |
| Formalin scavenger Cpd-C | 0.2 g |
| Cpd-I | 0.4 g |
| Latex dispersion of ethylacrylate | 0.05 g |
| Dye D'-3 | 0.05 g |
| Additive Cpd-J | 0.02 g |
| Additive F'-1 | 1.0 mg |
| Additive Cpd-N | 0.01 g |

| | |
|---|---|
| Additive F'-6 | 1.0 mg |
| Additive F'-7 | 0.5 mg |
| Additive M-2 | 0.05 g |
| Layer 19: Second protective layer | |
| Gelatin | 0.7 g |
| Silver bromoiodide emulsion (av. grain size: 0.06 μm; variation coefficient: 16%; AgI content: 1.0 mol %) | 0.1 g |
| Polymethylmethacrylate (av. grain size: 1.5 μm) | 0.1 g |
| Copolymer (1:1) of methylmethacrylate and acrylic acid (av. grain size: 1.5 μm) | 0.1 g |
| Silicone oil | 0.03 g |
| Surfactant W'-1 | 3.0 mg |
| Surfactant W'-2 | 0.03 g |
| Layer 20: Back layer | |
| Gelatin | 10 g |
| UV absorbent U'-1 | 0.05 g |
| UV absorbent U'-2 | 0.02 g |
| Organic solvent having a high-boiling point Oil-1 | 0.01 g |

| | |
|---|---|
| Layer 21: Back protective layer | |
| Gelatin | 5 g |
| Polymethylmethacrylate (av. grain size: 1.5 μm) | 0.03 g |
| Copolymer (4:6) of methylmethacrylate and acrylic acid (av. grain size: 1.5 μm) | 0.1 g |
| Surfactant W'-1 | 1 mg |
| Surfactant W'-2 | 10 mg |

Additive F'-1 was added to each of the silver halide emulsion layers. Further, gelatin hardener H-1, coating surfactants W'-3 and W'-4, and emulsifying surfactant W'-5 or W'-6 were added to each layer.

Still further, phenol 1,2-benzisothiazoline-3-one, 2-phenoxyethanol, phenyl isothiocyanate, and phenetyl alcohol were added as anticeptcs and antifungal agents.

The structures of the compounds used in this example will be specified below:

C'-1

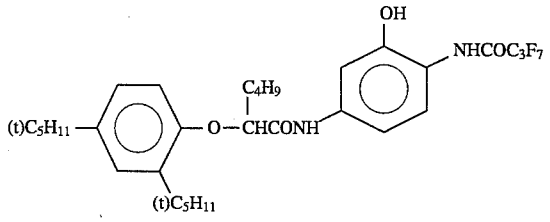

C'-2

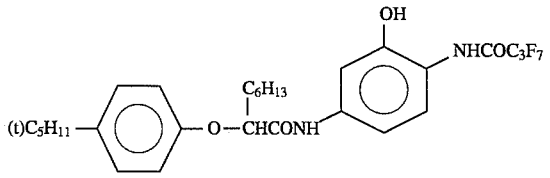

C'-3

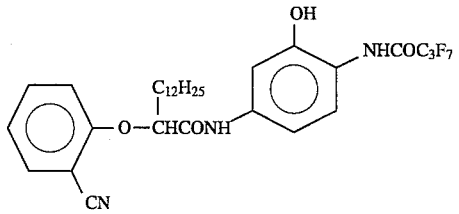

C'-4

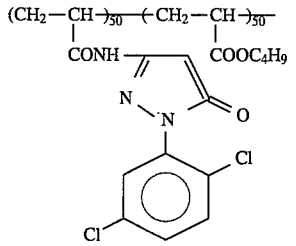

number indicating wt %
Av. molecular weight: about 25,000

-continued
C'-5
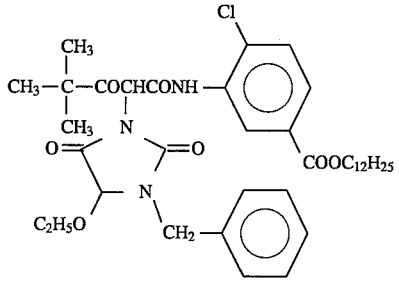
C'-6
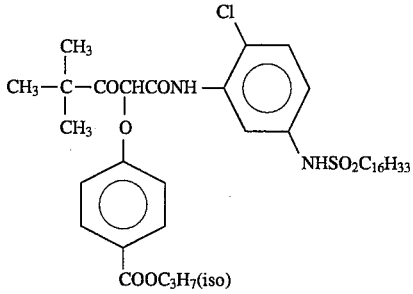
C'-7
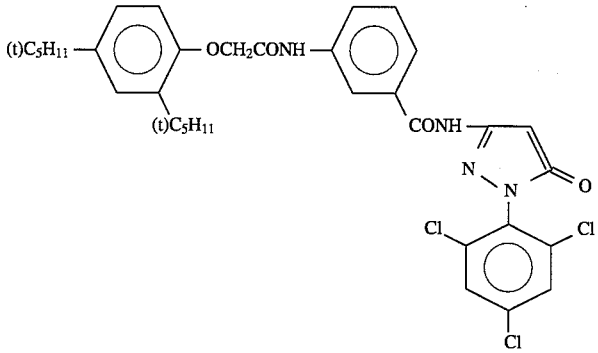
C'-8
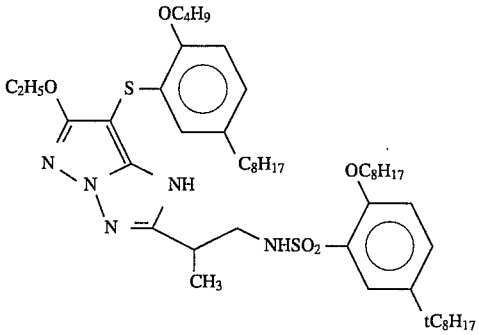
C'-9
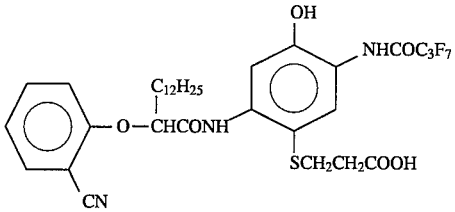

-continued
C'-10
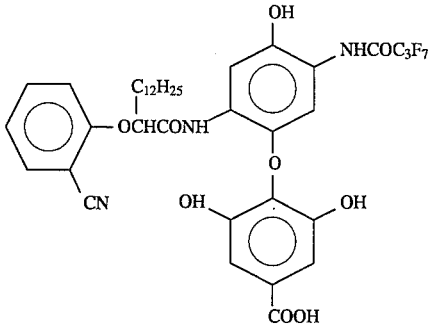
C'-11
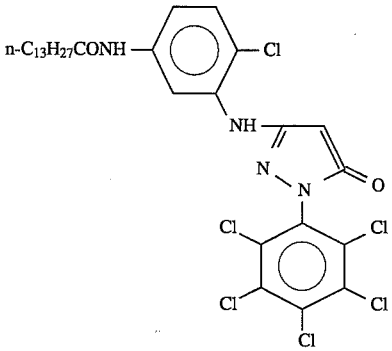
C'-12
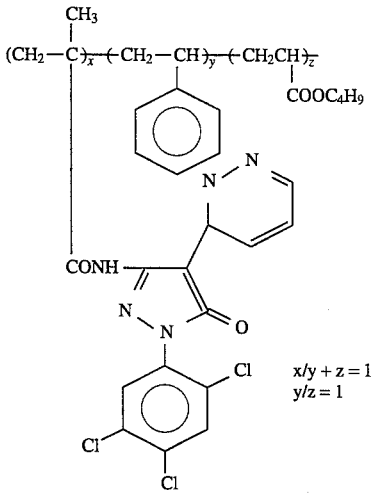
Dibutyl phthalate — Oil-1
Triycresylphosphate — Oil-2
Oil-3
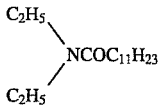
Cpd-A
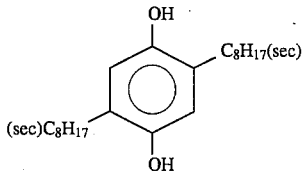

-continued
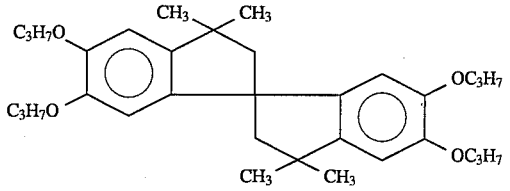
Cpd-B
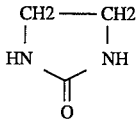
Cpd-C
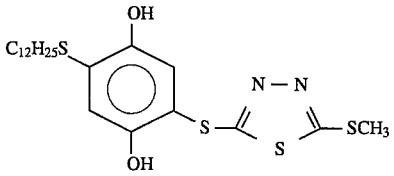
Cpd-D
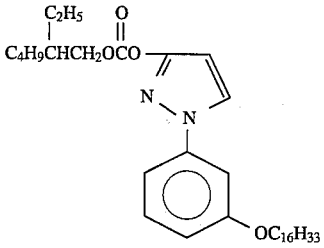
Cpd-E
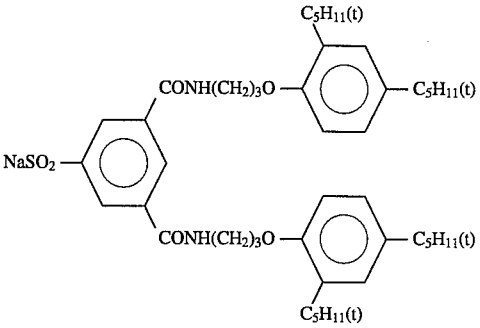
Cpd-F
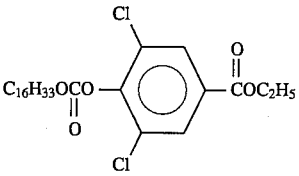
Cpd-G
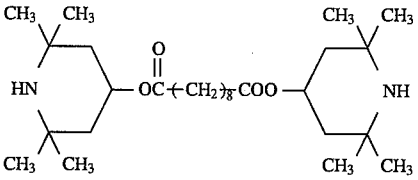
Cpd-H
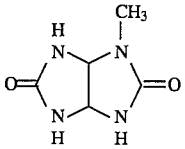
Cpd-I -continued
Cpd-J
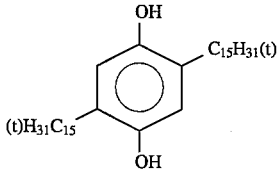
Cpd-K
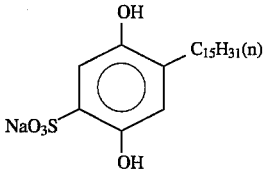
Cpd-L
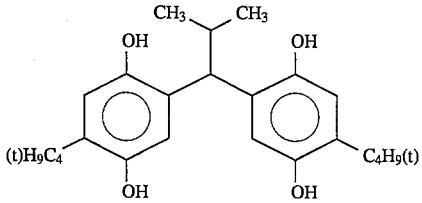
Cpd-M
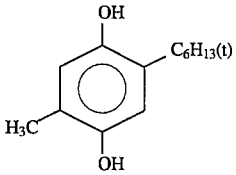
Cpd-N
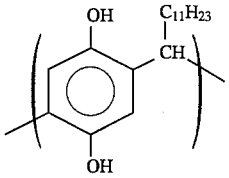
U'-1
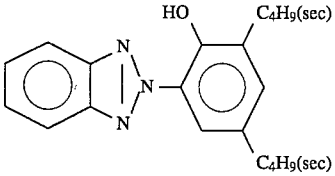
U'-2
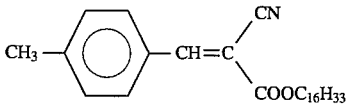
U'-3
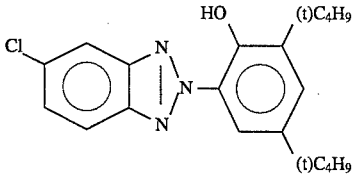
U'-4
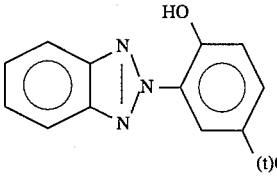

-continued
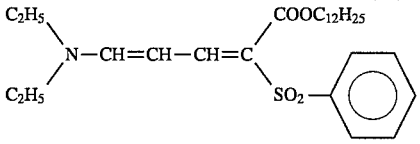
U'-5
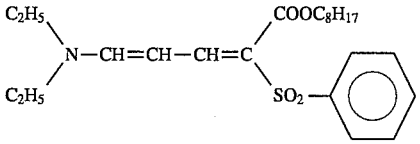
U'-6
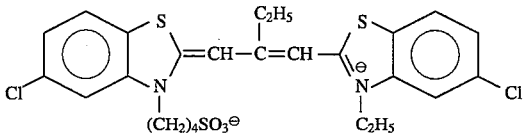
S'-1
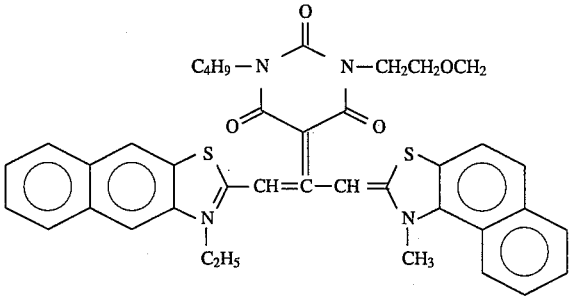
S'-2
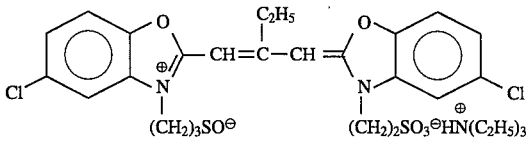
S'-3
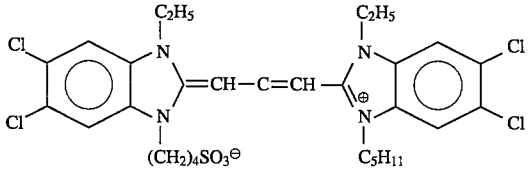
S'-4
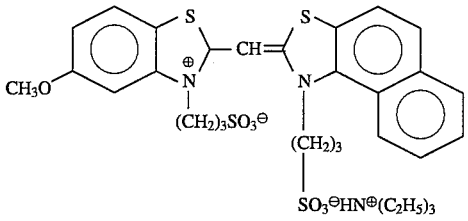
S'-5
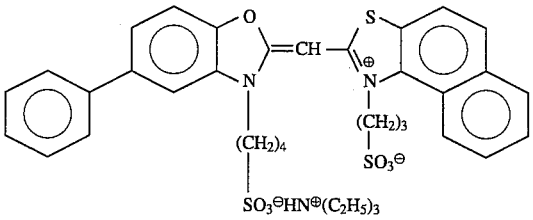
S'-6
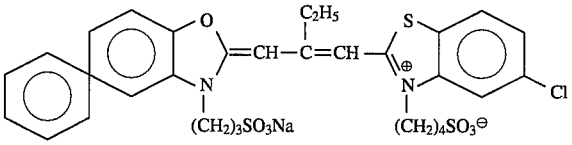
S'-7

-continued
S'-8
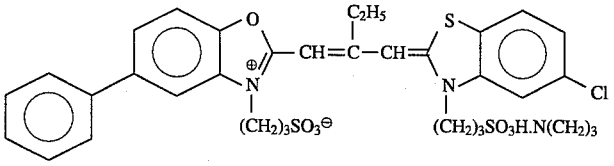
S'-9
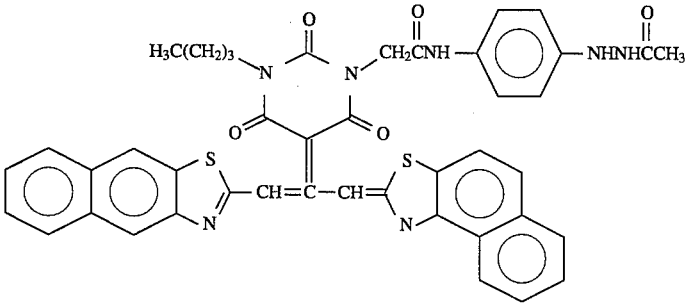
S'-10
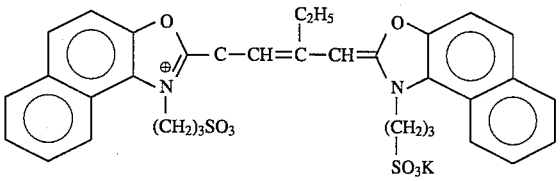
S'-11
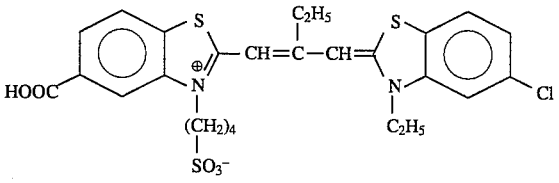
D-1
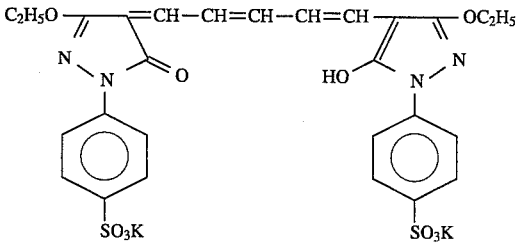
D-2
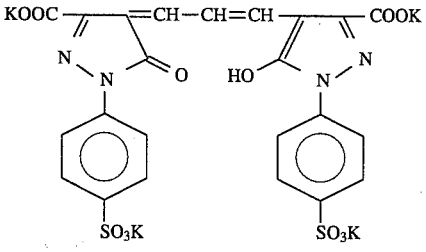
D-3
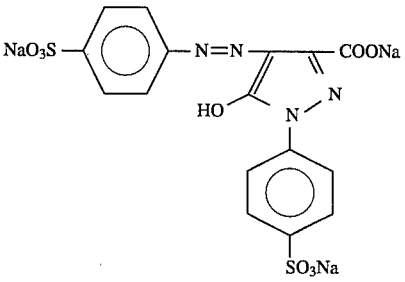

-continued
D-4
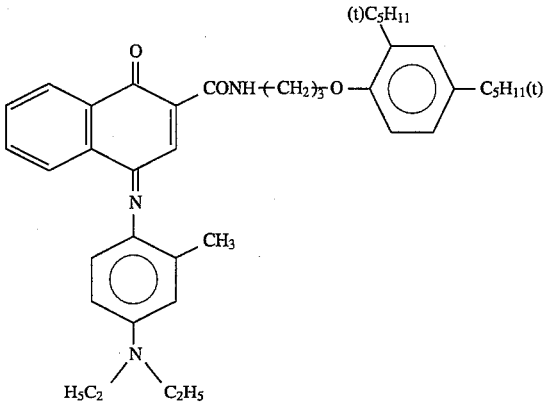
D-5
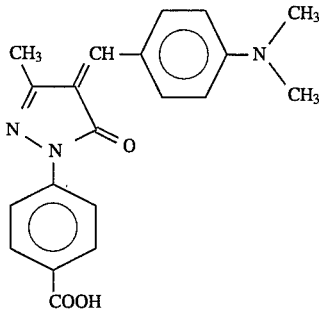
D-6
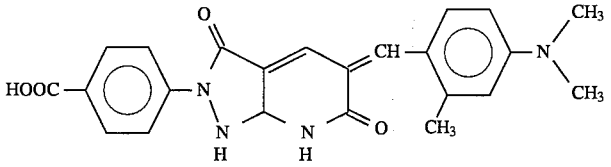
D-7
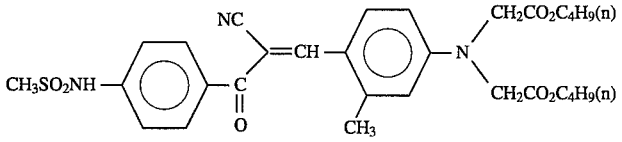
D-8
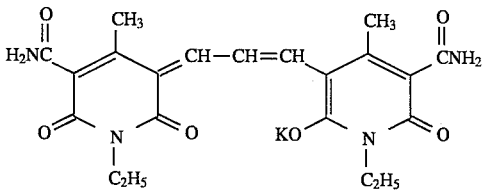
D-9
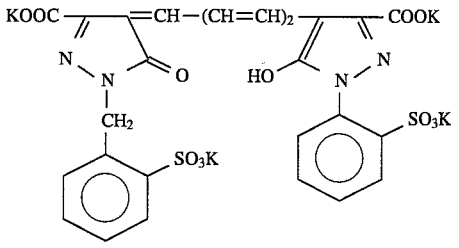
H-1
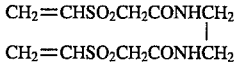

-continued
W'-1
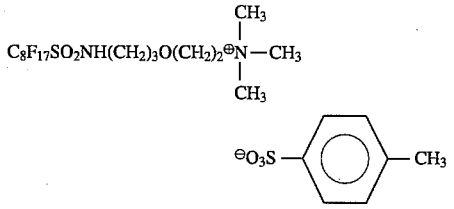
W'-2
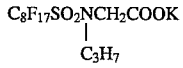
W'-3
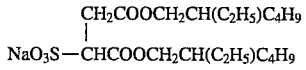
W'-4
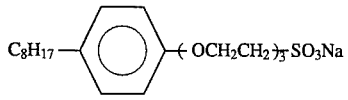
W'-5
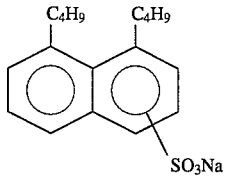
W'-6
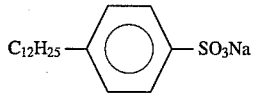
P-1
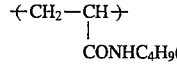
M-1
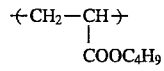
M-2
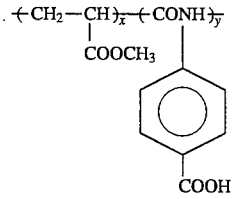
x/y = 1/1
F'-1
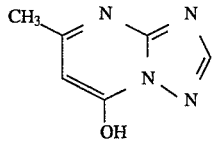
F'-2
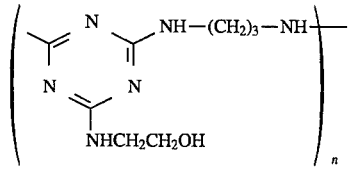
$-HNO_3$
F'-3
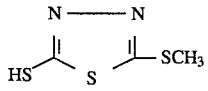

-continued
F'-4
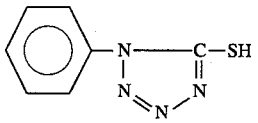
F'-5
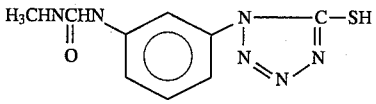
F'-6
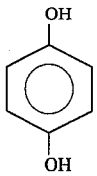
F'-7
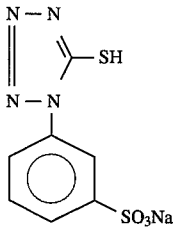
F'-8
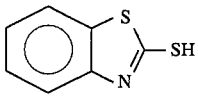
F'-9
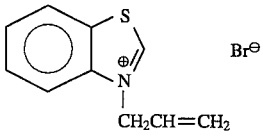
F'-10
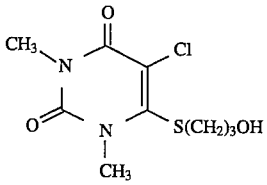
F'-11
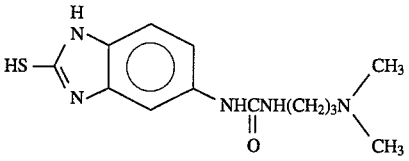
F'-12
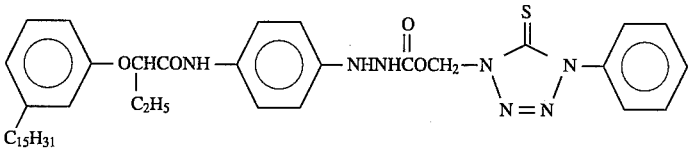

-continued

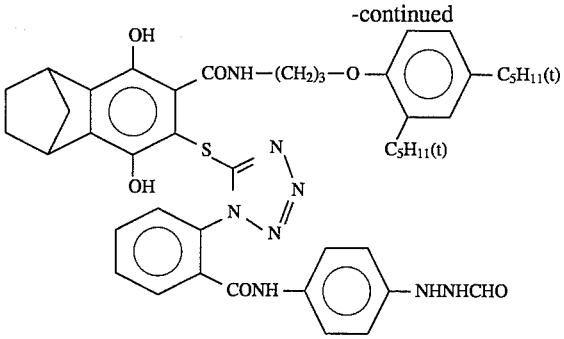

F'-13

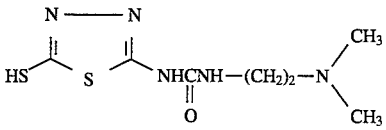

F'-14

The silver bromoiodide emulsions used in Sample 310 are as follows:

| Emulsion | Features | Av. GS (μm) | VC (%) | AgI C. (%) |
|---|---|---|---|---|
| A' | Monodispersed tetra-decahedral grains | 0.35 | 16 | 4.5 |
| B' | Monodispersed cubic, internal latent grains | 0.45 | 10 | 5.0 |
| C' | Monodispersed tetra-decahedral grains | 0.60 | 18 | 4.0 |
| D' | Polydispersed twinned grains having average aspect ratio of 1.5 | 1.10 | 25 | 3.0 |
| E' | Monodispersed cubic grains | 0.30 | 17 | 4.0 |
| F' | Monodispersed cubic grains | 0.40 | 16 | 4.0 |
| G' | Monodispersed cubic, internal latent grains | 0.50 | 11 | 4.5 |
| H' | Monodispersed tetra-decahedral grains | 0.65 | 9 | 3.5 |
| I' | Polydispersed twinned grains having average aspect ratio of 1.5 | 1.20 | 28 | 3.0 |
| K' | Monodispersed tetra-decahedral grains | 0.60 | 17 | 2.0 |
| L' | Monodispersed octa-hedral grains | 0.80 | 14 | 2.0 |
| M' | Monodispersed octa-hedral grains | 1.00 | 18 | 4.0 |
| N' | Polydispersed twinned grains having average aspect ratio of 1.5 | 1.45 | 27 | 3.5 |

Note:
"Av. GS," "VC," and "AgI C" stand for "average grain size," "variation coefficient," and "AgI content," respectively.

Spectral Sensitization of Emulsions A' to N'

| Emulsion | Sensitizing Dyes Added | Amount (g)* | Timing of Addition |
|---|---|---|---|
| A' | S'-9 | 0.002 | Right after chemical sensitization |
| | S'-1 | 0.125 | Right after chemical sensitization |
| | S'-11 | 0.125 | Right after chemical sensitization |
| B' | S'-1 | 0.01 | Right after forming grains |
| | S'-2 | 0.25 | Right after forming grains |

-continued

| | | | |
|---|---|---|---|
| C' | S'-1 | 0.02 | Right after chemical sensitization |
| | S'-9 | 0.002 | Right after chemical sensitization |
| | S'-2 | 0.25 | Right after chemical sensitization |
| D' | S'-11 | 0.10 | Right before chemical sensitization |
| | S'-2 | 0.01 | Right before chemical sensitization |
| | S'-7 | 0.01 | Right before chemical sensitization |
| E' | S'-3 | 0.5 | Right after chemical sensitization |
| | S'-10 | 0.05 | Right after chemical sensitization |
| | S'-4 | 0.1 | Right after chemical sensitization |
| F' | S'-3 | 0.3 | Right after chemical sensitization |
| | S'-4 | 0.1 | Right after chemical sensitization |
| G' | S'-3 | 0.25 | Right after forming grains |
| | S'-4 | 0.08 | Right after forming grains |
| H' | S'-3 | 0.2 | During the forming of grains |
| | S'-10 | 0.1 | Right after chemical sensitization |
| | S'-4 | 0.06 | During the forming of grains |
| I' | S'-3 | 0.3 | Right before chemical sensitization |
| | S'-4 | 0.07 | Right before chemical sensitization |
| | S'-8 | 0.1 | Right before chemical sensitization |
| K' | S'-5 | 0.2 | During the forming of grains |
| | S'-6 | 0.05 | During the forming of grains |
| L' | S'-5 | 0.22 | Right after forming grains |
| | S'-6 | 0.06 | Right after forming grains |
| M' | S'-5 | 0.15 | Right after chemical sensitization |
| | S'-6 | 0.04 | Right after chemical sensitization |
| N' | S'-5 | 0.22 | Right after forming grains |
| | S'-6 | 0.06 | Right after forming grains |

Note*:
amount used per mol of silver halide

Sample 302 was prepared in the same way as Sample 1, except that emulsion 1 was used in the layer 15 in place of emulsions K' and L', and in the layer 16 in place of emulsion L' in the same coating amount of silver.

Sample 303 was prepared in the same way as Sample 301, except that 0.007 g/m$^2$ of SA-6 was added to the layers 17 and 18.

Samples 304 to 307 were prepared by the same method as Sample 303, except that emulsions 1' to 4' were used respectively in the layer 15 in place of emulsions K' and L' and in the layer 16 in place of emulsion L'.

Samples 301 to 307, thus prepared, were exposed for measuring their MTF values, and then developed in the method specified below. Another set of Samples 301 to 307 were bent by a predetermined angle and then developed, thereby to determine the change in density of each sample due to the pressure applied to it. The results were as is shown in the following Table 7.

| Processing Method | | |
|---|---|---|
| Process | Time | Temperature |
| First development | 6 min. | 38° C. |
| Water washing | 2 min. | " |
| Reversing | 2 min. | " |
| Color development | 6 min. | " |
| Adjustment | 2 min. | " |
| Bleaching | 6 min. | " |
| Fixing | 4 min. | " |
| Water washing | 4 min. | " |
| Stabilization | 1 min. | Room temp. |
| Drying | | |

The process solutions used in the above processing method had the compositions specified below:

| First Developing Solution | |
|---|---|
| Water | 700 ml |
| Nitrilo-N,N,N-trimethylene-phosphonic acid-5-sodium salt | 2 g |
| Sodium sulfite | 30 g |
| Sodium Hydroquinone monosulfonate | 20 g |
| Potassium carbonate | 33 g |
| 1-phenyl-4-methyl-4-hydroxymethyl-3-pyrazolidone | 2 g |
| Potassium bromide | 2.5 g |
| Potassium thiocyanate | 1.2 g |
| Potassium iodide | 2 mg |
| Water to make | 1000 ml |
| **Reversal solution** | |
| Water | 700 ml |
| Nitrilo-N,N,N-trimethylene-phosphonic acid-5-sodium salt | 3 g |
| Stannous chloride (dihydrate) | 1 g |
| P-aminophenol | 0.1 g |
| Sodium hydroxide | 8 g |
| Glacial acetic acid | 15 ml |
| Water to make | 1000 ml |
| **Color developing solution** | |
| Water | 700 ml |
| Nitrilo-N,N,N-trimethylene-phosphonic acid-5-sodium salt | 3 g |

| | |
|---|---|
| Sodium sulfite | 7 g |
| Trisodium phosphate (dodecahydrate) | 36 g |
| Potassium bromide | 1 g |
| Potassium iodide | 90 mg |
| Sodium hydroxide | 3 g |
| Citrazinic acid | 1.5 g |
| N-ethyl-N-β-methane-sulfonamidoethyl)-3-methyl-4-aminoaniline sulfate | 11 g |
| 3,6-dithiaoctane-1,8-diol | 1 g |
| Water to make | 1000 ml |
| **Adjusting water** | |
| Water | 700 ml |
| Sodium sulfite | 12 g |
| Sodium ethylenediamine-tetraacetate (dihydrate) | 8 g |
| Thioglycerin | 0.4 ml |
| water to make | 1000 ml |
| **Bleaching Solution** | |
| Water | 800 ml |
| Sodium ethylenediamine-tetraacetate (dihydrate) | 2 g |
| Ammonium ferric ethylenediamine tetraacetate (dihydrate) | 120 g |
| Potassium bromide | 100 g |
| Ammonium nitrate | 10 g |
| Water to make | 1000 ml |
| **Fixing Solution** | |
| Water | 800 ml |
| Sodium thiosulfate | 80.0 g |
| Sodium sulfite | 5.0 g |
| Sodium bisulfite | 5.0 g |
| Water to make | 1000 ml |
| **Stabilizing Solution** | |
| Water | 800 ml |
| Formalin (37 wt %) | 5.0 ml |
| Polyoxyethylene-p-mono-nonylphenyl ether (av. polymerization degree: 10) | 0.5 ml |
| Water to make | 1000 ml |

The same results were obtained when the samples were washed with the following washing solution, after they had been fixed.

| Washing Solution | |
|---|---|
| Disodium ethylenediamine tetraacetate | 0.4 g |
| Water to make | 1000 ml |
| pH adjusted by sodium hydroxide | 7.0 |

TABLE 7

| Sample | Emulsion Layer 15 | Emulsion Layer 16 | Compound in Layers 17 and 18 | Photographic Properties MTF value 1) | Photographic Properties Pressure Properties 2) |
|---|---|---|---|---|---|
| 301 (comp.) | K', L' | L', M' | — | 0.20 | 2 |
| 302 (comp.) | 1' | 1', M' | — | 0.23 | 1 |
| 303 (comp.) | K', L' | L', M' | SA-6 | 0.22 | 2 |
| 304 (Invention) | 1' | 1', M' | " | 0.26 | 1 |
| 305 (Invention) | 2' | 2', M' | " | 0.26 | 3 |
| 306 (Invention) | 3' | 3', M' | " | 0.26 | 4 |
| 307 (Invention) | 4' | 4', M' | " | 0.26 | 5 |

1) Value for a magenta image at 60 cycles/mm
2) One of 5 levels, visually determined by the change in density due to bend (5: best; 1: worst)

As is evident from Table 7, Samples 304 to 307, which were combination of tabular emulsions 1' to 4' of the invention and the compounds of the invention, excelled in sharpness represented by their MTF values. It is also clear from Table 7 that emulsions 2' to 4', which contained grains having many dislocation lines, helped to improve pressure resistance, and that emulsions 3' and 4', which contained grains not differing much in silver iodide content, helped to improve pressure resistance very much.

What is claimed is:

1. A silver halide color photographic light-sensitive material comprising a support and thereon at least one light-sensitive emulsion layer containing a silver halide emulsion comprising tabular grains having an average aspect ratio of 2 or more, and at least one of the emulsion layers contains a compound represented by the formula (III), or (IV):

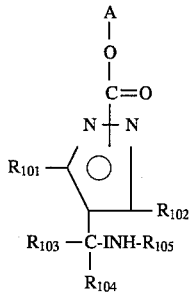

(III)

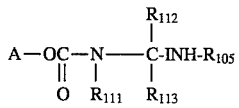

(IV)

wherein A represents a coupler residue or a redox group; INH is a developer inhibitor group; $R_{101}$ and $R_{102}$ each independently represents a hydrogen, an aryl group, an alkyl group, a halogen atom, an alkoxy group, an aryloxy group, an alkylthio group, an arylthio group, an amino group, a carbamoyl group, a sulfamoyl group, an alkoxycarbonyl group, an aryloxycarbonyl group, an acylamino group, a sulfonamido group, an alkoxycarbonylamino group, an aryloxycarbonylamino group, an ureido group, a cyano group, or a nitro group and in formula (III) does not contain an INH group; $R_{103}$ and $R_{104}$ each independently has the same meaning as $R_{101}$ and $R_{102}$; $R_{105}$ represents an unsubstituted phenyl group, an unsubstituted primary alkyl group, a primary alkyl group substituted with a halogen atom, an alkoxy group, an alkylthio group, an amino group, a carbamoyl group, a sulfamoyl group, an alkoxycarbonyl group, an acylamino group, a sulfonamido group, an alkoxycarbonylamino group, an ureido group, a cyano group, or a nitro group or a group represented by $—CO_2CH_2CO_2R_{106}$ wherein $R_{106}$ is an unsubstituted alkyl group having 3 to 6 carbon atoms; $R_{111}$, $R_{112}$ and $R_{113}$ each independently represents a hydrogen atom, an alkyl group, or an aryl group; wherein at least one of $R_{101}$ to $R_{104}$ is other than a hydrogen atom and any two of $R_{111}$, $R_{112}$ and $R_{113}$ can be divalent groups which bond together to form a ring.

2. The light-sensitive material according to claim 1, wherein the formula weight of the residue remaining after removing A and INH-$R_{105}$ from formula (III) is 142 to 240 and from formula (IV) is 81 to 240.

3. The light-sensitive material according to claim 1, which contains a compound represented by the following formula (A):

$$Q—SM^1 \qquad \text{Formula (A)}$$

wherein Q is a heterocyclic group directly or indirectly bonded to a group selected from the group consisting of $—SO_3M^2$, $—COOM^2$, —OH and $—NR^1R^2$, $M^1$ and $M^2$ each independently represents a hydrogen atom, an alkali metal atom, a quaternary ammonium group, or a quaternary phosphonium group; and $R^1$ and $R^2$ each independently represents a hydrogen atom, an unsubstituted alkyl group or an alkyl group substituted with a carboxyl group.

4. The light-sensitive material according to claim 1, wherein said silver halide emulsion is a monodispersed emulsion and contains grains having a variation coefficient of 0.25 or less, in terms of the grain sizes.

5. The light-sensitive material according to claim 1, wherein the projected area of hexagonal tabular silver halide grains each having two parallel surfaces and the ratio of the longest side to the shortest side of 2 or less, occupies 50% or more of the total projected area of all silver halide grains contained in said silver halide emulsion.

6. The light-sensitive material according to claim 1, wherein the same emulsion layer contains at least two emulsions of the type identical to said silver halide emulsion, or contains said silver halide emulsion and at least one silver halide emulsion of any other type.

7. The light-sensitive material according to claim 4, wherein the same emulsion layer contains at least two emulsions of the type identical to said silver halide emulsion, or contains said silver halide emulsion and at least one silver halide emulsion of any other type.

8. The light-sensitive material according to claim 5, wherein the same emulsion layer contains at least two emulsions of the type identical to said silver halide emulsion, or contains said silver halide emulsion and at least one silver halide emulsion of any other type.

9. The light-sensitive material according to claim 1, wherein at least 50% of the grains contained in said silver halide emulsion have at least 10 dislocation lines each.

10. The light-sensitive material according to claim 1, wherein said silver halide grains have a relative standard deviation of 30% or less in terms of silver iodide content.

11. The light-sensitive material according to claim 1, wherein the formula weight of the residue remaining after removing A and INH-$R_{105}$ from formula (III) is 142 to 180 and from formula (IV) is 90 to 180.

12. The light-sensitive material according to claim 1, wherein the formula weight of the residue remaining after removing A and INH-$R_{105}$ from formula (III) is 142 to 200 and from formula (IV) is 81 to 200.

* * * * *